US005578414A

United States Patent [19]

Yamamoto et al.

[11] Patent Number: 5,578,414

[45] Date of Patent: Nov. 26, 1996

[54] SILVER HALIDE PHOTOGRAPHIC MATERIAL AND METHOD FOR PROCESSING THE SAME

[75] Inventors: Seiichi Yamamoto; Tetsuo Yoshida; Takanori Hioki, all of Kanagawa, Japan

[73] Assignee: Fuji Photo Film Co., Ltd., Kanagawa, Japan

[21] Appl. No.: 423,708

[22] Filed: Apr. 18, 1995

[30] Foreign Application Priority Data

Apr. 19, 1994 [JP] Japan ..... 6-103272

[51] Int. Cl.[6] ..... G03C 1/06; G03C 1/20

[52] U.S. Cl. ..... 430/264; 430/577; 430/598

[58] Field of Search ..... 430/264, 569, 430/577, 598

[56] References Cited

U.S. PATENT DOCUMENTS

| | | | |
|---|---|---|---|
| 4,268,620 | 5/1981 | Iytaka et al. | 430/264 |
| 4,699,873 | 10/1987 | Takahashi et al. | 430/264 |
| 4,837,140 | 6/1989 | Ikeda et al. | 430/577 |
| 4,851,321 | 7/1989 | Takagi et al. | 430/264 |
| 5,139,921 | 8/1992 | Takagi et al. | 430/264 |
| 5,340,694 | 8/1994 | Hioki et al. | 430/264 |

*Primary Examiner*—Thorl Chea

*Attorney, Agent, or Firm*—Sughrue, Mion, Zinn, Macpeak & Seas

[57] ABSTRACT

A silver halide photographic material is disclosed, which comprises a support having thereon at least one silver halide emulsion layer, wherein the emulsion layer or other hydrophilic colloid layer contains at least one hydrazine compound and at least one compound represented by the following formula (I):

(I)

An image forming method is also described, which comprises development processing the above-described image exposed silver halide photographic material with a developing solution comprising (1) from 0.2 to 0.75 mol/liter of dihydroxybenzene based developing agent, (2) from 0.001 to 0.06 mol/liter of 1-phenyl-3-pyrazolidone or p-aminophenol auxiliary developing agent, (3) from 0.3 to 1.2 mol/liter of free sulfite ion, and (4) a compound represented by the following formula (E); and the concentration ratio of the compound represented by formula (E) to the dihydroxybenzene developing agent is from 0.03 to 0.12, and the developing solution has a pH value of from 9.0 to 12.0.

(E)

6 Claims, No Drawings

SILVER HALIDE PHOTOGRAPHIC MATERIAL AND METHOD FOR PROCESSING THE SAME

FIELD OF THE INVENTION

The present invention relates to a silver halide photographic material. More particularly, the present invention relates to a super high contrast silver halide photographic material suitable for a scanner or an image setter using an He-Ne laser or a laser diode as a light source.

BACKGROUND OF THE INVENTION

An image formation system which shows super high contrast photographic properties (particularly with a γ value of 10 or more) is required in the field of graphic arts to obtain good image reproduction of continuous tone by dot images or reproduction of line images.

An image formation system has been desired which comprises developing a photographic material using a processing solution having an excellent storage stability to provide super high contrast photographic properties. By way of example, a system has been proposed which comprises processing a surface latent image type silver halide photographic material containing a specific acylhydrazine compound with a developing solution containing 0.15 mol/liter or more of a sulfite preservative and having a pH value of from 11.0 to 12.3 to form a super high contrast negative image with a γ value of more than 10 as disclosed in U.S. Pat. Nos. 4,166,742, 4,168,977, 4,221,857, 4,224,401, 4,243,739, 4,272,606 and 4,311,781. This novel image formation system is characterized in that silver iodobromide or silver chloroiodobromide can be used in contrast to conventional super high contrast image formation methods in which only silver chlorobromide having a high silver chloride content could be used. Furthermore, the system has a comparatively good storage stability because it can contain a large amount of a sulfite preservative as opposed to the conventional lith developing solution which could use only a slight amount of a sulfite preservative.

On the other hand, a scanner and an image setter having an oscillating wavelength of from 600 nm to 700 nm have recently been widely propagated by the development of a laser and a light emitting diode, and the development of a super high contrast photographic material applicable to these power units has been strongly desired. Combinations of sensitizing dyes having preferred color sensitivities with hydrazine compounds are disclosed in JP-A-4-178644, JP-A-4-275541, JP-A-4-311946 and JP-A-5-224330 (the term "JP-A" as used herein refers to a "published unexamined Japanese patent application"); however, they are not yet satisfactory with respect to sensitivities, residual coloring (after processing), and fluctuations of the properties of photographic materials during storage.

SUMMARY OF THE INVENTION

An object of the present invention is to provide a silver halide photographic material for an He-Ne laser or a laser diode with which extremely high contrast and high sensitive photographic properties having a γ value of more than 10 and less residual coloring after processing can be obtained.

Another object of the present invention is to provide a silver halide photographic material having the above described properties and further less fluctuations of the properties during storage.

These and other objects of the present invention have been attained by a silver halide photographic material, which comprises a support having thereon at least one silver halide emulsion layer, wherein the emulsion layer or other hydrophilic colloid layer contains at least one hydrazine compound and at least one compound represented by following formula (I):

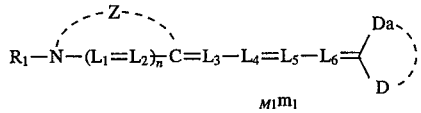

(I)

wherein $R_1$ represents an alkyl group; Z represents an atomic group necessary for forming a 5- or 6-membered nitrogen-containing heterocyclic ring; D and Da represent an atomic group necessary for forming a non-cyclic or cyclic acid nucleus; $L_1$, $L_2$, $L_3$, $L_4$, $L_5$ and $L_6$ each represents a methine group; $M_1$ represents a charge neutralizing counter ion; $m_1$ represents a number of 0 or more necessary for neutralizing a charge in the molecule; and n represents 0 or 1.

Furthermore, these and other objects of the present invention have been attained by an image forming method, which comprises the steps of (a) imagewise exposing the above-described silver halide photographic material, and then (b) developing the exposed silver halide photographic material with a developing solution comprising (1) from 0.2 to 0.75 mol/liter of dihydroxybenzene developing agent, (2) from 0.001 to 0.06 mol/liter of 1-phenyl-3-pyrazolidone or p-aminophenol auxiliary developing agent, (3) from 0.3 to 1.2 mol/liter of free sulfite ion, and (4) a compound represented by the following formula (E), wherein a concentration ratio by mol of the compound represented by formula (E) to the dihydroxybenzene developing agent is from 0.03 to 0.12, and the developing solution has a pH value of from 9.0 to 12.0,

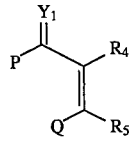

(E)

wherein $R_4$ and $R_5$ each represents a hydroxyl group, an amino group, an acylamino group, an alkylsulfonylamino group, an arylsulfonylamino group, an alkoxycarbonylamino group, a mercapto group or an alkylthio group; P and Q each represents a hydroxyl group, a carboxyl group, an alkoxy group, a hydroxyalkyl group, a carboxyalkyl group, a sulfo group, a sulfoalkyl group, an amino group, an aminoalkyl group, an alkyl group or an aryl group, or P and Q may be bonded with each other to represent an atomic group necessary for forming a 5- to 8-membered ring together with the two vinyl carbon atoms substituted by $R_4$ and $R_5$ and the carbon atom substituted by $Y_1$, in which $Y_1$ represents =O or =N—$R_6$; and $R_6$ represents a hydrogen atom, a hydroxyl group, an alkyl group, an acyl group, a hydroxyalkyl group, a sulfoalkyl group, or a carboxyalkyl group.

Moreover, these and other objects of the present invention have been attained by a processing method of a silver halide photographic material, which comprises processing the above-described silver halide photographic material after an image formation with a fixing solution obtained by diluting a concentrated fixing solution to a prescribed concentration, wherein the concentrated fixing solution comprises at least thiosulfate, a water-soluble aluminum salt and a compound selected from iminodiacetic acid, gluconic acid, 5-sulfosalicylic acid, derivatives thereof and salts thereof, and does not contain a boron compound.

DETAILED DESCRIPTION OF THE INVENTION

Examples of $R_1$ include an unsubstituted alkyl group having from 1 to 18 carbon atoms (e.g., methyl, ethyl, propyl, butyl, pentyl, octyl, decyl, dodecyl, octadecyl), a substituted alkyl {alkyl groups having from 1 to 18 carbon atoms and substituted by one or more substituents, which is not particularly limited and examples thereof include a carboxyl group, a sulfo group, a cyano group, a halogen atom (e.g., fluorine, chlorine, bromine), a hydroxyl group, an alkoxycarbonyl group having from 2 to 8 carbon atoms (e.g., methoxycarbonyl, ethoxycarbonyl, benzyloxycarbonyl), an alkanesulfonylaminocarbonyl group having from 2 to 8 carbon atoms, an acylaminosulfonyl group having from 2 to 8 carbon atoms, an alkoxy group having from 1 to 8 carbon atoms (e.g., methoxy, ethoxy, benzyloxy, phenethyloxy), an alkylthio group having from 1 to 8 carbon atoms (e.g., methylthio, ethylthio, methylthioethylthioethyl), an aryloxy group having from 6 to 20 carbon atoms (e.g., phenoxy, p-tolyloxy, 1-naphthoxy, 2-naphthoxy), an acyloxy group having from 1 to 3 carbon atoms (e.g., acetyloxy, propionyloxy), an acyl group having from 1 to 8 carbon atoms (e.g., acetyl, propionyl, benzoyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl), and an aryl group having from 6 to 20 carbon atoms (e.g., phenyl, 4-chlorophenyl, 4-methylphenyl, α-naphthyl).

Preferred examples of $R_1$ are an unsubstituted alkyl group (e.g., methyl, ethyl, n-propyl, n-butyl, n-pentyl, n-hexyl), a carboxyakyl group (e.g., 2-carboxyethyl, carboxymethyl, salts thereof), a sulfoalkyl group (e.g., 2-sulfoethyl, 3-sulfopropyl, 4-sulfobutyl, 3-sulfopropyl, salts thereof), and a methanesulfonylcarbamoylmethyl group or salts thereof.

More preferred are a sulfoalkyl group (e.g., 2-sulfoethyl, 3-sulfopropyl, 4-sulfobutyl, 3-sulfobutyl, salts thereof), and most preferred are a 2-sulfoethyl group or salts thereof.

Examples of the nucleus formed by Z include a thiazole nucleus [for example, a thiazole nucleus (e.g., thiazole, 4-methylthiazole, 4-phenylthiazole, 4,5-dimethylthiazole, 4,5-diphenylthiazole, 3,4-dihydronaphtho[4,5-a]thiazole), a benzothiazole nucleus (e.g., benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-phenoxybenzothiazole, 5-carboxybenzothiazole, 5-acetylbenzothiazole, 5-acetoxybenzothiazole, 5-phenethylbenzothiazole, 5-fluorobenzothiazole, 5-trifluoromethylbeznothiazole, 5-chloro-6-methylbenzothiazole, 5,6-dimethylbenzothiazole, 5,6-dimethoxybenzothiazole, 5,6-methylenedioxybenzothiazole, 5-hydroxy-6-methylbenzothiazole, tetrahydrobenzothiazole, 4-phenylbenzothiazole, 5,6-bismethylthiobenzothiazole), a naphthothiazole nucleus (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole, 8-methylthionaphtho[1,2-d]thiazole)], a thiazoline nucleus (for example, thiazoline, 4-methylthiazoline, 4-nitrothiazoline), an oxazole nucleus [for example, an oxazole nucleus (e.g., oxazole, 4-methyloxazole, 4-nitroxazole, 5-methyloxazole, 4-phenyloxazole, 4,5-diphenyloxazole, 4-ethyloxazole), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole, 5-acethylbenzoxazole), a naphthoxazole nucleus (e.g., naphtho[2,1-d]oxazole, naphtho[1,2-d]oxazole, naphtho[2,3-d]oxazole, 5-nitronaphtho[2,1-d ]oxazole ) ], an oxazoline nucleus (for example, 4,4-dimethyloxazoline), a selenazole nucleus [for example, a selenazole nucleus (e.g., 4-methylselenazole, 4-nitroselenazole, 4-phenylselenazole), a benzoselenazole nucleus (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole), a naphthoselenazole nucleus (e.g., naphtho[2,1-d]selenazole, naphtho[1,2-d]selenazole)], a selenazoline nucleus (for example, selenazoline, 4-methylselenazoline), a tellurazole nucleus [for example, a tellurazole nucleus (e.g., tellurazole, 4-methyltellurazole, 4-phenyltellurazole), a benzotellurazole nucleus (e.g., benzotellurazole, 5-chlorobenzotellurazole, 5-methylbenzotellurazole, 5,6-dimethylbenzotellurazole, 6-methoxybenzotellurazole), a naphthotellurazole nucleus (e.g., naphtho[2,1-d]tellurazole, naphtho[1,2-d]tellurazole)], a tellurazoline nucleus (for example, tellurazoline, 4-methyltellurazoline), a 3,3-dialkylindolenine nucleus (for example, 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine 3,3-dimethyl-5-methoxyindolenine, 3,3,5-trimethylindolenine, 3,3-dimethyl-5-chloroindolenine), an imidazole nucleus [for example, an imidazole nucleus (e.g., 1-alkylimidazole, 1-alkyl-4-phenylimidazole, 1-arylimidazole), a benzimidazole nucleus (e.g., 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-allyl-5,6-dichlorobenzimidazole, 1-allyl-5-chlorobenzimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole), a naphthimidazole nucleus (e.g., 1-alkylnaphtho[1,2-d]imidazole, 1-arylnaphtho[1,2-d]imidazole), wherein the alkyl group as a substituent on the above-described nucleus has preferably from 1 to 8 carbon atoms such as an unsubstituted alkyl group (e.g., methyl, ethyl, propyl, isopropyl, butyl) and a hydroxyalkyl group (e.g., 2-hydroxyethyl, 3-hydroxypropyl), and more preferably a methyl group or an ethyl group; and the aryl group as a substituent on the above-described nucleus represents an unsubstituted phenyl group, a phenyl group substituted by a halogen atom such as a chlorine atom, a phenyl group substituted by an alkyl group such as a methyl group, or an alkoxy group substituted by an alkoxy group such as a methoxy group], a pyridine nucleus (for example, 2-pyridine, 4-pyridine, 5-methyl-2-pyridine, 3-methyl-4-pyridine), a quinoline nucleus [for example, a quinoline nucleus (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, 6-chloro-4-quinoline, 5,6-dimethyl-4-quinoline), an isoquinoline nucleus (e.g., 6-nitro-1-isoquinoline, 3,4-dihydro-1-isoquinoline, 6-nitro-3-isoquinoline)], an imidazo[4,5-b]quinoxaline nucleus (for example, 1,3-diethylimidazo[4,5-b]quinoxaline, 6-chloro- 1,3-diallylimidazo [4,5-b]quinoxaline, 6-chloro-1,3-dibenzylimidazo[4,5-b] quinoxaline, 6-chloro-1,3-diphenylimidazo[4,5-b] quinoxaline, 6-nitro-1,3-diallylimidazo[4,5-b]quinoxaline), an oxadiazole nucleus, a thiadiazole nucleus, a tetrazole nucleus, and a pyrimidine nucleus.

The nucleus formed by Z is more preferably a benzothiazole nucleus, a naphthothiazole nucleus, a naphthoxazole nucleus, a benzoimidazole nucleus, a 2-quinoline nucleus, and a 4-quinoline nucleus.

D and $D_a$ represent an atomic group necessary for forming an acid nucleus and may be in any form of the acid nuclei of conventional merocyanine dyes. The term "acid nucleus" as used herein refers to the nucleus defined, for example, by T. H. James, *The Theory of the Photographic Process,* the 4th edition, p.198 (Macmullan Co., 1977). In a preferred form, examples of substituents which participate in the resonance of D include a carbonyl group, a cyano group, a sulfonyl group, and a phenyl group. $D_a$ is the residual moiety of the atomic group necessary for forming the acid nucleus.

Specific examples thereof include those described in U.S. Pat. Nos. 3,567,719, 3,575,869, 3,804,634, 3,837,862, 4,002,480 and 4,925,777, and JP-A-167546.

When the acid nucleus is a non-cyclic nucleus, the terminal of the methine bond is such a group as derived from a malononitrile group, an alkanesulfonylacetonitrile group, a cyanomethyl benzofuranyl ketone group or a cyanomethyl phenyl ketone group.

When the acid nucleus formed by D and $D_a$ is a cyclic nucleus, a 5- or 6-membered heterocyclic ring comprising a carbon atom, a nitrogen atom or a chalcogen atom (typically, oxygen, sulfur, selenium, tellurium) is formed.

Preferred examples of the acid nucleus include 2-pyrazoline-5-one, pyrazolidine-3,5-dione, imidazoline-5-one, hydantoin, 2- or 4-thiohydantoin, 2-iminoxazoiidine-5-one, 2-oxazoline-5-one, 2-thiazoline-4-one, thiazolidine-4-one, thiazolidine-2,4-dione, rhodanine, thiazolidine-2,4-dithione, isorhodanine, indane-1,3-dinone, thiophene-3-one-1,1-dioxide, indoline-2-one, indoline-3-one, indazoline-3-one, 2-oxoindazolium, 3-oxoindazolium, 5,7-dioxo-6,7-dihydrothiazolo[3,2-a]pydimidine, cyclohexane-1,3-dione, 3,4-dihydroisoquinoline-4-one, 1,3-dioxane-4,4-dione, barbituric acid, 2-thiobarbituric acid, chroman-2,4-dione, indazoline-2-one, pyrido[1,2-a]pyrimidine-1,3-dione, pyrazolo[1,5-b]quinazolone, pyrazolo[1,5-a]benzimidazole, pyrazolopyridone, 1,2,3,4-tetrahydroquinoline-2,4-dione, 3-oxo-2,3-dihydrobenzo[d]thiophene-1,1-dioxide, 3,3-dicyanomethine-2,3-dihydrobenzo[d]thiophene-1,1-dioxide and 2-thiohydantoin.

Among these, a 2-thiohydantoin nucleus, 2-oxazoline-5-one and a rhodanine nucleus are more preferred, and a rhodanine nucleus is particularly preferred.

Examples of substituents bonding to a nitrogen atom contained in the above-described acidic nucleus include a hydrogen atom, an alkyl group having from 1 to 18 carbon atoms (e.g., methyl, ethyl, propyl, isopropyl, butyl, isobutyl, hexyl, octyl, dodecyl, octadecyl), an aryl group having from 6 to 18 carbon atoms (e.g., phenyl, 2-naphthyl, 1-naphthyl), and a heterocyclic group having from 1 to 18 carbon atom (e.g., 2-pyridyl, 2-thiazolyl, 2-furyl). These substituents may be further substituted by one or more substituents. Examples thereof include a carboxyl group, a sulfo group, a cyano group, a nitro group, a halogen atom (e.g., fluorine, chlorine, iodine, bromine), a hydroxyl group, an alkoxy group having from 1 to 8 carbon atoms (e.g., methoxy, ethoxy, benzyloxy, phenethyloxy), an aryloxy group having from 6 to 15 carbon atoms (e.g., phenoxy), an acyloxy group having from 1 to 8 carbon atoms (e.g., acetyloxy), an alkoxycarbonyl group having from 1 to 8 carbon atoms, an acyl group having from 1 to 8 carbon atoms, a sulfamoyl group, a carbamoyl group, an alkanesulfonylaminocarbonyl group having from 2 to 8 carbon atoms (e.g., methanesulfoylaminocarbonyl), an aryl group having from 6 to 15 carbon atoms (e.g., phenyl, 4-methylphenyl, 4-chlorophenyl, naphthyl), and a heterocyclic group having from 6 to 15 carbon atoms (e.g., pyrolidine-2-one-1-yl, tetrahydrofurfuryl, 2-morpholino). These substituents may be further substituted by one or more of these substituents.

$L_1$, $L_2$, $L_3$, $L_4$, $L_5$ and $L_6$ ($L_1$ to $L_6$) each represents a methine group or a substituted methine group {e.g., methine groups substituted by a substituted or unsubstituted alkyl group (e.g., methyl, ethyl, 2-carboxyethyl), a substituted or unsubstituted aryl group (e.g., phenyl, o-carboxyphenyl), a substituted or unsubstituted heterocyclic group (e.g., barbituric acid), a halogen atom (e.g., chlorine, bromine), a substituted or unsubstituted alkoxy group (e.g., methoxy, ethoxy), a substituted or unsubstituted amino group (e.g., N,N-diphenylamino, N-methyl-N-phenylamino, N-methylpiperazino), or a substituted or unsubstituted alkylthio group (e.g., methylthio, ethylthio), which may be further substituted by one or more of these substituents}. Each of $L_1$ to $L_6$ may form a ring together with another methine group or with an auxochrome.

$L_1$, $L_2$, $L_3$, $L_4$ and $L_6$ are each preferably an unsubstituted methine group, and $L_5$ is preferably a methine group substituted by an unsubstituted alkyl group; and $L_1$, $L_2$, $L_3$, $L_4$ and $L_6$ are each more preferably an unsubstituted methine group, and $L_5$ is more preferably a methyl substituted-methine group.

$M_1m_1$ is included in the formula for the purpose of indicating the presence or absence of a cation or anion in the case where the ion is necessary for neutralizing an ionic charge of the dye.

Whether a given dye is a cation or an anion or whether it has a clear charge or not depends on the auxochrome(s) and substituent(s) thereof. Typical cations are an inorganic or organic ammonium ion (e.g., tetraalkylammonium ion, pyridinium ion, triethylamine salt, 1,8-diazabiscyclo[5,4,0]-7-undecene), an alkali metal ion (e.g., sodium ion, potassium ion), and an alkaline earth metal ion (e.g., calcium ion). On the other hand, the anion may be either inorganic or organic, and examples thereof include a halogen anion (e.g., fluorine ion, chlorine ion, bromine ion, iodine ion), a substituted arylsulfonate ion (e.g., p-toluenesulfonate ion, p-chlorobenzenesulfonate ion), an aryldisulfonate ion (e.g., 1,3-benzenedisulfonate ion, 1,5-naphthalenedisulfonate ion, 2,6-naphthalenedisulfonate ion), an alkylsulfate ion (e.g., methylsulfate ion, ethylsulfate ion), a sulfate ion, a thiocyanate ion, a perchlorate ion, a tetrafluoroborate ion, a picrate ion, an acetate ion, a trifluoromethanesulfonate ion, and a hexafluorophosphate ion.

The charge-neutralizing counter ion may be an ionic polymer or a dye having an opposite charge to the dye, or may be a metal complex ion (e.g., bisbenzene-1,2-dithiolatonickel(III)).

Among these, an ammonium ion (e.g., triethylamine salt, 1,8-diazabiscyclo[5,4,0]-7-undecene) and an alkali metal ion (e.g., sodium ion, potassium ion) are preferred; an alkali metal ion (e.g., sodium ion, potassium ion) are more preferred; and a sodium ion is particularly preferred.

n is preferably 0.

The compound represented by formula (I) is more preferably selected from the compounds represented by the following formula (II):

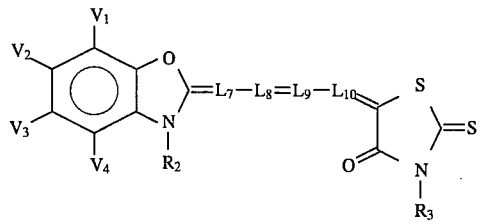

(II)

$M_2m_2$ wherein $R_2$ and $R_3$ each represents an alkyl group containing a group having a water solubility as a form of free acid or salt, that is, an alkyl group having a group capable of imparting a water solubility to the compound represented by formula (II); $V_1$, $V_2$, $V_3$ and $V_4$ each represents a hydrogen atom or a monovalent substituent, provided that the substituents represented by $V_1$, $V_2$, $V_3$ and $V_4$ do not form a ring with each other, and the total molecular weight of $V_1$, $V_2$, $V_3$ and $V_4$ is 50 or less; $L_7$, $L_8$, $L_9$ and $L_{10}$ each represents a substituted or unsubstituted methine group; $M_2$ represents a charge neutralizing counter ion; and $m_2$ represents a number of 0 or more necessary for neutralizing a charge in the molecule.

The compound represented by formula (II) is described in detail below.

$R_2$ and $R_3$ each represents an alkyl group having a group capable of imparting a water solubility to the compound. The water solubility used herein means that at least 0.5 g of the compound dissolves in 1 liter of water at room temperature.

Specific examples of $R_2$ and $R_3$ include the following. Of these, the alkyl group having an acid group is preferred.

$$-Q_1-CO_2M,\ -Q_1-SO_3M,\ -Q_1-\overset{\overset{\displaystyle O}{\|}}{C}NSO_2R_{10},\ -Q_1-PO_3M,$$

$$-Q_1-N(R_{10})_2,\ -Q_1-\overset{\oplus}{N}(R_{10})_3$$

wherein $Q_1$ represents an alkylene group, an arylene group or an alkenylene group; M represents a hydrogen atom, an ammonium group, an alkali metal (e.g., sodium, potassium), an alkaline earth metal (e.g., calcium), an organic amine salt (e.g., triethylamine salt, 1,8-diazabicyclo[5,4,0]-7-undecene salt); $R_{10}$ represents an alkyl group or an aryl group.

$Q_1$ is preferably an alkylene group (e.g., methylene, ethylene, propylene, butylene, pentylene), an arylene group (e.g., phenylene), an alkenylene group (e.g., propenylene), or a group of a combination of these groups.

These groups may be substituted by one or more of an amido group, an ester group, a sulfoamido group, a sulfonic acid ester group, a ureido group, a sulfonyl group, a sulfinyl group, a thioether group, an ether group, a carbonyl group, and an amino group.

Specific examples of $Q_1$ are shown below.

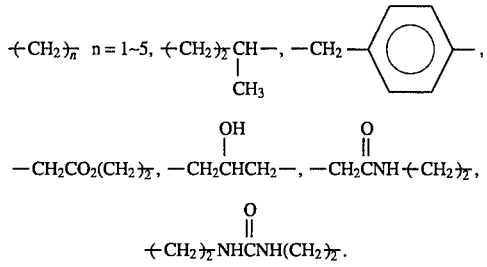

In addition to the above, linking groups disclosed in European Patent No. 472,004, pages 5 to 7 can be used. A methylene group, an ethylene group, a propylene group and a butylene group are particularly preferred.

$R_{10}$ is preferably an alkyl group (e.g., methyl, ethyl, hydroxyethyl), or an aryl group (e.g., phenyl, 4-chlorophenyl).

$R_2$ is preferably a sulfoalkyl group (e.g., sulfobutyl, 3-sulfobutyl, 3-sulfopropyl, 2-sulfoethyl).

$R_3$ is preferably a carboxyalkyl group (e.g., carboxymethyl, 2-carboxyethyl).

$R_2$ is more preferably a 2-sulfoethyl group and $R_3$ is more preferably a carboxymethyl group.

$V_1$, $V_2$, $V_3$ and $V_4$ each represents a hydrogen atom or any of monovalent substituents, but preferably represents a hydrogen atom, an alkyl group (e.g., methyl, ethyl, propyl), a substituted alkyl group (e.g., hydroxymethyl), an alkoxy group (e.g., methoxy, ethoxy), a halogen atom (e.g., fluorine, chlorine), a hydroxyl group, an acyl group (e.g., acetyl), a carbamoyl group, a carboxyl group, or a cyano group.

More preferred of them are a hydrogen atom, an alkyl group (e.g., methyl), and an alkoxy group (e.g., methoxy). Particularly preferred are a hydrogen atom.

The total molecular weight of $V_1$, $V_2$, $V_3$ and $V_4$ means the molecular weight simply totaled molecular weights of $V_1$, $V_2$, $V_3$ and $V_4$.

For example, when $V_1$, $V_2$, $V_3$ and $V_4$ are each a hydrogen atom, the total molecular weight thereof is 4, and when $V_1$, $V_2$ and $V_4$ are each a hydrogen atom and $V_3$ is a phenyl group, the total molecular weight thereof is 80.

$L_7$, $L_8$, $L_9$ and $L_{10}$ each represents an unsubstituted methine group or a substituted methine group {for example, substituted by one or more of a substituted or unsubstituted alkyl group (e.g., methyl, ethyl, n-propyl, i-propyl, cyclopropyl, butyl, 2-carboxyethyl), a substituted or unsubstituted aryl group (e.g., phenyl, naphthyl, anthryl, o-carboxyphenyl), a heterocyclic group (e.g., pyridyl, thienyl, furano, barbituric acid), a halogen atom (e.g., chlorine, bromine), an alkoxy group (e.g., methoxy, ethoxy), an amino group (e.g., N,N-diphenylamino, N-methyl-N-phenylamino, N-methylpiperazino), or an alkylthio group (e.g., methylthio, ethylthio)}, and each may form a ring with other methine group, or can form a ring with an auxochrome.

$L_7$, $L_8$ and $L_{10}$ are each preferably an unsubstituted methine group.

$L_9$ is preferably an unsubstituted alkyl group (e.g., methyl, ethyl), or a substituted methine group, and more preferably a methyl group-substituted methine group.

$M_2$ represents the same groups as those defined for $M_1$. $M_2$ preferably represents the same groups as the preferable groups defined for $M_1$. $M_2$ is particularly preferably a sodium ion.

Particularly preferred combination of the substituents in formula (II) is described below.

$V_1$, $V_2$, $V_3$ and $V_4$ are each a hydrogen atom;

$R_2$ is a sulfoalkyl group or a salt thereof (preferably a sulfoethyl group or a salt thereof);

$R_3$ is a carboxyalkyl group or a salt thereof (preferably a carboxymethyl group or a salt thereof);

$L_7$, $L_8$ and $L_{10}$ are each a hydrogen atom; and $L_9$ is a methyl group-substituted methine group.

This preferable compound can be represented by the following formula (II-a):

(II-a)

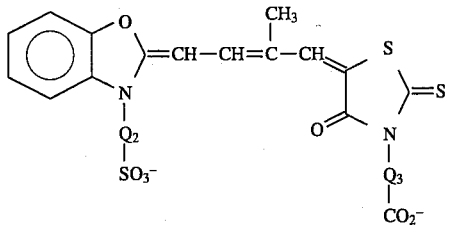

$M_3m_3$ wherein $M_3$ has the same meaning as $M_1$ or $M_2$, and is preferably the same groups as the preferable groups defined for $M_1$ and $M_2$, and is more preferably a sodium ion; $m_3$ has the same meaning as $m_1$ or $m_2$; and $Q_2$ and $Q_1$ each has the same meaning as $Q_1$, and is preferably an alkylene group (e.g., methylene, ethylene, propylene, butylene).

$Q_2$ is more preferably an ethylene group, and $Q_3$ is particularly preferably a methylene group.

Representative examples of the compounds represented by formula (I) or (II) are shown below; however, the present invention should not be construed as being limited thereto.

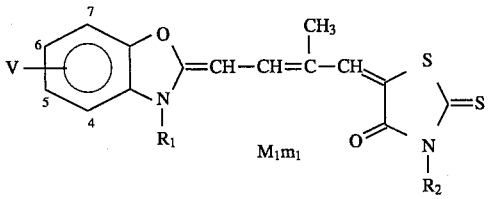

$M_1m_1$

| Compound No. | $R_1$ | $R_2$ | V | $M_2$ | $m_1$ |
|---|---|---|---|---|---|
| I-1 | $(CH_2)_2SO_3^-$ | $CH_2CO_2^-$ | H | $Na^+$ | 2 |
| I-2 | " | " | " | $K^+$ | " |
| I-3 | " | " | " | $(C_2H_5)_3\overset{+}{N}H$ | " |
| I-4 | $(CH_2)_4SO_3^-$ | " | " | " | " |
| I-5 | $(CH_2)_3SO_3^-$ | " | " | " | " |
| I-6 | $(CH_2)_2CH(CH_3)SO_3^-$ | " | " | " | " |
| I-7 | $(CH_2)_4SO_3^-$ | " | 5-$OCH_3$ | " | " |
| I-8 | " | " | 5-F | $Na^+$ | " |
| I-9 | $(CH_2)_2SO_3^-$ | " | 5-$CH_3$ | " | " |
| I-10 | " | " | 5,6-$(CH_3)_2$ | " | " |
| I-11 | $(CH_2)_4SO_3^-$ | $(CH_2)_2SO_3^-$ | H | $K^+$ | " |
| 1-12 | $CH_2CO_2^-$ | $CH_2CO_2^-$ | " | $Na^+$ | " |
| 1-13 | $CH_2CO_2^-$ | $(CH_2)_2SO_3^-$ | " | " | " |
| I-14 | $(CH_2)_3CO_3^-$ | " | " | " | " |
| I-15 | $(CH_2)_4SO_3^-$ | $(CH_2)_2OH$ | " | $K^+$ | 1 |
| I-16 | " | $(CH_2)_2CO_2^-$ | " | " | 2 |
| I-17 | " | $(CH_2)_3CO_2^-$ | " | " | " |
| I-18 | " | $(CH_2)_5CO_2^-$ | " | " | " |
| I-19 | " | $(CH_2)_2NHC(=O)CH_3$ | " | " | 1 |
| I-20 | 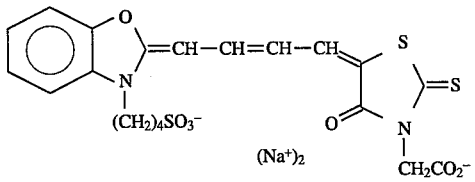 | | | | |

-continued
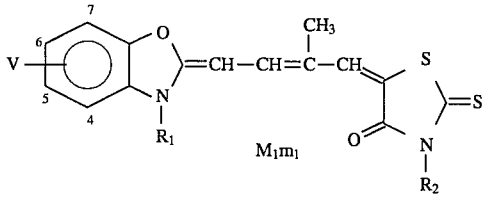
$M_1m_1$
| Compound No. | $R_1$ | $R_2$ | V | $M_2$ | $m_1$ |
|---|---|---|---|---|---|
| I-21 | 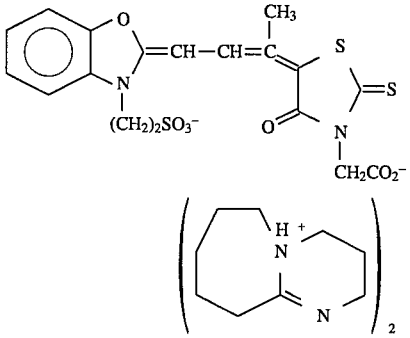 | | | | |
| I-22 | 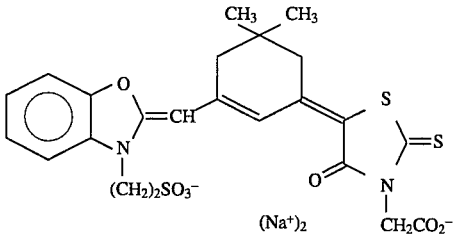 | | | | |
| I-23 | 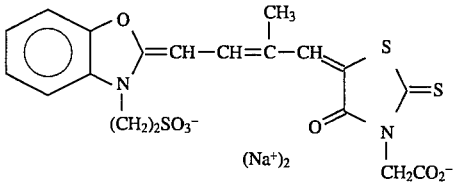 | | | | |
| I-24 | 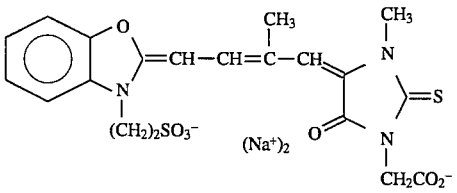 | | | | |
| I-25 | 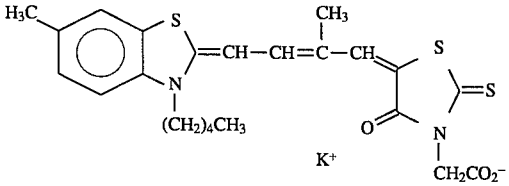 | | | | |
| I-26 | 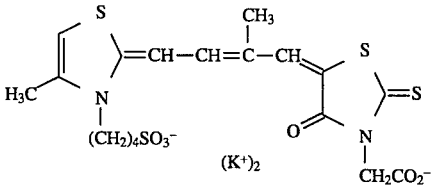 | | | | |

-continued
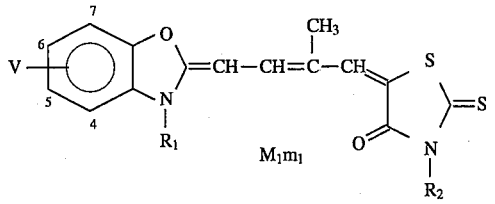
| Compound No. | $R_1$ | $R_2$ | V | $M_2$ | $m_1$ |
|---|---|---|---|---|---|
| I-27 | 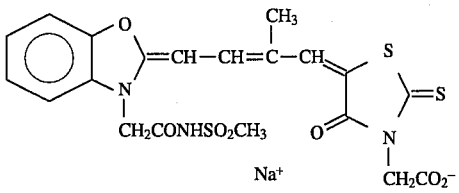 | | | | |
| I-28 | 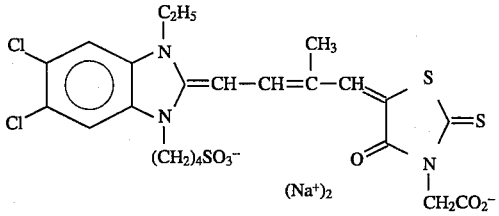 | | | | |
| I-29 | 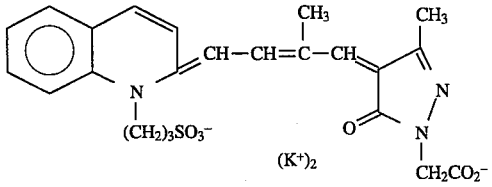 | | | | |
| I-30 | 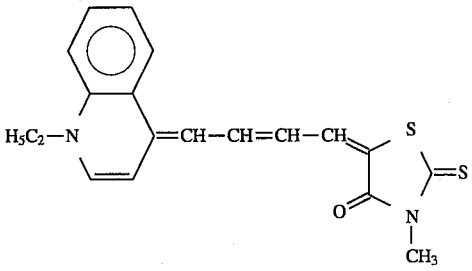 | | | | |
| I-31 | 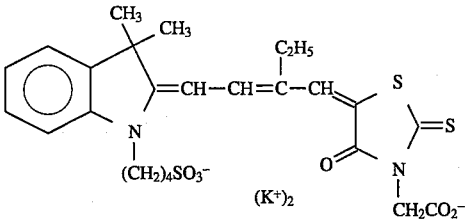 | | | | |
| I-32 | 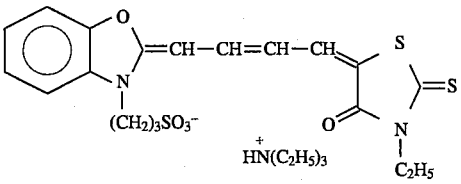 | | | | |

-continued

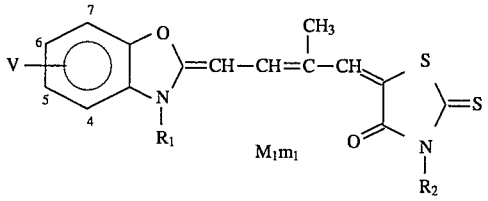

| Compound No. | $R_1$ | $R_2$ | V | $M_2$ | $m_1$ |
|---|---|---|---|---|---|
| I-33 | 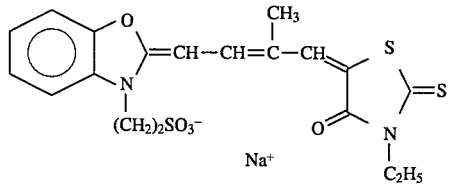 | | | | |
| I-34 | 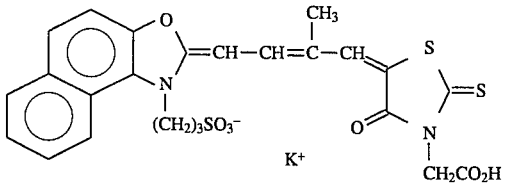 | | | | |

These compounds enumerated above can be synthesized by, for example, the methods described in JP-A-6-228446; F. M. Hamer, *Heterocyclic Compounds—Cyanine Dyes and Related Compounds* (John Wiley & Sons, New York, London, 1964); D. M. Sturmer, *Heterocyclic Compounds—Special Topics in Heterocyclic Chemistry-*, Chapter 18, Section 14, pp. 482–515, John Wiley & Sons, New York, London (1977); and Rodd's *Chemistry of Carbon Compounds* (2nd Ed. vol. IV, part B, 1977) Chapter 15, pp. 369–422, (2nd, Ed. vol. IV, part B, 1985) Chapter 15, pp. 267–296, Elsvier Science Publishing Company Inc., New York.

The compounds represented by formulae (I) and (II) are preferably used in a silver halide emulsion layer, and are more preferably used as a sensitizing dye of silver halides.

The amount added thereof is not particularly limited, but it is preferably added in an amount of from $1\times10^{-6}$ to $1\times10^{-2}$ mol, more preferably from $1\times10^{-5}$ to $1\times10^{-3}$ mol, per mol of silver halide.

The hydrazine derivatives for use in the present invention are preferably selected from the compounds represented by the following formula (III):

$$J_1-\underset{\underset{A_1}{|}}{N}-\underset{\underset{A_2}{|}}{N}-G_1-J_2 \qquad \text{(III)}$$

wherein $J_1$ represents an aliphatic group or an aromatic group, which each may be substituted by at least one substituent; $J_2$ represents a hydrogen atom, an alkyl group, an aryl group, an unsaturated heterocyclic group, an alkoxy group, an aryloxy group, an amino group or a hydrazino group, which each may be substituted by at least one substituent; $G_1$ represents —CO—, —$SO_2$—, —SO—, —$PO(J_3)$—, —CO—CO—, a thiocarbonyl group or an iminomethylene group; $A_1$ and $A_2$ are both a hydrogen atom, or one of them is a hydrogen atom and the other is a substituted or unsubstituted alkylsulfonyl group, a substituted or unsubstituted arylsulfonyl group, or a substituted or unsubstituted acyl group; $J_3$ has the same meaning as $J_2$, but it may be different from $J_2$.

In formula (III), the aliphatic group represented by $J_1$ is preferably an aliphatic group having from 1 to 30 carbon atoms. In particular, a straight-chain, branched or cyclic alkyl group having from 1 to 20 carbon atoms is preferred as $J_1$. The branched alkyl group may form a saturated heterocyclic ring containing at least one hetero atom in the alkyl group. The alkyl group may have at least one substituent described below.

The aromatic group represented by $J_1$ in formula (III) is a monocyclic or dicyclic aryl group or an unsaturated heterocyclic group. The unsaturated heterocyclic group may form a heteroaryl group by fusing a monocyclic or dicyclic aryl groups. Examples of the ring formed by $J_1$ include a benzene ring, a naphthalene ring, a pyridine ring, a pyrimidine ring, an imidazole ring, a pyrazole ring, a quinoline ring, an isoquinoline ring, a benzimidazole ring, a thiazole ring and a benzothiazole ring. Among these, the group containing a benzene ring is preferred.

$J_1$ is more preferably an aryl group.

The aliphatic and aromatic groups represented by $J_1$ may be substituted by one or more substituents. Typical examples of the substituents include an alkyl group, an alkenyl group, an alkynyl group, an aryl group, a heterocyclic group (a group containing a heterocyclic ring), a pyridinium group, a hydroxyl group, an alkoxy group, an aryloxy group, an acyloxy group, an alkylsulfonyloxy group, an arylsulfonyloxy group, an amino group, a carbonamido group (e.g., a group containing —C(=O)—N<), a sulfonamido group (e.g., a group containing —$SO_2$—N<), a ureido group, a thioureido group, a semicarbazido group, a thiosemicarbazido group, a urethane group (e.g., a group containing >N—C(=O)O—), a group having a hydrazide structure, a group having a quaternary ammonium structure, an alkylthio group, an arylthio group, an alkylsulfonyl group, an arylsulfonyl group, an alkylsulfinyl group, an arylsulfinyl group, a carboxyl group (e.g., a group containing —$COO^-$), a sulfo group, an acyl group, an alkoxycarbonyl group, an aryloxycarbonyl group, a carbamoyl group, a sulfamoyl group, a halogen atom, a cyano group, a phosphonamido group (e.g., a group containing >P(=O)—N<), a diacylamino group, an imido group, a group having an acylurea structure, a group containing a selenium atom or a tellurium atom, and a group having a tertiary sulfonium structure or a quaternary sulfonium structure. Of these, preferred are a strain-chain, branched or cyclic alkyl group (preferably one having from 1 to 20 carbon atoms), an aralkyl group (preferably monocyclic or dicyclic one having an alkyl moiety of from 1 to 3 carbon atoms), an alkoxy group (preferably one having from 1 to 20 carbon atoms), a substituted amino group (preferably an amino group substituted by at least one alkyl group having from 1 to 20 carbon atoms), an acylamino group (preferably one having from 2 to 30 carbon atoms), a sulfonamido group (preferably one having from 1 to 30 carbon atoms), a ureido group (preferably one having from 1 to 30 carbon atoms) and a phosphonamido group (preferably one having from 1 to 30 carbon atoms). The above-described substituents may be further substituted by one or more of these substituents.

In formula (III), the alkyl group represented by $J_2$ is preferably an alkyl group having from 1 to 4 carbon atoms, and the aryl group represented by $J_2$ is preferably a monocyclic or dicyclic aryl group such as an aryl group containing a benzene ring.

The unsaturated heterocyclic group represented by $J_2$ is preferably a compound having a 5- or 6-membered ring containing at least one nitrogen, oxygen or sulfur atom. Examples thereof are an imidazolyl group, a pyrazolyl group, a triazolyl group, a tetrazolyl group, a pyridyl group, a pyridinium group, a quinolinium group and a quinolinyl group. Among these, more preferred are a pyridyl group and a pyridinium group.

The alkoxy group represented by $J_2$ is preferably an alkoxy group having from 1 to 8 carbon atoms.

The aryloxy group represented by $J_2$ is preferably a monocyclic aryloxy group.

The amino group represented by $J_2$ is preferably an unsubstituted amino group or an alkylamino or arylamino group having from 1 to 10 carbon atoms.

$J_2$ may be substituted by at least one substituent, and examples of such substituent include those recited above with respect to $J_1$.

When $G_1$represents —CO—, $J_2$ is preferably a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl) or an aryl group (e.g., phenyl, 3,5-dichlorophenyl, o-methanesulfonamidophenyl, 4-methanesulfonylphenyl, 2-hydroxymethylphenyl), and more preferably a hydrogen atom or a trifluoromethyl group.

When $G_1$represents —$SO_2$—, $J_1$ is preferably an alkyl group (e.g., methyl), an aralkyl group (e.g., o-hydroxybenzyl group), an aryl group (e.g., phenyl) or a substituted amino group (e.g., dimethylamino).

When $G_1$ represents —CO—CO—, $J_2$ is preferably an alkoxy group, an aryloxy group or an amino group.

In formula (III), $G_1$ is preferably —CO— or —CO—CO—, and more preferably —CO—.

Further, $J_2$ may be a group such that it can split the $G_1$–$J_2$ moiety off the residual molecule and thereby cause the cyclization reaction to form a cyclic structure containing the atoms of the G1–$J_2$ moiety. Specific examples of such a group include those disclosed in JP-A-63-29751.

$A_1$ and $A_2$ is preferably a hydrogen atom, an alkylsulfonyl or arylsulfonyl group having from 1 to 20 carbon atoms (more preferably, a phenylsulfonyl group or a phenylsulfonyl group substituted by at least one substituent having total Hammett's reaction constant of –0.5 or more) or an acyl group having from 1 to 20 carbon atoms (more preferably, a benzoly group, a benzoyl group substituted by at least one substituent having total Hammett's reaction constant of –0.5 or more, or a straight-chain, branched or cyclic acyl group, which may be substituted by at least one substituent such as a halogen atom, an ether group, a sulfonamido group, a carbonamido group, a hydroxyl group, a carboxyl group or a sulfonic acid group). Examples of the substituted alkylsulfonyl or arylsulfonyl group include a p-methylphenylsulfonyl group, a pentafluorophenylsulfonyl group, a p-ethoxycarbonylphenylsulfonyl group, a m-methoxyphenylsulfonyl group and a p-cyanophenylsulfonyl group. Examples of the substituted benzoyl group include a p-methylbenzoyl group, a pentafluorobenzoyl group, a p-ethoxycarbonylbenzoyl group, a m-methoxybenzoyl group and a p-cyanobenzoyl group.

More preferably, $A_1$ and $A_2$ are each a hydrogen atom.

The substituents of $J_1$ and $J_2$ may be further substituted by at least one substituent, and examples of such substituent include those recited above with respect to $J_1$. The substituted substituents may be further substituted by a substituent, a substituted substituent, a ((substituted substituent)-substituted substituent, and so on, and the examples of the substituents also include those recited above. with respect to $J_1$.

Moreover, $J_1$ or $J_2$ may be a group into which a ballast group used commonly in immobile photographic additives, such as couplers, or a polymeric moiety is introduced. The ballast group is a group containing 8 or more carbon atoms and having a relatively slight influence upon photographic properties, and examples thereof include an alkyl group, an alkoxy group, a phenyl group, an alkylphenyl group, a phenoxy group, and an alkylphenoxy group. Examples of the polymeric moiety include those described in JP-A-1-100530.

Further, $J_1$ or $J_2$ may be a group into which a group capable of intensifying the adsorption onto the grain surface of silver halide is introduced. Examples of the adsorption-intensifying group include thiourea groups, heterocyclic thioamido groups, mercapto heterocyclic groups and triazole groups, such as described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

The particularly preferred hydrazine compound in the present invention is a hydrazine compound represented by formula (III), wherein $J_1$ a group Capable of accelerating the adsorption onto the ballast group or the surface of silver halide grains, a group having a quaternary ammonium structure or an alkylthio group; $G_1$ is —CO—, and $J_2$ is a hydrogen atom or a substituted alkyl or substituted aryl group (as such substituent, an electron attracting group and a hydroxymethyl group to the 2-position thereof are preferred). All the combinations of the above-described $J_1$ and $J_2$ can be selected and are preferred.

Specific examples of the compound represented by formula (III) are illustrated below. However, the invention should not be construed as being limited to these examples.

III-1
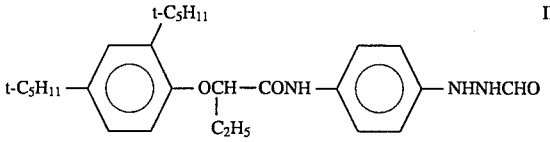
III-2
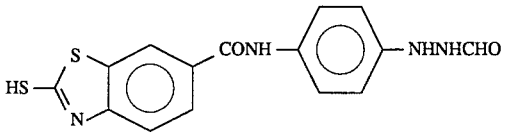
III-3
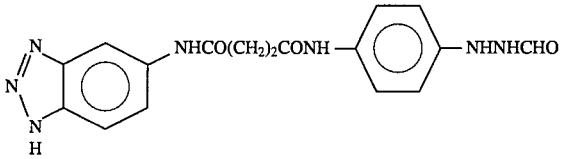
III-4
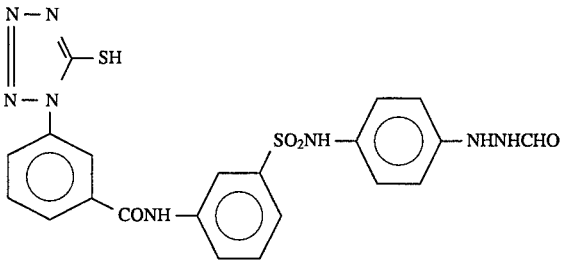
III-5
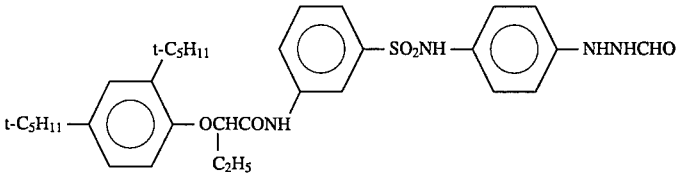
III-6
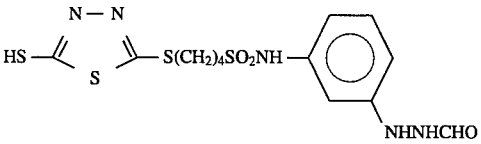
III-7
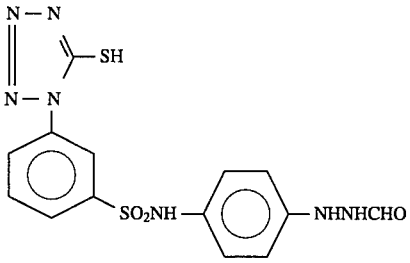
III-8
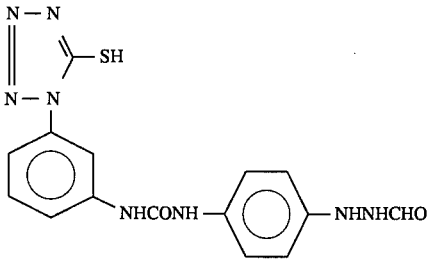
III-9
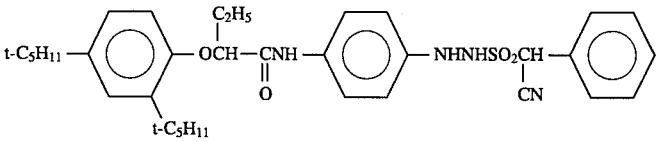
III-10
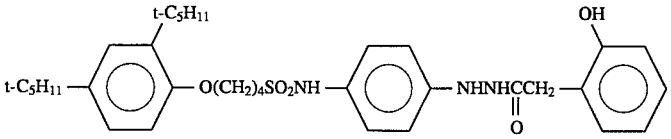

-continued
III-11
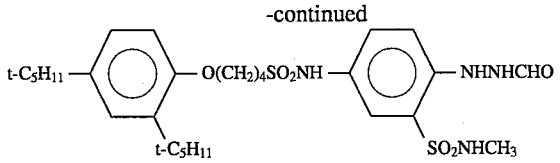
III-12
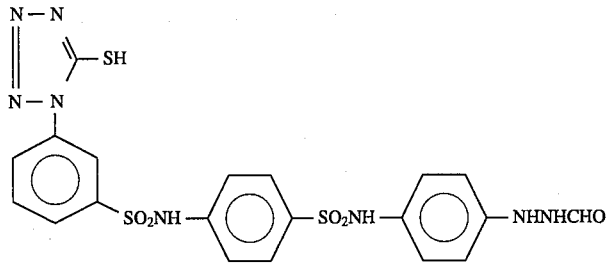
III-13
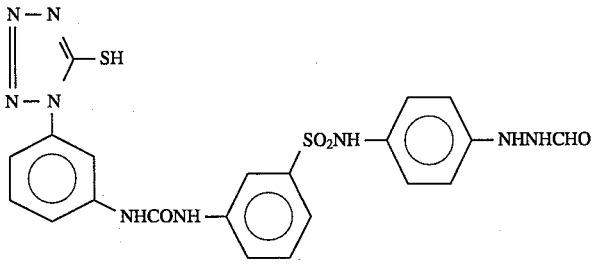
III-14
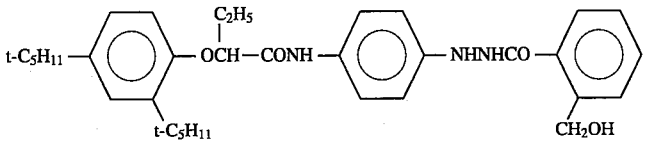
III-15
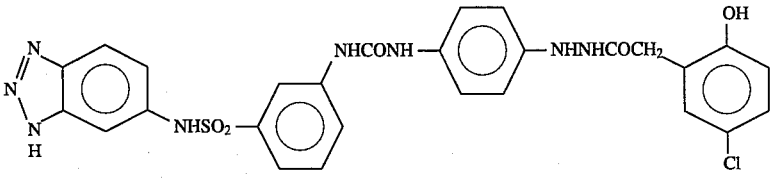
III-16
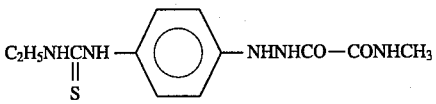
III-17
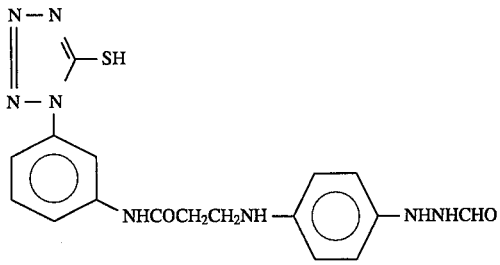
III-18
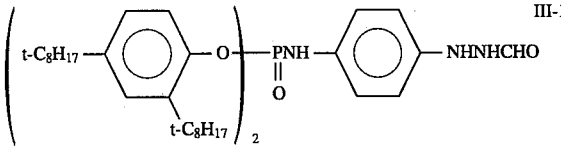
III-19
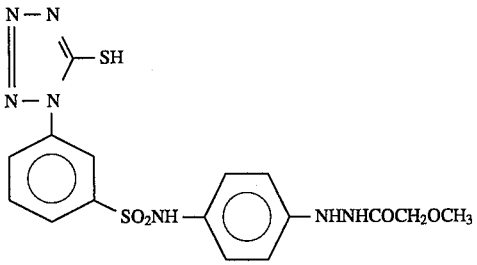

-continued
III-20
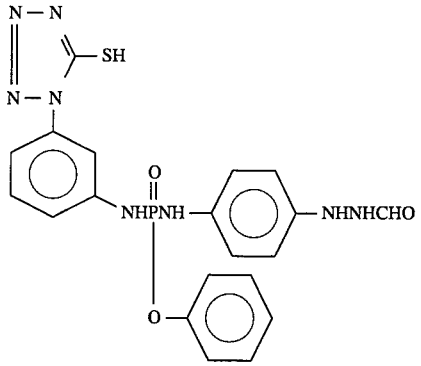
III-21
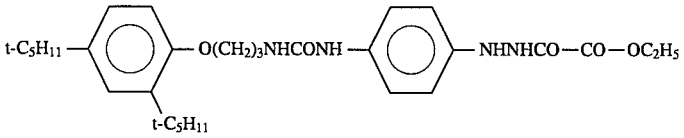
III-22
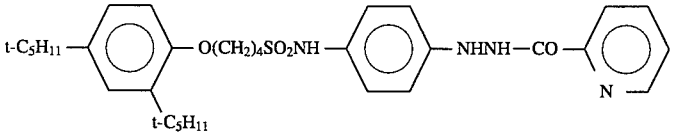
III-23
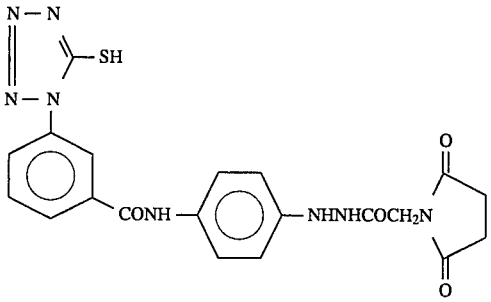
III-24
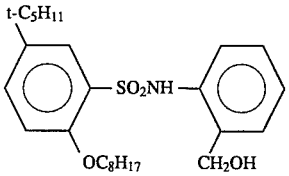
III-25
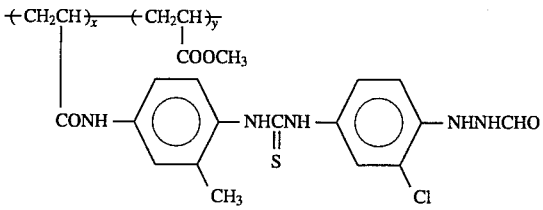
x:y = 3:97
Average Molecular weight = about 100,000
III-26
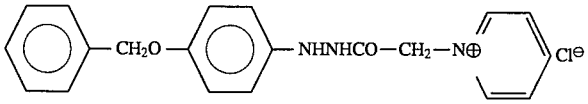
III-27
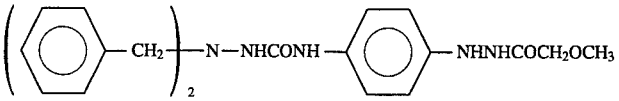
III-28
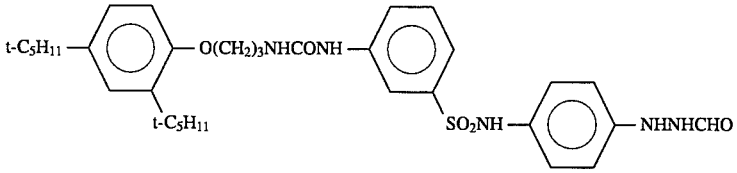

-continued
III-29
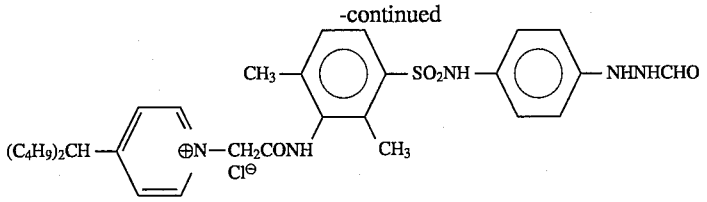
III-30
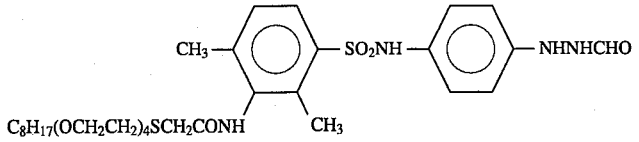
III-31
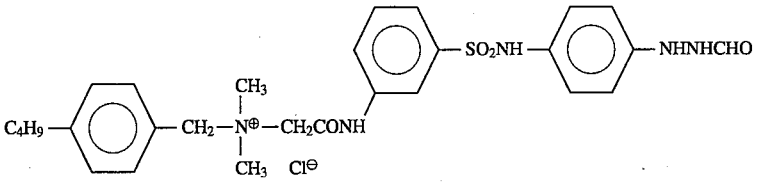
III-32
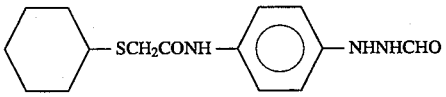
III-33
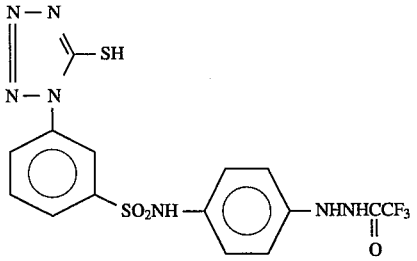
III-34
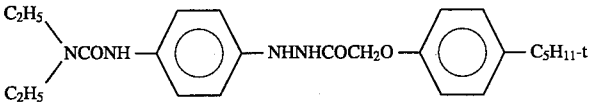
III-35
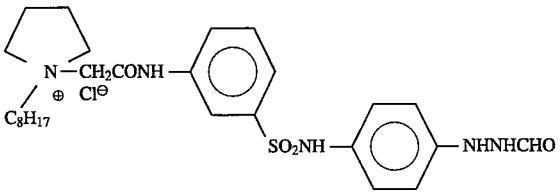
III-36
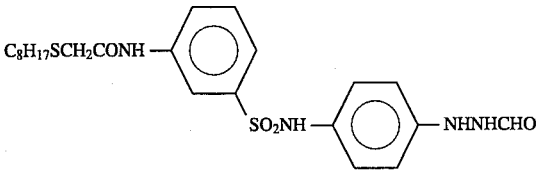
III-37
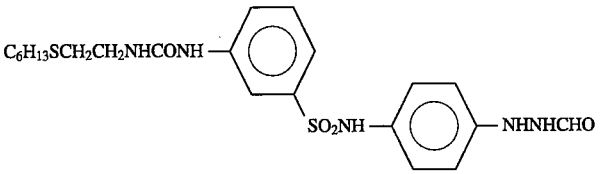
III-38
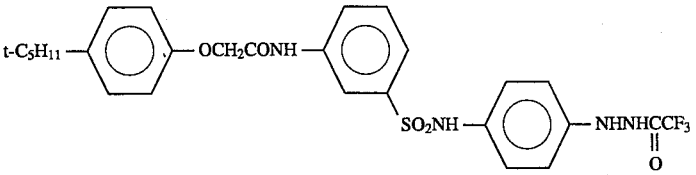

-continued
III-39
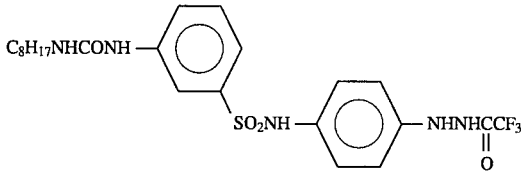
III-40
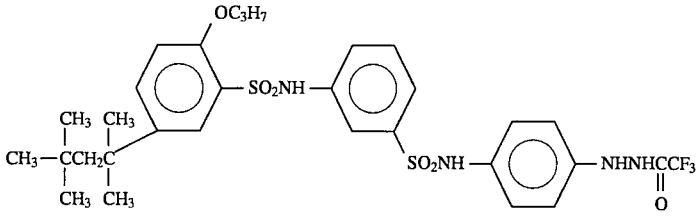
III-41
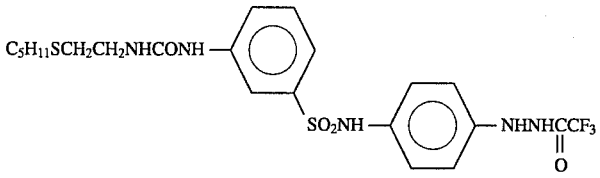
III-42
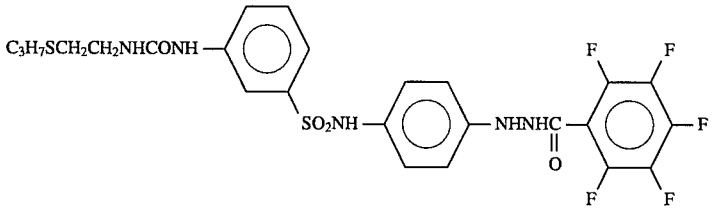
III-43
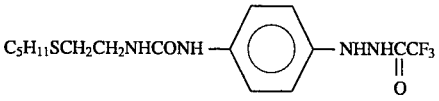
III-44
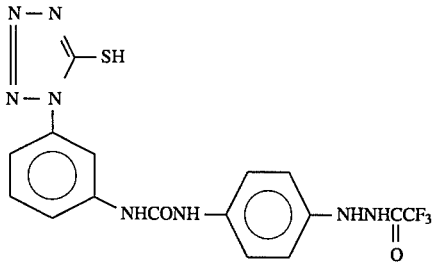
III-45
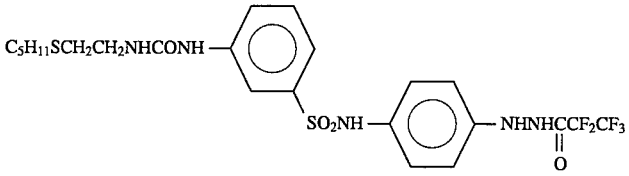
III-46
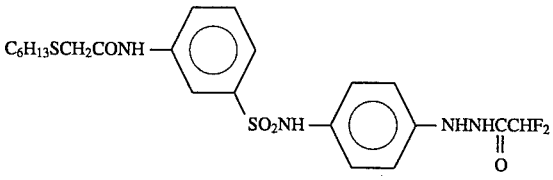
III-47
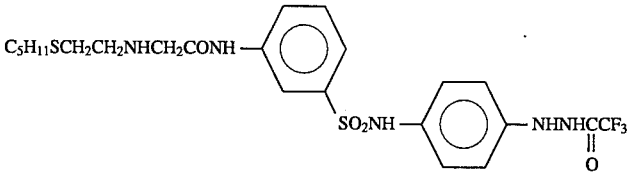

-continued

III-48

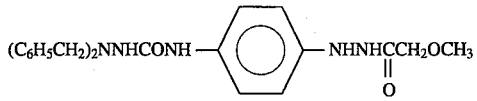

III-49

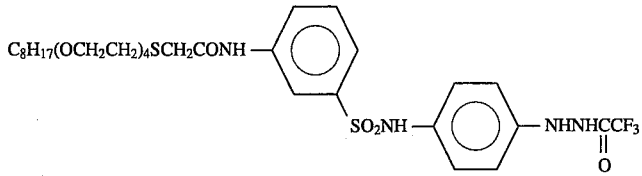

III-50

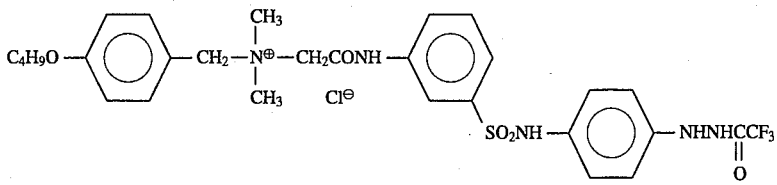

III-51

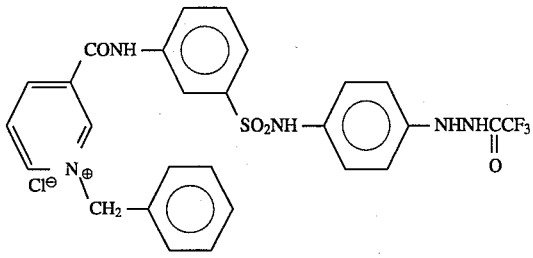

III-52

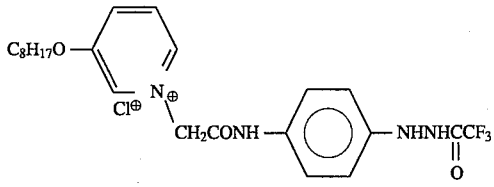

In addition to the above-illustrated ones, hydrazine derivatives which can be used in the present invention include those disclosed in *Research Disclosure,* Item 23516, page 346 (Nov., 1983), the references cited in ibid., U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355 and 5,104,769, British Patent No. 2,011,391B, European Patent Nos. 217,310, 301,799 and 356,898, JP-A-60-179734, JP-A-61-170733, JP-A-61-270744, JP-A-62-178246, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-64-10233, JP-A-1-90439, JP-A-1-100530, JP-A-1-105941, JP-A-1-105943, JP-A-1-276128, JP-A-1-280747, JP-A-1-283548, JP-A-1-283549, JP-A-1-285940, JP-A-2-2541, JP-A-2-77057, JP-A-2-139538, JP-A-2-196234, JP-A-2-196235, JP-A-2-198440, JP-A-2-198441, JP-A-2-198442, JP-A-2-220042, JP-A-2-221953, JP-A-2-221954, JP-A-2-285342, JP-A-2-285343, JP-A-2-289843, JP-A-2-302750, JP-A-2-304550, JP-A-3-37642, JP-A-3-54549, JP-A-3-125134, JP-A-3-184039, JP-A-3-240036, JP-A-3-240037, JP-A-3-259240, JP-A-3-280038, JP-A-3-282536, JP-A-4-51143, JP-A-4-56842, JP-A-4-84134, JP-A-2-230233, JP-A-4-96053, JP-A-4-216544, JP-A-5-45761, JP-A-5-45762, JP-A-5-45763, JP-A-5-45764 and JP-A-5-45765, JP-A-5-289524 and EP-A-618486.

The hydrazine derivative of the present invention is preferably added in an amount of from $1\times10^{-6}$ to $5\times10^{-2}$ mol, more preferably from $1\times10^{-5}$ to $2\times10^{-2}$ mol, per mol of silver halide.

In using the hydrazine derivative in the present invention, it may be dissolved in a proper water-miscible organic solvent, such as alcohols (e.g., methanol, ethanol, propanol, fluorinated alcohols), ketones (e.g., acetone, methyl ethyl ketone), dimethylformamide, dimethylsulfoxide and methyl cellosolve.

Further, the hydrazine derivative can be used in the form of emulsified dispersion, which is prepared using the well-known emulsion dispersion method in which the hydrazine derivative is dissolved using an oil such as dibutyl phthalate, tricresyl phosphate, glyceryl triacetate and diethyl phthalate, together with an auxiliary solvent, such as ethyl acetate and cyclohexanone, and then dispersed mechanically in an emulsified condition. On the other hand, the so-called solid dispersion method can be adopted in using the hydrazine derivative, wherein the powdered hydrazine derivative is dispersed into water by means of a ball mill, a colloid mill or ultrasonic waves.

It is preferred for the silver halide photographic material of the present invention to include a nucleation accelerator such as an amine derivative, an onium salt, a disulfide derivative, and a hydroxylamine derivative in the silver halide emulsion layer or other hydrophilic colloid layer. A phosphonium salt is more preferred.

The compounds represented by the following formulae (IV) to (VIII) are preferably used as amine derivatives for use in the present invention:

$$Y^1+(X^1)_{n1}-A^1-B^1]_{m1} \qquad \text{(IV)}$$

wherein $Y^1$ represents a group which is adsorbed onto silver halide; $X^1$ represents a divalent linking group comprising an atom or an atomic group selected from the group consisting of a hydrogen atom, a carbon atom, a nitrogen atom, an oxygen atom and a sulfur atom; $A^1$ represents a divalent linking group; $B^1$ represents an amino group, an ammonium group, or a nitrogen-containing heterocyclic ring, and the amino group may be substituted; $m^1$ represents 1, 2 or 3; and $n^1$ represents 0 or 1.

Example of the group represented by $Y^1$in formula (IV) which is adsorbed onto silver halide include a nitrogen-containing heterocyclic compound.

When $Y^1$ in formula (IV) represents a nitrogen-containing heterocyclic compound, the compound represented by formula (IV) is a compound represented by the following formula (IV-a):

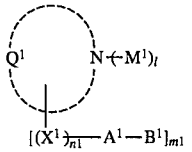

(IV-a)

wherein l represents 0 or 1; $m^1$ represents 1, 2 or 3; $n^1$ represents 0 or 1; $[(X^1)_{n1}—A^1—B^1]_{m1}$ as the same meaning as that described in formula (IV); $Q_1$ represents an atomic group necessary for forming a 5- or 6-membered heterocyclic ring comprising at least one atom selected from the group consisting of a carbon atom, a nitrogen atom, an oxygen atom and a sulfur atom, and this heterocyclic ring may be condensed with a carbon aromatic ring or a heterocyclic aromatic ring; and $M^1$ represents a hydrogen atom, an alkali metal atom, an ammonium group, or a group capable of becoming $M^1$=H or an alkali metal atom under the alkaline conditions.

Examples of the heterocyclic rings formed by $Q_1$ in formula (IV-a) include indazoles, benzimidazoles, benzotriazoles, benzoxazoles, benzothiazoles, imidazoles, thiazoles, oxazoles, triazoles, tetrazoles, azaindenes, pyrazoles, indoles, triazines, pyrimidines, pyridines, and quinolines, which each may be substituted.

Further, these heterocyclic rings may be substituted by a nitro group, a halogen atom, a mercapto group, a cyano group, an alkyl group, an aryl group, an alkenyl group, an aralkyl group, an alkoxy group, an aryloxy group, an alkylthio group, an arylthio group, a sulfonyl group, a carbamoyl group, a sulfamoyl group, a carbonamide group, a sulfonamide group, an acyloxy group, a sulfonyloxy group, a ureido group, a thioureido group, an acyl group, a heterocyclic group, an oxycarbonyl group, an oxycarbonylamino group, an amino group, a carboxylic acid group or a salt thereof, a sulfonic acid group or a salt thereof, or a hydroxyl group, which each may be substituted.

Examples of the divalent linking groups represented by $X^1$ in formula (IV) include —S—, —O—, —N($R^1$)—, —$CO_2$—, —OCO—, —CON($R^2$)—, —N($R^3$)$CO_2$—, —$SO_2$N($R^4$)—, —N($R^5$)$SO_2$—, —N($R^6$)CON($R^7$)—, —N($R^8$)CSN($R^9$)—, —N($R^{10}$)$CO_2$—, —$SO_2$—, —CO—, —$SO_2$—, and —$OSO_2$—. These linking groups may be bonded with Q via a straight chain or branched alkylene group $R^1$, $R^2$, $R^3$, $R^4$, $R^5$, $R^6$, $R^7$, $R^8$, $R^9$ and $R^{10}$ each represents a hydrogen atom, a substituted or unsubstituted alkyl group, a substituted or unsubstituted aryl group, a substituted or unsubstituted alkenyl group or a substituted or unsubstituted aralkyl group.

$A^1$ in formula (IV) represents a divalent linking group, such as a straight chain or branched alkylene group, a straight chain or branched alkenylene group, a straight chain or branched aralkylene group or arylene group. These groups represented by $A^1$ may further be substituted in an arbitrary combination with $X^1$.

The substituted or unsubstituted amino group represented by $B^1$ in formula (IV) is represented by the following formula (IV-b):

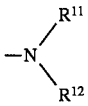

(IV-b)

wherein $R^{11}$ and $R^{12}$ may be the same or different and each represents a hydrogen atom, an alkyl group, an alkenyl group or an aralkyl group which each may be substituted and has from 1 to 30 carbon atoms, and these groups may be straight chain, branched, or cyclic.

Further, $R^{11}$ and $R^{12}$ in formula (IV-b) may be linked to form a ring, or may be cyclized to form a saturated heterocyclic ring containing one or more hetero atoms therein, examples thereof include a pyrrolidyl group, a piperidyl group and a morpholino group. Examples of substituents for $R^{11}$ and $R^{12}$ in formula (IV-b) include a carboxyl group, a sulfo group, a cyano group, a halogen atom, a hydroxyl group, an alkoxycarbonyl group having from 2 to 20 carbon atoms, an alkoxy group having from 1 to 20 carbon atoms, a monocyclic aryloxy group having from 6 to 20 carbon atoms, an acyloxy group having from 1 to 20 carbon atoms, an acyl group having from 1 to 20 carbon atoms, a carbamoyl group, a sulfamoyl group, an acylamino group having from 1 to 20 carbon atoms, a sulfonamide group, a carbonamide group having from 1 to 20 carbon atoms, a ureido group having from 1 to 20 carbon atoms, and an amino group.

The ammonium group represented by B in formula (IV) is represented by formula (IV-c):

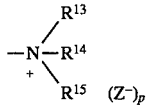

(IV-c)

wherein $R^{13}$, $R^{14}$ and $R^{15}$ each has the same meaning as $R^{11}$ and $R^{12}$ in formula (IV-b); $Z^-$ represents an anion; and p represents a number for neutralizing the charge.

The nitrogen-containing heterocyclic ring represented by $B^x$ in formula (IV) is a 5- or 6-membered ring which contains at least one or more nitrogen atoms, and the ring may be substituted, or may be condensed with other ring. Examples of the nitrogen-containing heterocyclic ring include an imidazolyl group, a pyridyl group, and a thiazolyl group.

Of the compounds represented by formula (IV), preferred compounds are represented by the following formula (IV-m), (IV-n), (IV-o) or (IV-p).

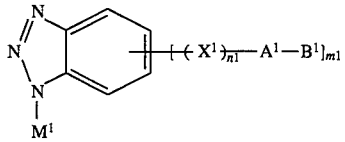

(IV-m)

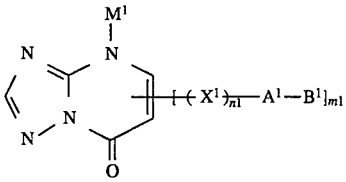

(IV-n)

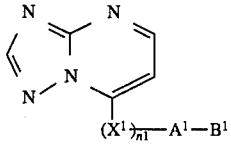

(IV-o)

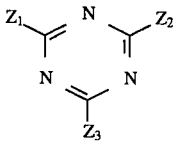

(IV-p)

wherein $—(X^1)_{n1}—A^1—B^1$, $M^1$ and $m^1$ have the same meanings as those defined in the above formula (IV-a), respectively; $Z_1$, $Z_2$ and $Z_3$ each has the same meaning as —$(X^1)_{n1}$—$A^1$—$B^1$ described in the above formula (IV-a), or represents a halogen atom, an alkoxy group having from 1 to 20 carbon atoms (e.g., methoxy), a hydroxyl group, a hydroxyamino group, or a substituted or unsubstituted amino group, and the substituents therefor can be selected from the substituents for $R^{11}$ and $R^{12}$ described in formula (IV-b), provided that at least one of $Z_1$, $Z_2$ and $Z_3$ has the same meaning as —$(X^1)_{n1}$—$A^1$—$B^1$ in formula (IV-a).

Further, these heterocyclic rings may be substituted by the substituents which are applicable to the heterocyclic rings in formula (IV).

Specific examples of the compounds represented by formula (IV) are shown below but the present invention is not limited thereto.

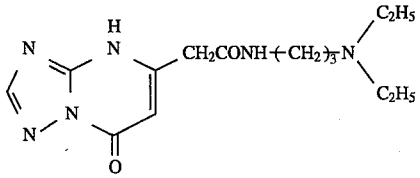
IV-1

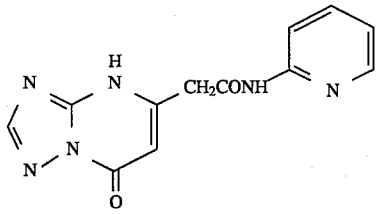
IV-2

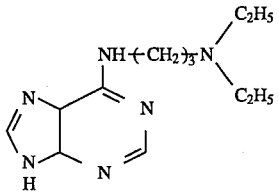
IV-3

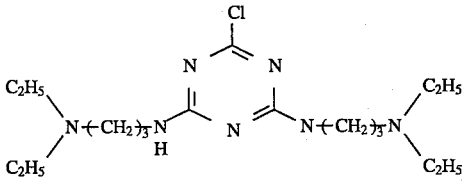
IV-4

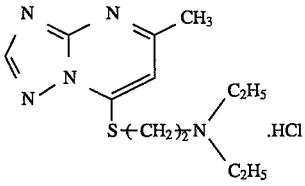
IV-5

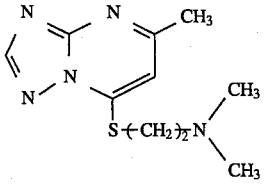
IV-6

-continued

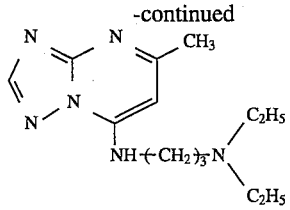
IV-7

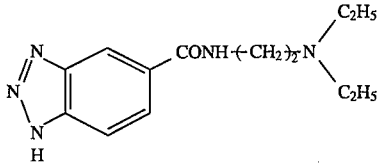
IV-8

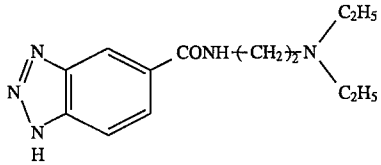
IV-9

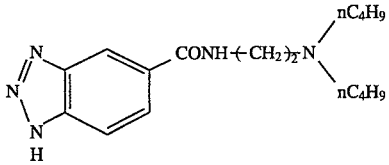
IV-10

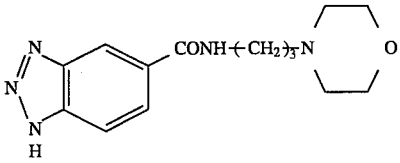
IV-11

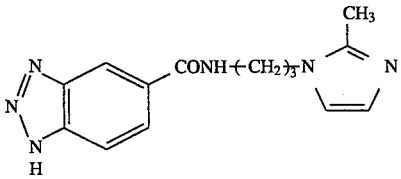
IV-12

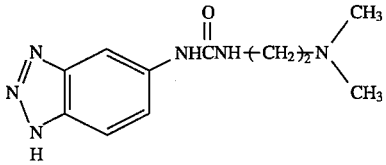
IV-13

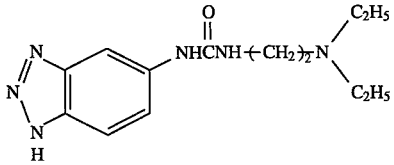
IV-14

-continued

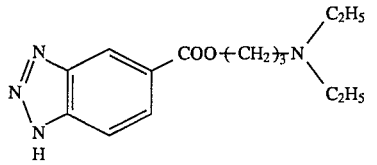

IV-15

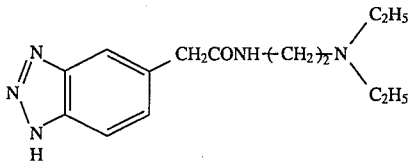

IV-16

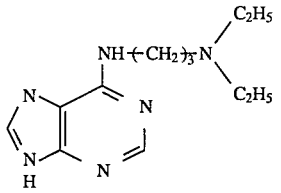

IV-17

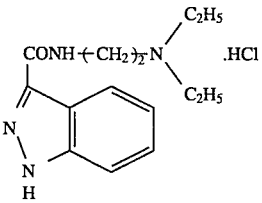

IV-18

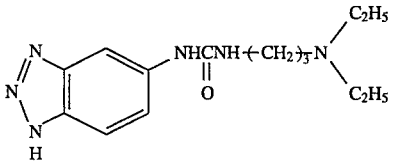

IV-19

Formula (V) is described below.

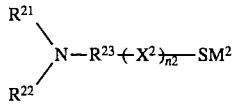

(V)

wherein $R^{21}$ and $R^{22}$ each represents a hydrogen atom or an aliphatic group, and $R^{21}$ and $R^{22}$ may be bonded with each other to form a ring; $R^{23}$ represents a divalent aliphatic group; $X^2$ represents a divalent heterocyclic ring containing a nitrogen atom, an oxygen atom or a sulfur atom; $n^2$ represents 0 or 1; $M^2$ represents a hydrogen atom, an alkali metal, an alkaline earth metal, a quaternary ammonium salt, a quaternary phosphonium salt, or an amidino group.

The aliphatic residue represented by $R^{21}$ or $R^{22}$ in formula (V) is preferably an alkyl group having from 1 to 12 carbon atoms, an alkenyl group or an alkynyl group, and each of which may be substituted by appropriate substituents.

When $R^{21}$ and $R^{22}$ in formula (V) form a ring, the ring is a 5- or 6-membered carbon ring or heterocyclic ring comprising a carbon atom or a combination of a carbon atom with a nitrogen atom or an oxygen atom, and is preferably a saturated ring.

$R^{21}$ and $R^{22}$ in formula (V) are each preferably an alkyl group having from 1 to 3 carbon atoms, and still more preferably are an ethyl group.

The divalent aliphatic group represented by $R^{23}$ in formula (V) is preferably —$R^{24}$— or —$R_{24}S$—, wherein $R^{24}$ represents a divalent aliphatic group, and preferably a saturated or unsaturated divalent aliphatic group having from 1 to 6 carbon atoms.

The heterocyclic ring represented by $X^2$ in formula (V) is a 5- or 6-membered heterocyclic ring which contains a nitrogen atom, an oxygen atom or a sulfur atom, and may be condensed with a benzene ring. Preferred examples of the heterocyclic ring include an aromatic ring such as tetrazole, triazole, thiadiazole, oxadiazole, imidazole, thiazole, oxazole, benzimidazole, benzothiazole, and benzoxazole; and tetrazole and thiadiazole are particularly preferred.

Specific examples of the compounds represented by formula (V) are shown below.

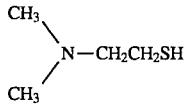

V-1

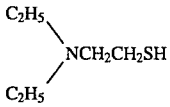

V-2

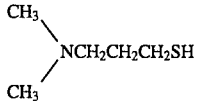

V-3

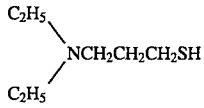

V-4

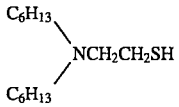

V-5

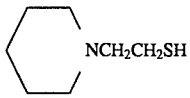

V-6

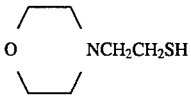

V-7

$(HOCH_2CH_2)_2NCH_2CH_2SH$

V-8

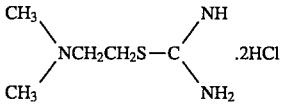

V-9

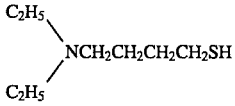

V-10

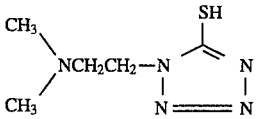

V-11

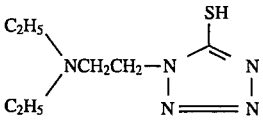

V-12

-continued

V-13

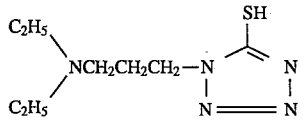

V-14

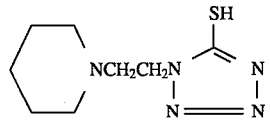

V-15

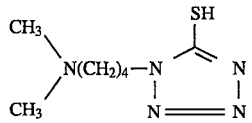

V-16

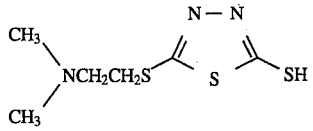

V-17

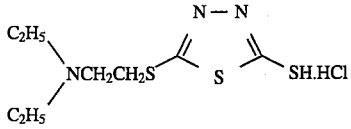

V-18

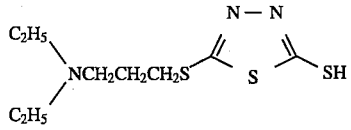

V-19

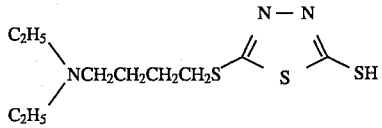

V-20

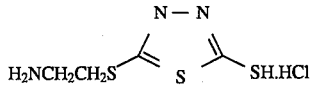

V-21

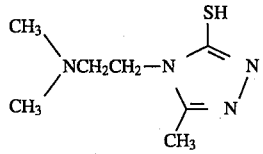

V-22

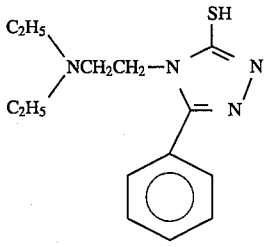

The optimal addition amount of these nucleation accelerators represented by formulae (IV) and (V) is varied according to the kind of the compound, but is generally from $1.0\times10^{-3}$ to 0.5 g/m$^2$, preferably from $5.0\times10^{-3}$ to 0.3 g/m$^2$ These accelerators are dissolved in an appropriate solvent (e.g., $H_2O$, alcohols such as methanol and ethanol, acetone, dimethylformamide, methyl cellosolve), and added to a coating solution.

The compounds represented by formulae (VI) to (VIII) are described below.

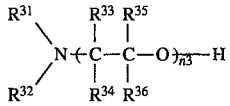

(VI)

wherein $R^{31}$ and $R^{32}$ each represents a hydrogen atom, an alkyl group having from 1 to 30 carbon atoms, an alkenyl group having from 3 to 30 carbon atoms or an aralkyl group having from 7 to 30 carbon atoms, provided that, when $R^{31}$ and $R^{32}$ are each an alkyl group, the number of total carbon atoms of $R^{31}$ and $R^{32}$ is 10 or more, $R^{31}$ and $R^{32}$ do not represent a hydrogen atom at the same time, and they may be bonded with each other to form a ring; $n^3$ represents an integer of from 2 to 50; and $R^{33}$, $R^{34}$, $R^{35}$ and $R^{36}$ each represents a hydrogen atom or an alkyl group having from 1 to 4 carbon atoms.

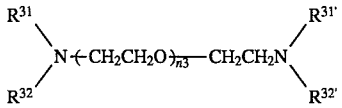

(VII)

wherein $R^{31}$ and $R^{32}$ and $n^3$ each has the same meaning as those described in formula (VI), respectively, and $R^{31'}$ and $R^{32'}$ have the same meaning as $R^{31}$ and $R^{32}$ in formula (IV).

$$Y^4\text{-}[(X^4)_{n4}\text{-}A^4\text{-}B^4]_{m4} \quad \text{(VIII)}$$

wherein $Y^4$ represents a group which is adsorbed onto silver halide; $X^4$ represents a divalent linking group comprising an atom or an atomic group selected from the group consisting of a hydrogen atom, a carbon atom, a nitrogen atom, an oxygen atom and a sulfur atom; $A^4$ represents a divalent linking group having at least two alkylene oxy units; $B^4$ represents an amino group, an ammonium group or a nitrogen-containing heterocyclic group; $m^4$ represents 1, 2 or 3; and $n^4$ represents 0 or 1.

Examples of the group represented by $Y_4$ in formula (VIII) which is adsorbed onto silver halide include a nitrogen-containing heterocyclic compound, a heterocyclic mercapto compound and an aliphatic mercapto compound.

The compounds represented by the above formulae (VI) and (VII) are described in more detail below.

$R^{31}$ and $R^{32}$ in formulae (VI) and (VII) may be the same or different and each represents a hydrogen atom, an alkyl group having from 1 to 30 carbon atoms which may be substituted (e.g., methyl, ethyl, n-butyl, n-hexyl, n-octyl, 2-ethylhexyl, methoxyethyl, ethylthioethyl, dimethylaminoethyl, n-decyl, n-dodecyl, phenoxyethyl, 2,4-di-t-amylphenoxyethyl, n-octadecyl), an alkenyl group having from 3 to 30 carbon atoms which may be substituted (e.g., allyl, butenyl, pentenyl), or an aralkyl group having from 7 to 30 carbon atoms which may be substituted (e.g., phenethyl, benzyl, 4-methoxybenzyl, 4-t-butylbenzyl, 2,4-di-t-amylphenethyl).

Further, $R^{31}$ and $R^{32}$ may be bonded with each other as an alkylene group which may be substituted to form a ring with a nitrogen atom (e.g., pyrrolidine ring, piperidine ring, 2-methylpiperidine ring, hexamethyleneimine ring).

$R^{33}$, $R^{34}$, $R^{35}$ and $R^{36}$ in formulae (VI) and (VII) may be the same or different and each represents a hydrogen atom, a lower alkyl group having from 1 to 4 carbon atoms (preferably unsubstituted lower alkyl group, e.g., methyl, ethyl, n-butyl group).

When $R^{31}$ and $R^{32}$ in formulae (VI) and (VII) are substituted, examples of the substituents include a halogen atom (e.g., chlorine, bromine), a cyano group, a nitro group, a hydroxyl group, an alkoxy group (e.g., methoxy), an aryloxy group (e.g., phenoxy, 2,4-di-t-amylphenoxy), an alkylthio group (e.g., methylthio), an arylthio group (e.g., phenylthio), an acyloxy group (e.g., acetyloxy, benzoyloxy), an amino group (e.g., unsubstituted amino, dimethylamino), a carbonamide group (e.g., acetamide), a sulfonamide group (e.g., methanesulfonamide, benzenesulfonamide), an oxycarbonylamino group (e.g., methoxycarbonylamino), a ureido group (e.g., unsubstituted ureido, 3,3-dimethylureido), a thioureido group (e.g., unsubstituted thioureido, 3-phenylthioureido), an acyl group (e.g., acetyl, benzoyl), an oxycarbonyl group (e.g., methoxycarbonyl), a carbamoyl group (e.g., methylcarbamoyl, 4-methylphenylcarbamoyl), a sulfonyl group (e.g., methanesulfonyl), a sulfamoyl group (e.g., methylsulfamoyl, 4-methoxyphenylsulfamoyl), a carboxylic acid group or a salt thereof, and a sulfonic acid group or a salt thereof.

In formulae (VI) and (VII), preferably, $R^{31}$ and $R^{32}$ each represents an alkyl group having from 1 to 30 carbon atoms or an aralkyl group having from 7 to 30 carbon atoms; $R^{33}$, $R^{34}$, $R^{35}$ and $R^{36}$ each represents a hydrogen atom, and $n^3$ represents an integer of from 3 to 20.

In formulae (VI) and (VII), more preferably $R^{31}$ and $R^{32}$each represents an alkyl group having from 5 to 20 carbon atoms.

Specific examples of the compounds represented by formulae (VI) and (VII) are shown below; however, the present invention is not limited thereto.

VI-1

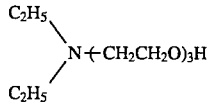

VI-2

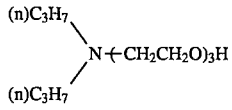

VI-3

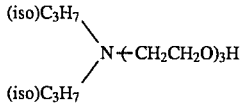

VI-4

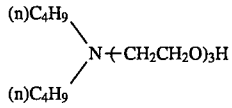

VI-5

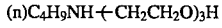

VI-6

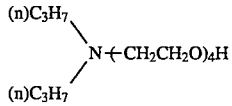

VI-7

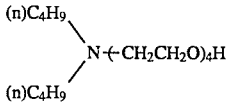

VI-8

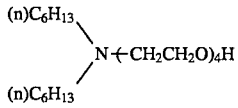

VI-9

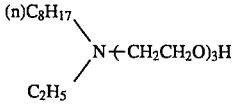

VI-10

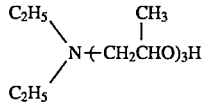

VI-11

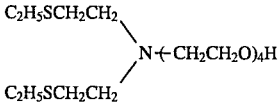

VI-12

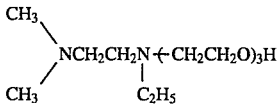

VI-13

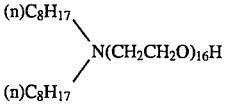

VI-14

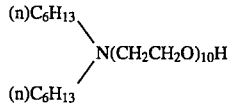

VI-15

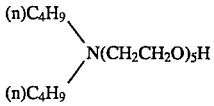

VI-16

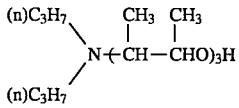

VI-17

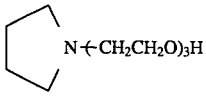

VI-18

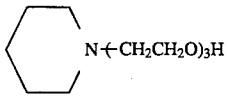

VI-19

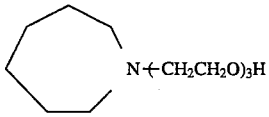

VI-20

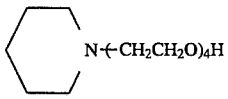

-continued

VI-21

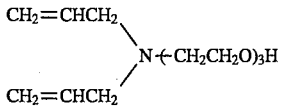

VI-22

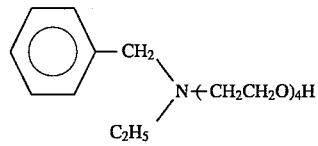

VI-23

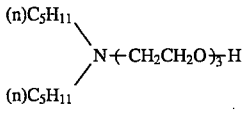

VI-24

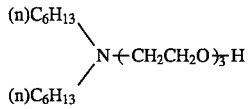

VI-25

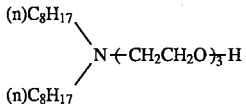

VI-26

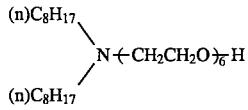

VI-27

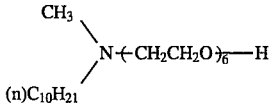

VI-28

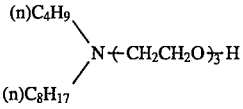

VI-29

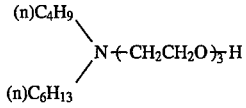

VI-30

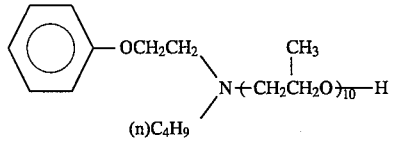

VI-31

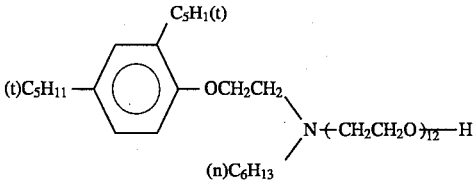

VI-32

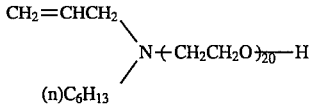

VI-33

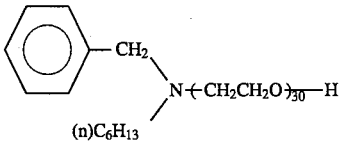

VI-34

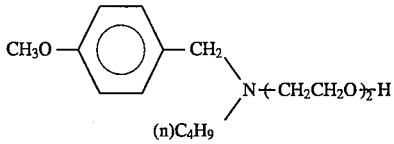

VI-35

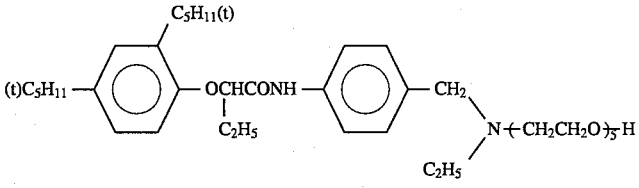

VI-36

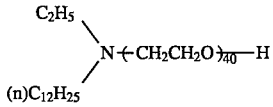

VII-1

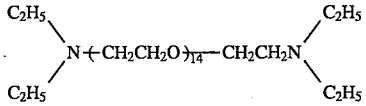

VII-2

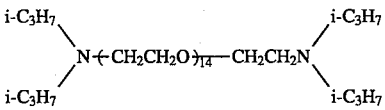

VII-3

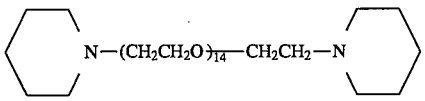

VII-4

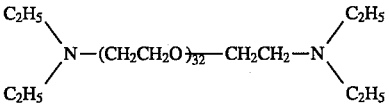

VII-5

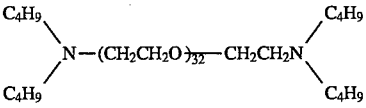

The compound represented by formula (VIII) is described below.

Examples of the group represented by $Y^4$ in formula (VIII) which is adsorbed onto silver halide include a nitrogen-containing heterocyclic compound, a heterocyclic mercapto compound and an aliphatic mercapto compound.

When $Y^4$ in formula (VIII) represents a nitrogen-containing compound or a heterocyclic mercapto compound, they are represented by formula (VIII-a) or (VIII-b):

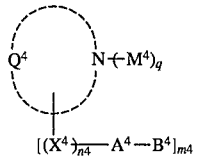

(VIII-a)

$$M^4S-Z^4+(X^4)_{n4}-A^4-B^4]_{m4} \quad \text{(VIII-b)}$$

In formula (VIII-a), q represents 0 or 1; $-[(X^4)_{n4}-A^4-B^4]_{m4}$ has the same meaning as that in formula (VIII); $Q_4$ represents an atomic group necessary for forming a 5- or 6-membered heterocyclic ring comprising at least one atom selected from the group consisting of a carbon atom, a nitrogen atom, an oxygen atom and a sulfur atom, and this heterocyclic ring may be condensed with a carbon aromatic ring or a heterocyclic aromatic ring; and $M^4$ represents a hydrogen atom, an alkali metal atom, an ammonium group or a group capable of becoming $M_4$=H or an alkali metal atom under the alkaline conditions.

Examples of the heterocyclic rings formed by $Q_4$ in formula (VIII-a) include indazoles, benzimidazoles, benzotriazoles, benzoxazoles, benzothiazoles, imidazoles, thiazoles, oxazoles, triazoles, tetrazoles, azaindenes, pyrazoles, indoles, triazines, pyrimidines, pyridines, and quinolines, which each may be substituted.

$M^4$ in formula (VIII-a) represents a hydrogen atom, an alkali metal atom (e.g., sodium, potassium), an ammonium group (e.g., trimethylammonium, dimethylbenzylammonium), or a group capable of becoming $M_4$=H or an alkali metal atom under the alkaline conditions (e.g., acetyl, cyanoethyl, methanesulfonylethyl).

Further, these heterocyclic rings represented by $Q_4$ in formula (VIII-a) may be substituted by a nitro group, a halogen atom (e.g., chlorine, bromine.), a mercapto group, a cyano group, an alkyl group (e.g., methyl, ethyl, propyl, t-butyl, cyanoethyl, methoxyethyl, methylthioethyl), an aryl group (e.g., phenyl, 4-methanesulfonamidophenyl, 4-methylphenyl, 3,4-dichlorophenyl, naphthyl), an alkenyl group (e.g., allyl), an aralkyl group (e.g., benzyl, 4-methylbenzyl, phenethyl), an alkoxy group (e.g., methoxy, ethoxy), an aryloxy group (e.g., phenoxy, 4-methoxyphenoxy), an alkylthio group (e.g., methylthio, ethylthio, methoxyethylthio), an arylthio group (e.g., phenylthio), a sulfonyl group (e.g., methanesulfonyl, ethanesulfonyl, p-toluenesulfonyl), a carbamoyl group (e.g., unsubstituted carbamoyl, methylcarbamoyl, phenylcarbamoyl), a sulfamoyl group (e.g., unsubstituted sulfamoyl, methylsulfamoyl, phenylsulfamoyl), a carbonamide group (e.g., acetamide, benzamide), a sulfonamide group (e.g., methanesulfonamide, benzenesulfonamide, p-toluenesulfonamide), an acyloxy group (e.g., acetyloxy, benzoyloxy), a sulfonyloxy group (e.g., methanesulfonyloxy), a ureido group (e.g., unsubstituted ureido, methylureido, ethylureido, phenylureido), a thioureido group (e.g., unsubstituted thioureido, methylthioureido), an acyl group (e.g., acetyl, benzoyl), a heterocyclic group (e.g., 1-morpholino, 1-piperidino, 2-pyridyl, 4-pyridyl, 2-thienyl, 1-pyrazolyl, 1-imidazolyl, 2-tetrahydrofuryl, tetrahydrothienyl), an oxycarbonyl group (e.g., methoxycarbonyl, phenoxycarbonyl), an oxycarbonylamino group (e.g., methoxycarbonylamino, phenoxycarbonylamino, 2-ethylhexyloxycarbonylamino), an amino group (e.g., unsubstituted amino, dimethylamino, methoxyethylamino, anilino), a carboxylic acid group or a salt thereof, a sulfonic acid group or a salt thereof, or a hydroxyl group. These substituents may be further substituted by one or more of these substituents.

Examples of the divalent linking groups represented by $X^4$ in formula (VIII-a) include, for example, —S—, —O—, $-N(R^{41})-$, $-CO_2-$, —OCO—, $-CON(R^{42})-$, $-N(R^{43})CO-$, $-SO_2N(R^{44})-$, $-N(R^{45})SO_2-$, $-N(R^{46})CON(R^{47})-$, $-N(R^{48})CSN(R^{49})-$, $-N(R^{50})CO_2-$, $-SO_3-$, and $-OSO_2-$. These linking groups may be bonded with Q via a straight chain or branched alkylene group (e.g., methylene, ethylene, propylene, butylene, hexylene, 1-methylethylene). $R^{41}$, $R^{42}$, $R^{43}$, $R^{44}$, $R^{45}$, $R^{46}$, $R^{47}$, $R^{48}$, $R^{49}$ and $R^0$ each represents a hydrogen atom, a substituted or unsubstituted alkyl group (e.g., methyl, ethyl, propyl, n-butyl), a substituted or unsubstituted aryl group (e.g., phenyl, 2-methylphenyl), a substituted or unsubstituted alkenyl group (e.g., propenyl, 1-methylvinyl) or a substituted or unsubstituted aralkyl group (e.g., benzyl, phenethyl).

$A^4$ in formula (VIII-a) represents a divalent linking group having at least two alkyleneoxy units, and preferably represents $-[C(R^{51})(R^{52})C(R^{53})(R^{54})O]_r-$. $R^{51}$, $R^{52}$, $R^{53}$ and $R^{54}$ each represents a hydrogen atom, an alkyl group having from 1 to 4 carbon atoms (e.g., methyl, ethyl, n-propyl, n-butyl); and r represents an integer of from 2 to 50.

The substituted or unsubstituted amino group represented by $B^4$ in formula (VIII-a) is represented by formula (VIII-c):

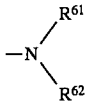

(VII-c)

wherein $R^{61}$ and $R^{62}$ may be the same or different and each represents a hydrogen atom, an alkyl group, an alkenyl group or an aralkyl group, which each may be substituted and has from 1 to 30 carbon atoms, and these groups may be straight chain (e.g., methyl, ethyl, n-propyl, n-butyl, n-octyl, allyl, 3-butenyl, benzyl, 1-naphthylmethyl), branched (e.g., isopropyl, t-octyl), or cyclic (e.g., cyclohexyl).

Further, $R^{61}$ and $R^{62}$ in formula (VIII-c) may be linked to form a ring, or may be cyclized to form a saturated heterocyclic ring containing one or more hetero atoms (e.g., oxygen, sulfur, nitrogen) therein, for example, a pyrrolidyl group, a piperidyl group and a morpholino group are included. Examples of substituents for $R^{61}$ and $R^{62}$ include a carboxyl group, a sulfo group, a cyano group, a halogen atom (e.g., fluorine, chlorine, bromine), a hydroxyl group, an alkoxycarbonyl group having from 2 to 20 carbon atoms (e.g., methoxycarbonyl, ethoxycarbonyl, phenoxycarbonyl, benzyloxycarbonyl), an alkoxy group having from 1 to 20 carbon atoms (e.g., methoxy, ethoxy, benzyloxy, phenethyloxy), a monocyclic aryloxy group having 6 to 20 carbon atoms (e.g., phenoxy, p-tolyloxy), an acyloxy group having from 1 to 20 carbon atoms (e.g., acetyloxy, propionyloxy), an acyl group having from 1 to 20 carbon atoms (e.g., acetyl, propionyl, benzoyl, mesyl), a carbamoyl group (e.g., -carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl), an acylamino group having from 1 to 20 carbon atoms (e.g., acetylamino, propionylamino, benzoylamino, mesylamino), a sulfonamide group (e.g., ethylsulfonamide, p-toluenesulfonamide), a carbonamide group having from 1 to 20 carbon atoms (e.g., methylcarbonamide, phenylcarbonamide), a ureido group having from 1 to 20 carbon atoms (e.g., methylureido, phenylureido), and an amino group (the same as those described in formula (VIII-c)).

The ammonium group represented by $B^4$ is represented by formula (VIII-d):

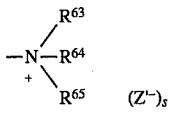

(VII-d)

wherein $R^{63}$, $R^{64}$, and $R^{65}$ each represents the same meaning as $R^{61}$ and $R^{62}$ in formula (VIII-c); $Z^{1-}$ represents an anion, for example, a halide ion (e.g., $Cl^-$, $Br^-$, $I^-$), a sulfonate ion (e.g., trifluoromethanesulfonate, paratoluenesulfonate, benzenesulfonate, parachlorobenzenesulfonate), a sulfate ion (e.g., ethylsulfate, methylsulfate), perchlorate, or tetrafluoroborate; and s represents 0 or 1, and when the compound forms an inner salt, s represents 0.

The nitrogen-containing heterocyclic ring represented by $B^4$ in formula (VIII-a) is a 5- or 6-membered ring which contains at least one or more nitrogen atoms, and such a ring may be substituted, or may be condensed with other ring. Examples of the nitrogen-containing heterocyclic rings include an imidazolyl group, a pyridyl group, and a thiazolyl group.

Of the compounds represented by formula (VIII-a), preferred compounds are represented by the following formula (VIII-e), (VIII-f) or (VIII-g).

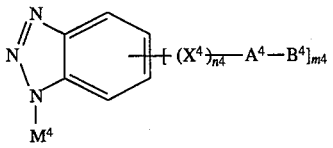

(VIII-e)

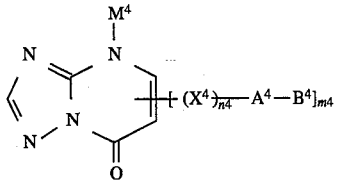

(VIII-f)

-continued

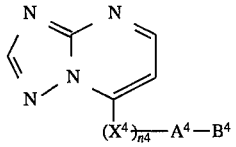

(VIII-g)

wherein $-(X^4)_{n4}-A^4-B^4$, $M^4$ and $m^4$ have the same meanings as those described in the above formula (VIII), respectively.

The compound represented by formula (VIII-b) is described in detail below.

$Z^4$ in formula (VIII-b) represents a heterocyclic ring comprising a carbon atom, a nitrogen atom, an oxygen atom, a sulfur atom, and a selenium atom.

The heterocyclic ring represented by $Z^4$ in formula (VIII-b) is preferably a 5- or 6-membered ring, and this heterocyclic ring may be condensed with a carbon aromatic ring or a heterocyclic aromatic ring.

Examples of the heterocyclic ring formed by $Z^4$ in formula (VIII-b) include a tetrazole ring, a triazole ring, a thiadiazole ring, an oxadiazole ring, a selenazole ring, an imidazole ring, a thiazole ring, an oxazole ring, a benzimidazole ring, a benzothiazole ring, a benzoxazole ring, a benzoselenazole ring, a tetraazaindene ring, a triazaindene ring, and a pentaazaindene ring. A tetrazole ring and a thiadiazole ring are particularly preferred of them. Further, these heterocyclic rings may be substituted by substituents for Q in formula (VIII-b) described in formula (VIII-a).

$M^4$ and $]-(X^4)_{n4}-A^4-B^4]_{m4}$ in formula (VIII-b) have the same meaning as those described in formula (VIII-a), respectively.

The compounds represented by formula (VIII) are shown below, but the present invention is not limited thereto.

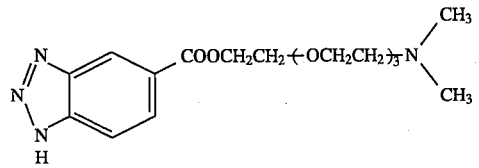

VIII-1

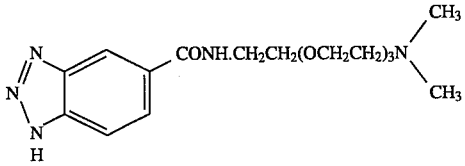

VIII-2

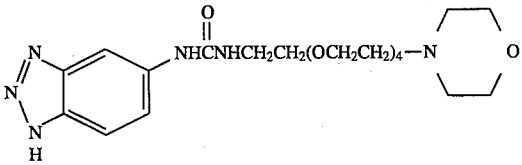

VIII-3

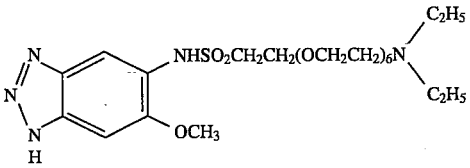

VIII-4

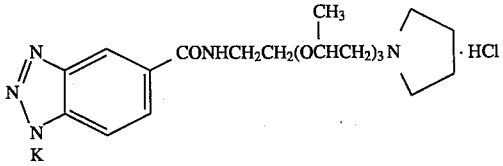

VIII-5

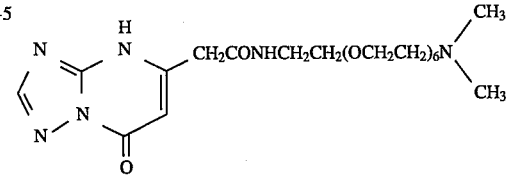

VIII-6

-continued
VIII-7
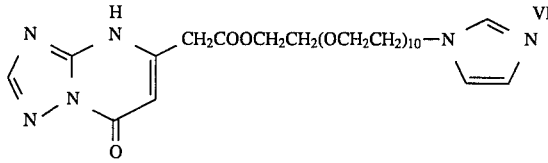
VIII-8
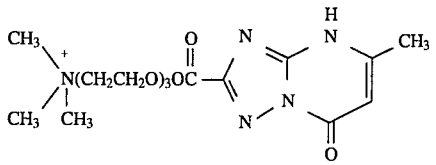
VIII-9
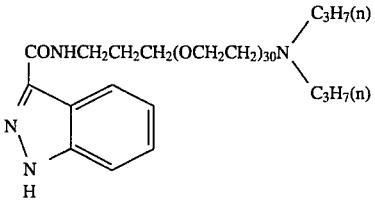
VIII-10
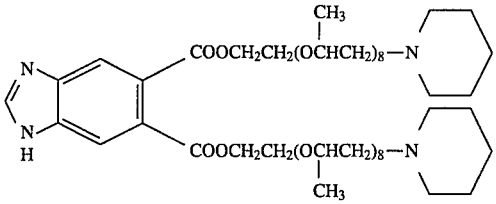
VIII-11
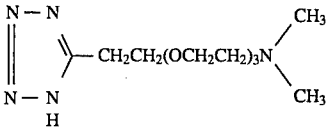
VIII-12
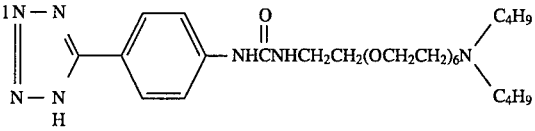
VIII-13
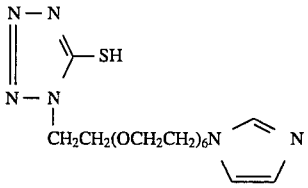
VIII-14
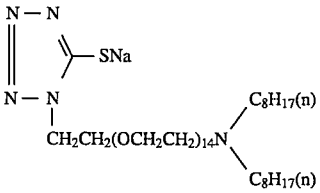
VIII-15
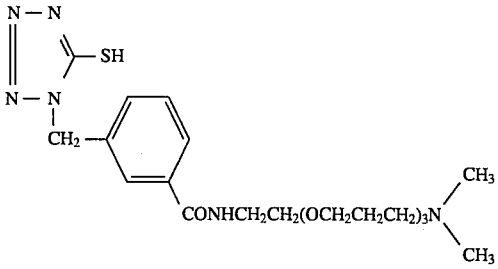
VIII-16
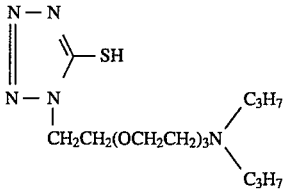
VIII-17
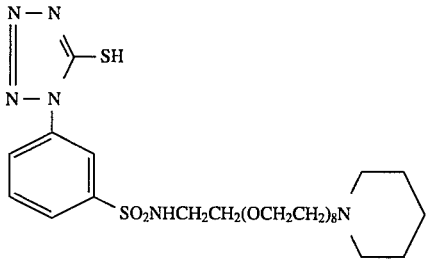
VIII-18
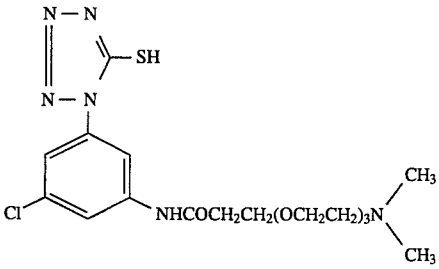
VIII-19
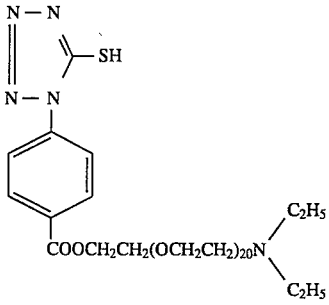
VIII-20
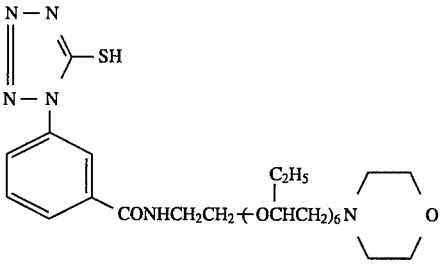

-continued
VIII-21
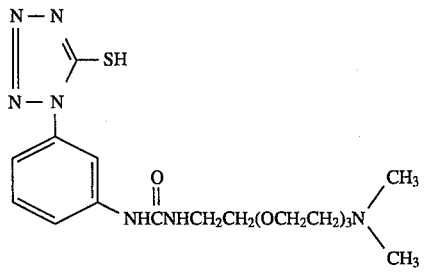
VIII-22
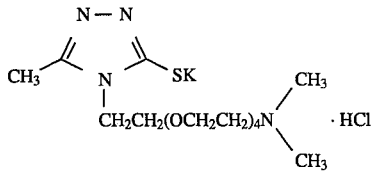
VIII-23
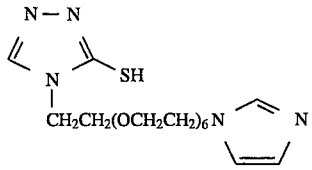
VIII-24
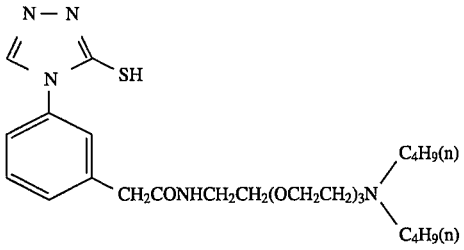
VIII-25
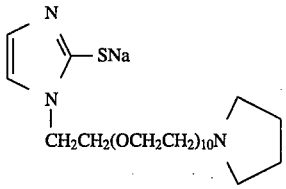
VIII-26
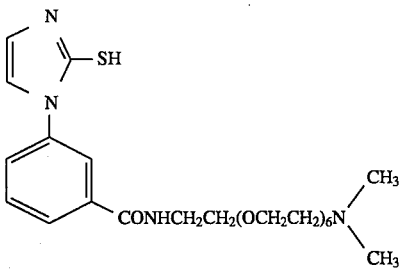
VIII-27
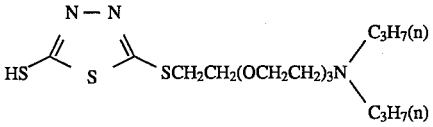
VIII-28
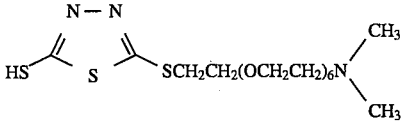
VIII-29
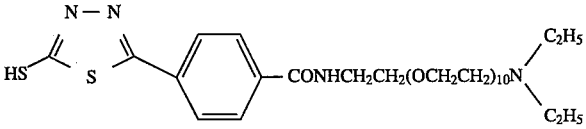
VIII-30
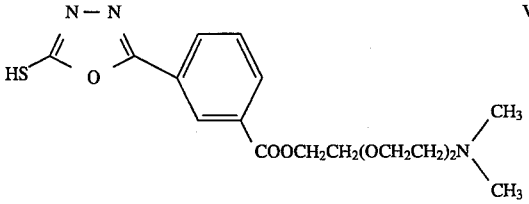
VIII-31
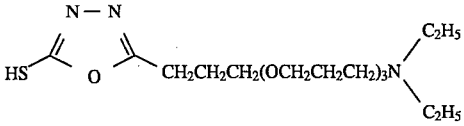
VIII-32
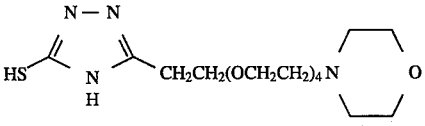
VIII-33
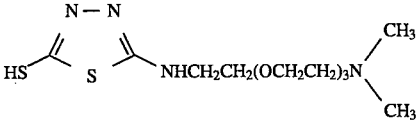
VIII-34
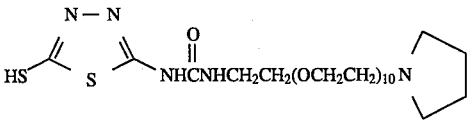
VIII-35
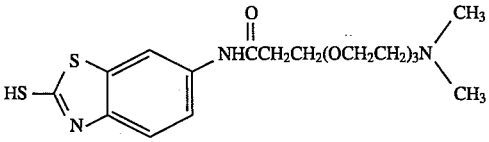
VIII-36
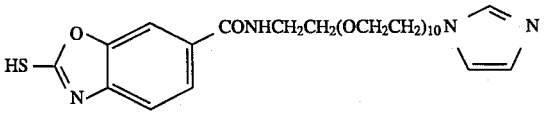
VIII-37
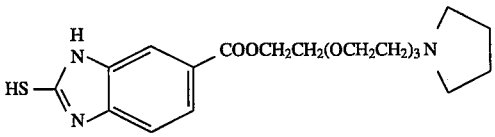

-continued

VIII-38

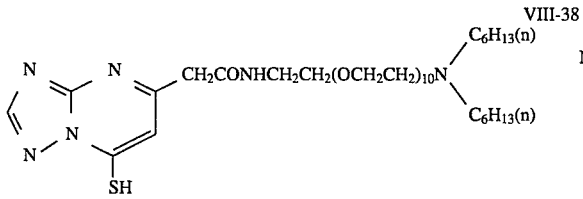

VIII-39

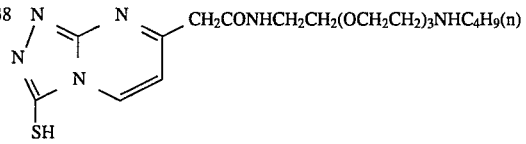

VIII-40

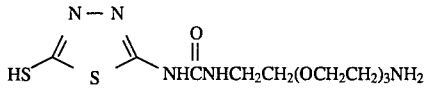

VIII-41

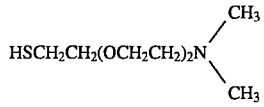

The compounds represented by formulae (VI), (VII) and (VIII) can be easily synthesized according to an addition reaction of an amine compound to an ethylene oxide compound, or a substitution reaction of an amine compound to polyalkylene glycol monohalohydrin.

The amino compounds represented by formulae (VI), (VII) and (VIII) may be contained in a developing solution.

When the amino compounds represented by formulae (VI), (VII) and (VIII) are contained in a developing solution, the addition amount thereof is from 0.005 to 0.30 mol, preferably from 0.01 to 0.2 mol, per liter of the developing solution.

The amino compounds represented by formulae (VI), (VII) and (VIII) are sparingly soluble in a developing solution (water), and when the developing solution is concentrated to reduce the volume for the sake of convenience of the transportation or the storage, the amino compounds sometimes deposit or precipitate. However, when the compound represented by the following formula (Y) or (Z) is used in combination in the concentrated developing solution, it is preferred because generation of such deposition and precipitation can be prevented:

$$R_8—SO_3M' \quad (Y)$$

$$R_9—COOM' \quad (Z)$$

wherein M'represents a hydrogen atom, Na, K or $NH_4$; and $R_8$ and $R_9$ each represents an alkyl group having 3 or more carbon atoms, an alkylbenzene group, or a benzene group.

Specific examples of the compounds represented by formula (Y) include sodium p-toluenesulfonate, sodium benzenesulfonate, and sodium 1-hexanesulfonate. Specific examples of the compounds represented by formula (Z) include sodium benzoate, sodium p-toluylate, potassium isobutyrate, sodium n-caproate, sodium n-caprylate, and sodium n-caprinate.

The amount used of the compound represented by formula (Y) or (Z) varies according to the amount used of the amino compound represented by the above formulae (VI), (VII) and (VIII), but is 0.005 mol/liter or more, preferably from 0.03 mol/liter to 0.1 mol/liter. Further, the compound represented by formula (Y) or (Z) is preferably used in an amount of from 0.5 to 20 mol per mol of these amino compounds.

When the amino compounds represented by formulae (VI), (VII) and (VIII) are included in silver halide photographic materials, the amount included is from $1\times10^{-7}$ to $1\times10^{-3}$ mol/m$^2$, preferably from $1\times10^{-6}$ to $1\times10^{-4}$ mol/m$^2$.

When the amino compounds are contained in photographic materials, they are preferably contained in a silver halide emulsion layer, but they may be contained in other light-insensitive hydrophilic colloid layers (e.g., a protective layer, an interlayer, a filter layer, an antihalation layer). Specifically, when the compounds used are water-soluble, they are added as an aqueous solution; and when sparingly water-soluble, they are added to a hydrophilic colloid solution as a solution of organic solvents miscible with water such as alcohols, esters, or ketones.

Moreover, the compounds represented by formulae (VI) and (VII) and the compound represented by formula (VIII) may be used in photographic materials in combination.

The compound represented by formula (VII) or (VIII) may be or may not be contained in the silver halide photographic material processed with the processing solution containing the compounds represented by formulae (VI) and (VII).

Further, the compound represented by formula (VI) may be or may not be contained in the processing solution which is used for processing the silver halide photographic material containing the compound represented by formula (VII) or (VIII).

Preferred onium salts for use in the present invention are compounds represented by the following formulae (A), (B), (C) and (D).

(A)

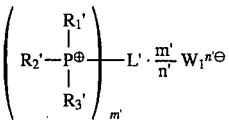

wherein $R_1'$, $R_2'$ and $R_3'$ each represents an alkyl group, a cycloalkyl group, an aryl group, an alkenyl group, a cycloalkenyl group or a heterocyclic group, which each may be substituted; m' represents an integer of from 1 to 4; L' represents an m'-valent organic group bonded with a P atom via the carbon atom thereof; n' represents an integer of from 1 to 3; and $W_1$ represents an n'-valent anion, and $W_1$ may be linked with L'.

(B)

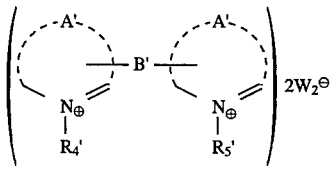

(C)

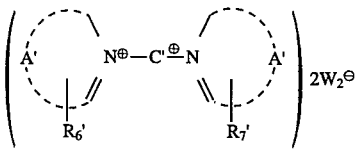

-continued

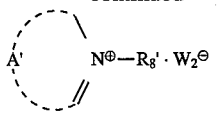

(D)

wherein A' represents an organic group to complete a heterocyclic ring; B' and C' each represents a divalent group; $R_4'$ and $R_5'$ each represents an alkyl group or an aryl group; $R_6'$ and $R_7'$ each represents a hydrogen atom or a substituent; $R_8'$ represents an alkyl group; and $W_2$ represents an anion group, but when the compound forms an inner salt, $W_2$ does not exist.

Formula (A) is described in detail below.

Examples of the groups represented by $R_1'$, $R_2'$ and $R_3'$ include a straight chain or branched alkyl group (e.g., methyl, ethyl, propyl, isopropyl, butyl, isobutyl, sec-butyl, tert-butyl, octyl, 2-ethylhexyl, dodecyl, hexadecyl, octadecyl), an aralkyl group (e.g., substituted or unsubstituted benzyl), a cycloalkyl group (e.g., cyclopropyl, cyclopentyl, cyclohexyl), an aryl group (e.g., phenyl, naphthyl, phenanthryl), an alkenyl group (e.g., allyl, vinyl, 5-hexenyl), a cycloalkenyl group (e.g., cyclopentenyl, cyclohexenyl), and a heterocyclic group (e.g., pyridyl, quinolyl, furyl, imidazolyl, thiazolyl, thiadiazolyl, benzotriazolyl, benzothiazolyl, morpholyl, pyrimidyl, pyrrolidyl), which each may be substituted by one or more substituents. Examples of the substituents include a halogen atom (e.g., fluorine, chlorine, bromine, iodine), a nitro group, a primary amino group, a secondary amino group, a tertiary amino group, an alkyl ether group, an aryl ether group, an alkyl thioether group, an aryl thioether group, a carbonamide group, a carbamoyl group, a sulfonamide group, a sulfamoyl group, a hydroxyl group, a sulfoxy group, a sulfonyl group, a carboxyl group, a sulfonic acid group, a cyano group, and a carbonyl group, in addition to the groups represented by $R_1'$, $R_2'$ and $R_3'$.

Examples of the groups represented by L' include the same groups as described for $R_1'$, $R_2'$ and $R_3'$, a polymethylene group (e.g., trimethylene, tetramethylene, hexamethylene, pentamethylene, octamethylene, dodecamethylene), a divalent aromatic group (e.g., phenylene, biphenylene, naphthylene), a polyvalent aliphatic group (e.g., trimethylenemethyl, tetramethylenemethyl), and a polyvalent aromatic group (e.g., phenylene-1,3,5-toluyl, phenylene-1,2,4,5-tetrayl).

Examples of the anions represented by $W_1$ include a halogen ion (e.g., chlorine ion, bromine ion, iodine ion), a carboxylate ion (e.g., acetate ion, oxalate ion, fumarate ion, benzoate ion), a sulfonate ion (e.g., p-toluenesulfonate ion, methanesulfonate ion, butanesulfonate ion, benzenesulfonate ion), a sulfate ion, a perchlorate ion, a carbonate ion, and a nitrate ion.

In formula (A), $R_1'$, $R_2'$ and $R_3'$ each are preferably a group having from 1 to 20 carbon atoms, and particularly preferably an aryl group having from 6 to 15 carbon atoms. m' is preferably 1 or 2, and when m' is 1, L' is preferably a group having from 1 to 20 carbon atoms, and particularly preferably an alkyl or aryl group having from 1 to 15 total carbon atoms. When m' is 2, the divalent organic group represented by L' is preferably an alkylene group or an arylene group, a divalent group formed by bonding these groups, or a divalent group formed by combining these groups with a —CO— group, an —O— group, an —$NR_9'$— group (wherein $R_9'$ represents a hydrogen atom or the same groups as the substituents for $R_1'$, $R_2'$ and $R_3'$, and when plural $R_9'$ groups exist in the molecule, they may be the same or different, and further, they may be bonded with each other), an —S— group, an —SO— group, or an —$SO_2$— group. When m' is 2, L' is particularly preferably a divalent group bonded with a P atom via the carbon atom thereof and having from 1 to 20 total carbon atoms. When m' is an integer of 2 or more, plural $R_1'$, $R_2'$ and $R_3'$ groups exist in the molecule, and the plural $R_1'$, $R_2'$ and $R_3'$ groups may be the same or different, respectively.

n' is preferably 1 or 2, and m' is preferably 1 or 2. $W_1$ may form an inner salt by bonding with $R_1'$, $R_2'$, $R_3'$ or L'.

Most of the compounds represented by formula (A) for use in the present invention are known compounds and commercially available as a reagent. A method in which phosphinic acids are reacted with an alkylating agent such as alkyl halides or sulfonates, and a method in which the counter anions of phosphonium salts are exchanged by ordinary methods are general synthesis methods of the compounds represented by formula (A).

Specific examples of the compounds represented by formula (A) are shown below, but the present invention is not limited thereto.

A-101

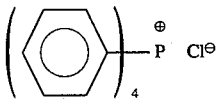

A-102

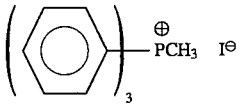

A-103

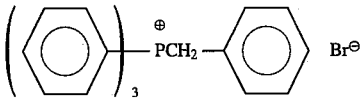

A-104

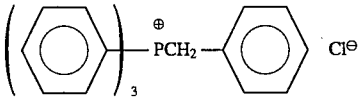

A-105

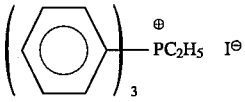

A-106

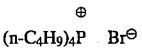

A-107

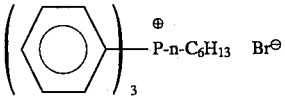

A-108

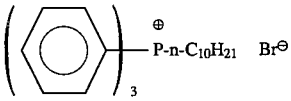

A-109

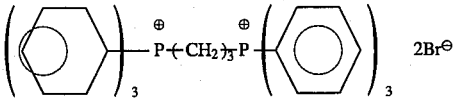

A-110

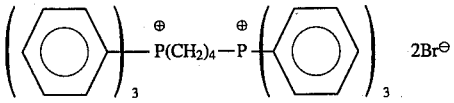

-continued
A-111
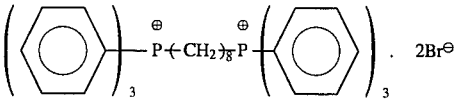
A-112
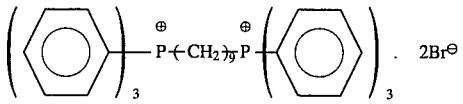
A-113
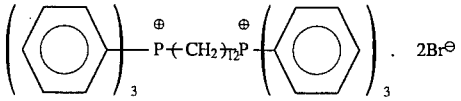
A-114
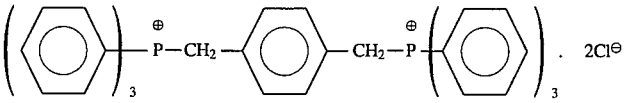
A-115
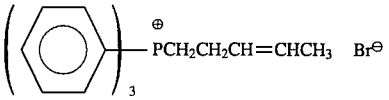
A-116
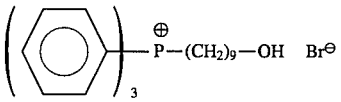
A-117
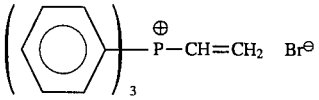
A-118
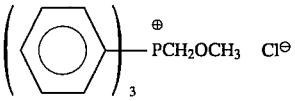
A-119
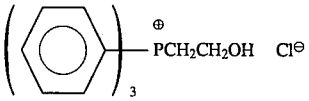
A-120
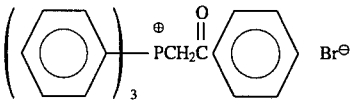
A-121
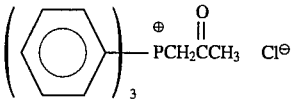
A-122
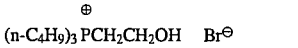
A-123
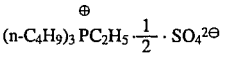
A-124
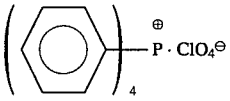
A-125
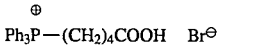
A-126
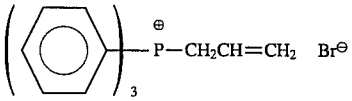
A-127
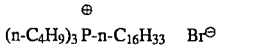
A-128
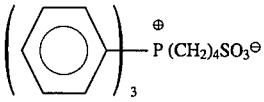
A-129
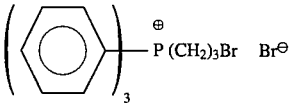
A-130
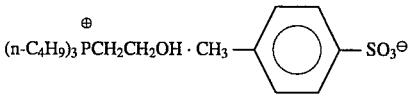
A-131
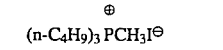
A-132
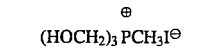
A-133
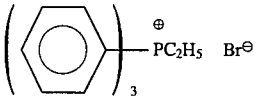
A-134
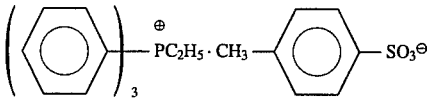
A-135
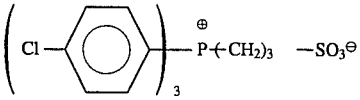
A-136
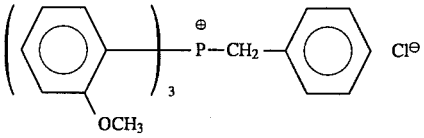

-continued

A-137

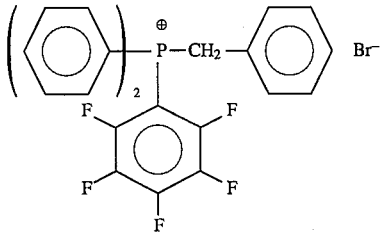

A-138

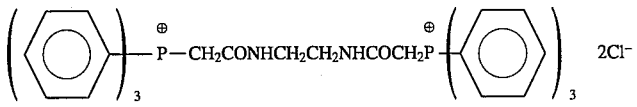

A-139

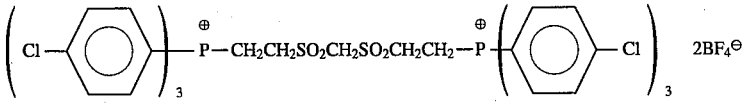

A-140

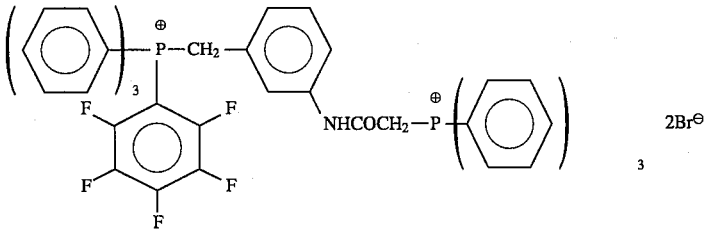

A-141

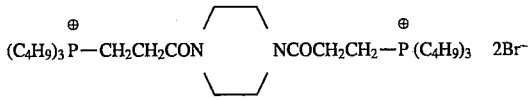

A-142

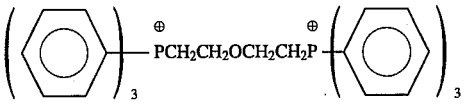

A-143

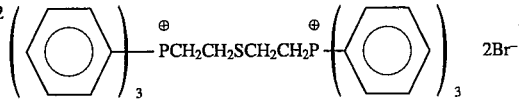

A-144

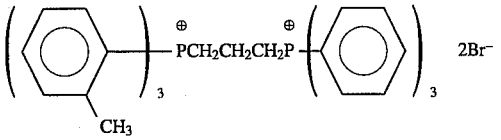

A-145

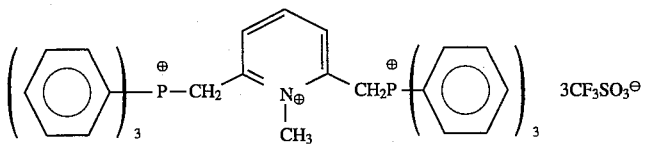

A-146

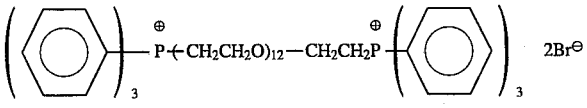

A-147

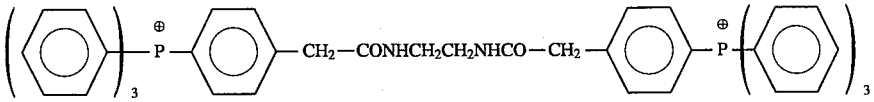

Formulae (B), (C) and (D) are further described in detail below.

In formula (B), (C) or (D), A' represents an organic group to complete a heterocyclic ring, and may contain a carbon atom, a hydrogen atom, an oxygen atom, a nitrogen atom and a sulfur atom, and further, may be condensed with a benzene ring. Preferred examples of A' include a 5- or 6-membered ring, and more preferred examples thereof include a pyridine ring, a quinoline ring, and an isoquinoline ring. Further, A' may be substituted by one or more substituents such as a halogen atom (e.g., chlorine, bromine), a substituted or unsubstituted alkyl group (e.g., methyl, hydroxyethyl), a substituted or unsubstituted aralkyl group (e.g., benzyl, p-methoxyphenethyl), a substituted or unsubstituted aryl group (e.g., phenyl, tolyl, p-chlorophenyl, furyl, thienyl, naphthyl), a substituted or unsubstituted acyl group (e.g., benzoyl, p-bromobenzoyl, acetyl), a sulfo group, a carboxyl group, a hydroxyl group, an alkoxy group (e.g., methoxy, ethoxy), an aryloxy group, an amide group, a sulfamoyl group, a carbamoyl group, a ureido group, an unsubstituted or alkyl-substituted amino group, a cyano group, a nitro group, an alkylthio group, and an arylthio group. Examples of particularly preferred substituents include an aryl group, a sulfo group, a carboxyl group and a hydroxyl group.

The divalent groups represented by B' and C' are preferably divalent groups comprising alkylene, arylene, alkenylene, $—SO_2—$, —SO—, —O—, —S—, $—N(R_{10}')—$ or a combination thereof, wherein $R_{10}'$ represents an alkyl group, an aryl group, or a hydrogen atom. Particularly preferred divalent groups represented by B' and C' are divalent groups comprising alkylene, arylene, —O—, —S— or a combination thereof.

$R_4'$ and $R_5'$ may be the same or different and each are preferably an alkyl group having from 1 to 20 carbon atoms. The alkyl group may be substituted by one or more substituents such as a halogen atom (e.g., chlorine, bromine), a substituted or unsubstituted aryl group (e.g., phenyl, tolyl, p-chlorophenyl, furyl, thienyl, naphthyl), a substituted or unsubstituted acyl group (e.g., benzoyl, p-bromobenzoyl, acetyl), a sulfo group, a carboxyl group, a hydroxyl group, an alkoxy group (e.g., methoxy, ethoxy), an aryloxy group, an amide group, a sulfamoyl group, a carbamoyl group, a ureido group, an unsubstituted or alkyl-substituted amino group, a cyano group, a nitro group, an alkylthio group, and an arylthio group. $R_4'$ and $R_5'$ each are particularly preferably an alkyl group having from 1 to 10 carbon atoms, and preferred examples of the substituents include an aryl group, a sulfo group, a carboxyl group and a hydroxyl group.

$R_6'$ and $R_7'$ each represents a hydrogen atom or a substituent, and examples of the substituents are selected from the substituents for the alkyl group represented by $R_4'$ and $R_5'$. Preferably, $R_6'$ and $R_7'$ each has from 0 to 10 carbon atoms, specifically an aryl-substituted alkyl group or a substituted or unsubstituted aryl group.

$R_8'$ is preferably an alkyl group having from 1 to 20 carbon atoms, which may be straight chain or branched, or may be a cyclic alkyl group. The alkyl group may be substituted by one or more substituents selected from the substituents for the alkyl group represented by $R_4'$ and $R_5'$.

$W_2$ represents an anion group, but when the compound forms an inner salt, $W_2$ does not exist. Examples of W2 include a chlorine ion, a bromine ion, an iodine ion, a nitrate ion, a sulfate ion, a p-toluenesulfonate ion, and an oxalate ion.

The compounds represented by formulae (B), (C) and (D) for use in the present invention can easily be synthesized according to generally known methods, and *Quart. Rev.*, 16, 163 (1962) can be referred to.

Specific examples of the compounds represented by formulae (B), (C) and (D) are shown below. However, it should not be construed as the present invention is limited thereto.

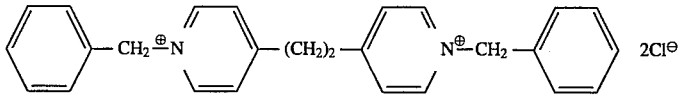
A-201

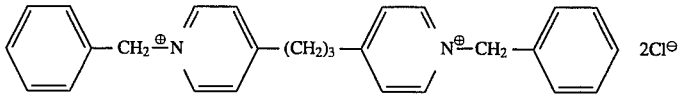
A-202

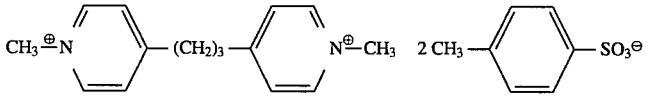
A-203

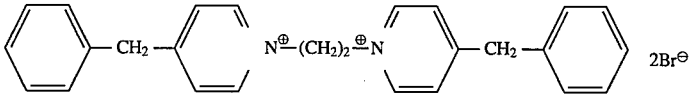
A-204

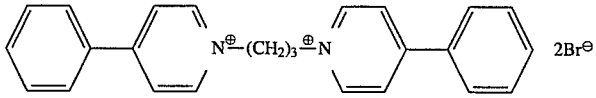
A-205

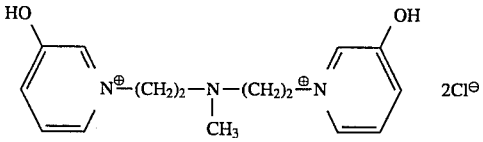
A-206

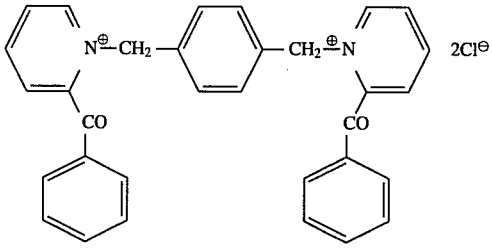
A-207

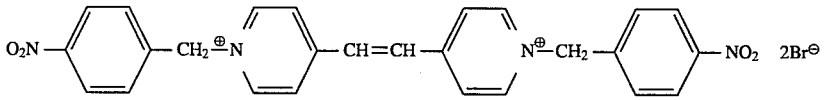
A-208

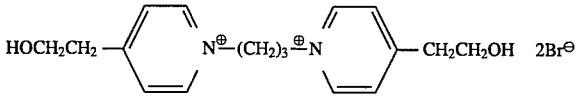
A-209

-continued
A-210
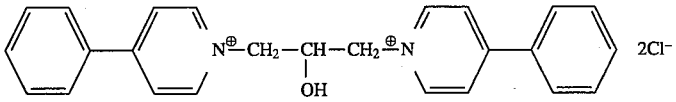
A-211
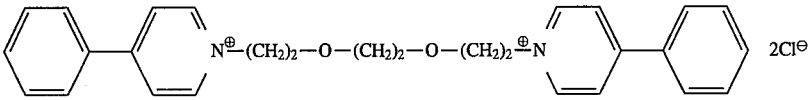
A-212
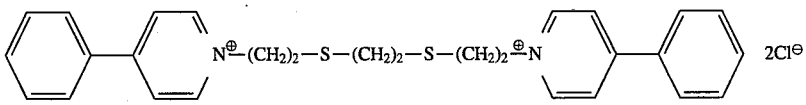
A-213
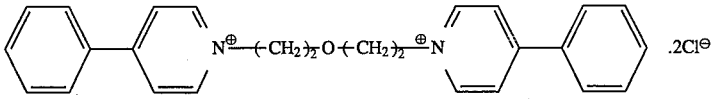
A-214
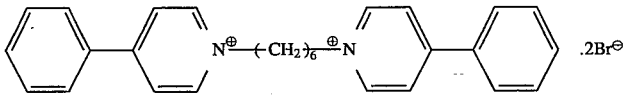
A-215
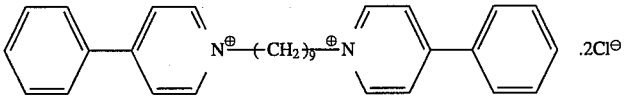
A-216
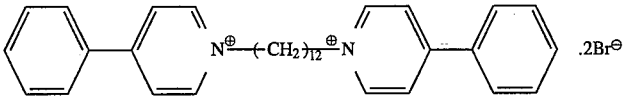
A-217
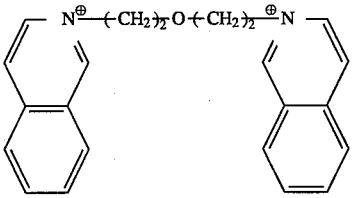
A-218
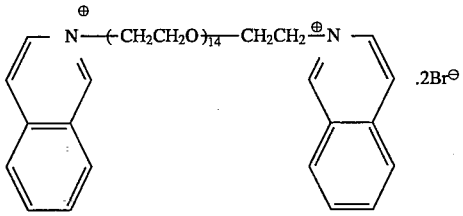
A-219
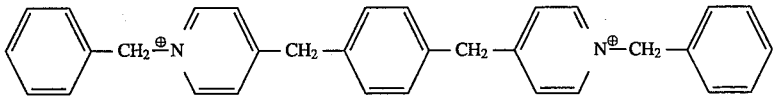
A-220
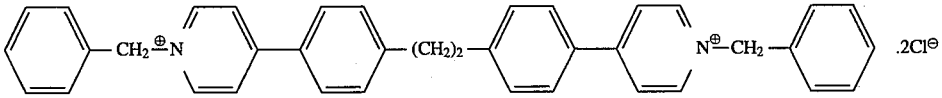
A-221
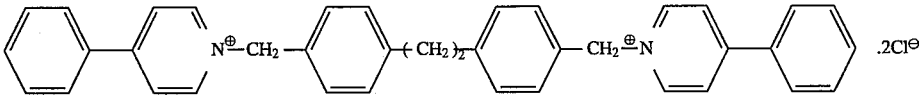
A-222
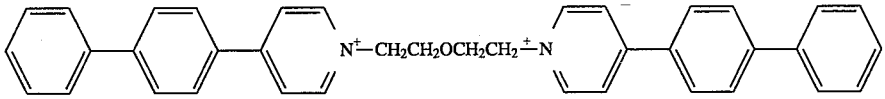
A-223
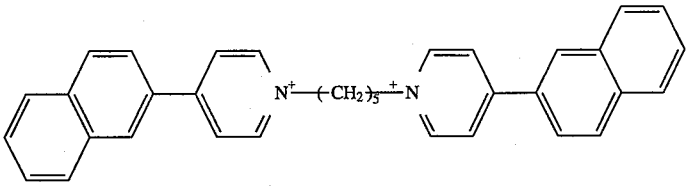

-continued
A-224
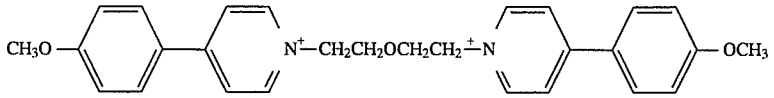
A-225
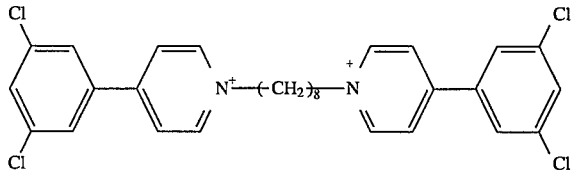
A-226
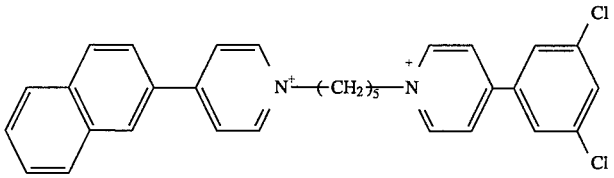
A-227
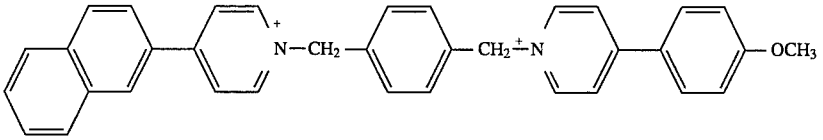
A-228
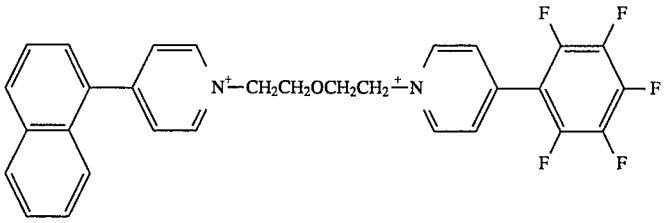
A-229
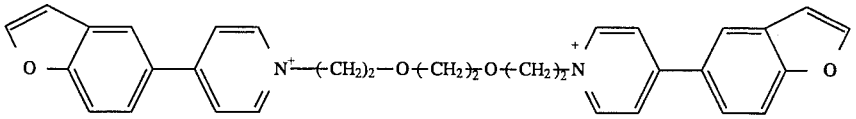
A-230
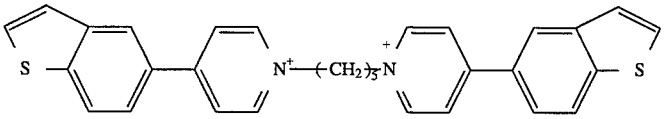
A-231
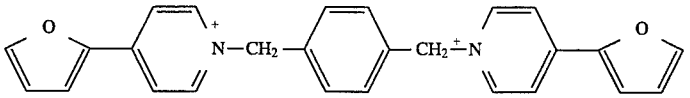
A-232
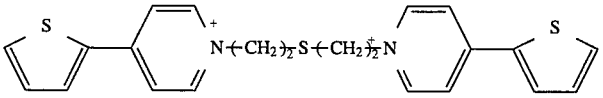
A-233
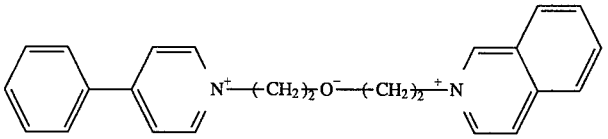
A-234
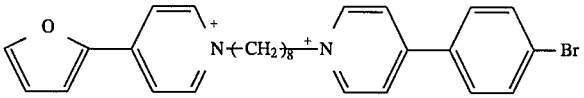
A-235
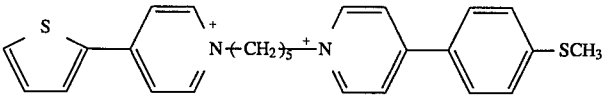

-continued
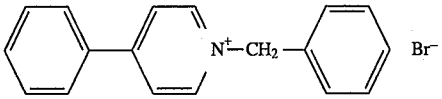
A-236
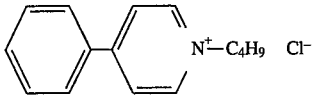
A-237
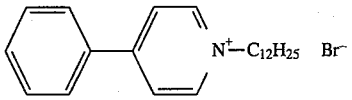
A-238
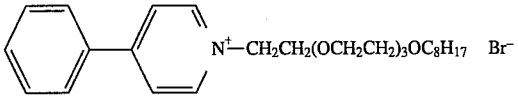
A-239
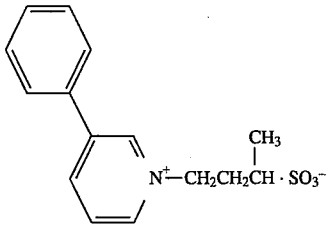
A-240
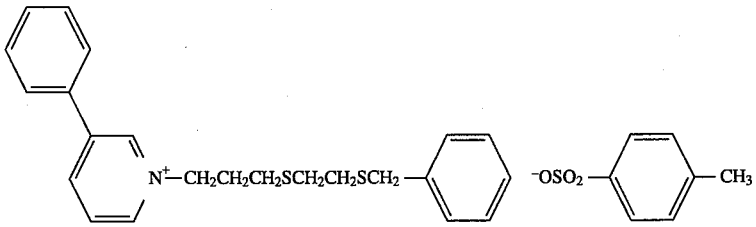
A-241
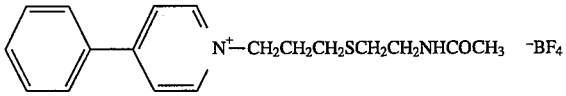
A-242
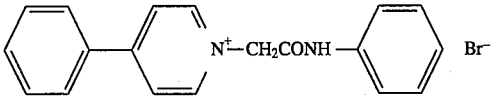
A-243
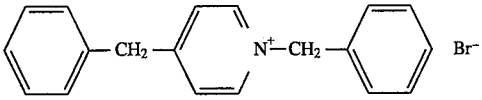
A-244
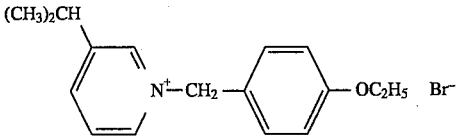
A-245
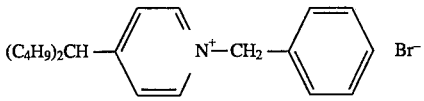
A-246
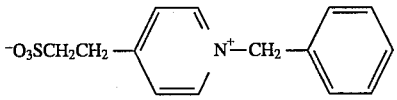
A-247
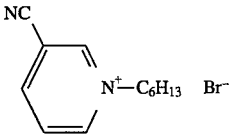
A-248
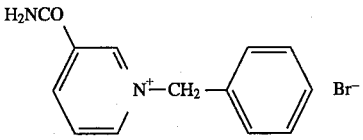
A-249
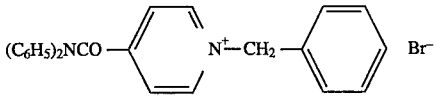
A-250
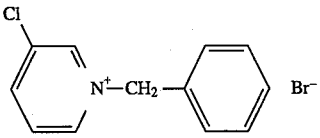
A-251
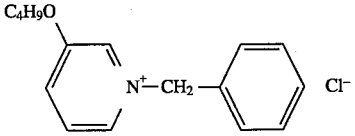
A-252

-continued

A-253

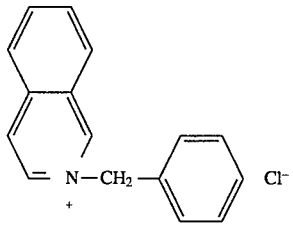

A-254

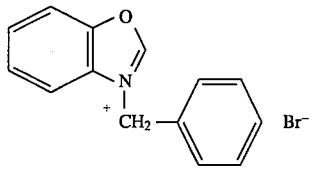

A-255

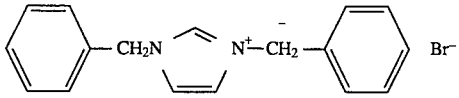

The amount added of the compound represented by formulae (A), (B), (C) and (D) is not particularly limited, but is preferably from $1\times10^{-5}$ to $2\times10^{-2}$ mol, particularly preferably from $2\times10^{-5}$ to $1\times10^{-2}$ mol, per mol of the silver halide.

When the water-soluble or water-insoluble compounds represented by formulae (A), (B), (C) and (D) are contained in photographic materials, water-soluble compounds are added as an aqueous solution, and the water-insoluble compounds are added to a silver halide emulsion solution or a hydrophilic colloid solution as a solution of organic solvents miscible with water such as alcohols (e.g., methanol, ethanol), esters (e.g., ethyl acetate), or ketones (e.g., acetone).

Further, other methods can be utilized for the inclusion of the compounds, such as the well-known emulsification dispersion method which comprises dissolving the compounds using oils, such as dibutyl phthalate, tricresyl phosphate, glyceryl triacetate or diethyl phthalate; auxiliary solvents such as ethyl acetate or cyclohexanone; and preparing an emulsified dispersion mechanically, or the solid dispersion method in which the compounds are finely dispersed and included in photographic materials.

The compounds disclosed in, for example, JP-A-61-198147 can be used as disulfide derivatives.

The compounds disclosed in, for example, U.S. Pat. Nos. 4,698,956, 4,777,118, EP 231,850, and JP-A-62-50829 can be used as dihydroxy derivatives, but diarylmethacrynol derivatives are more preferably used.

The compounds disclosed in, for example, JP-A-3-168735 and JP-A-2-271351 can be used as acetylene derivatives.

The compounds disclosed in, for example, JP-A-3-168736 can be used as urea derivatives.

The halogen compositions of the silver halide emulsions of the silver halide photographic material used in the present invention are not particularly limited. Examples thereof include silver chloride, silver chlorobromide, silver iodochlorobromide, silver bromide and silver iodobromide. The silver halide grains may have any crystal shape, such as that of a cube, a tetradecahedron, an octahedron, amorphism or a plate. However, it is preferable for them to be cubic grains. The average grain size of the silver halide are preferably from 0.1 to 0.7 μm, more preferably from 0.2 to 0.5 μm. As for the distribution of grain sizes, it is preferable that the distribution be so narrow as to correspond to a variation coefficient of 15% or less, preferably 10% or less, wherein the variation coefficient refers to the value obtained by dividing the standard deviation regarding the grain sizes of silver halide grains by the average grain size and then multiplying the quotient by 100.

The silver halide grains may be uniform throughout, or differ between the inner part and the surface layer.

Photographic emulsions used in the present invention can be prepared using methods described in, e.g., P. Glafkides, *Chemie et Physique Photographique,* Paul Montel, Paris (1967), G. F. Duffin, *Photographic Emulsion Chemistry,* The Focal Press, London (1966), V. L. Zelikman et al, *Making and Coating Photographic Emulsion,* The Focal Press, London (1964), and so on.

Suitable methods for reacting a water-soluble silver salt with a water-soluble halide include, e.g., a single jet method, a double jet method, or a combination thereof.

A method in which silver halide grains are produced in the presence of excess silver ion (the so-called reverse mixing method) can be employed. On the other hand, the so-called controlled double jet method, in which the pAg of the liquid phase wherein silver halide grains are to be precipitated is maintained constant, may be employed. Further, it is preferable to carry out the grain formation using the so-called silver halide solvent, such as ammonia, thioethers and tetrasubstituted thioureas. Preferably, tetrasubstituted thioureas are used as the silver halide solvent, which are disclosed in JP-A-53-82408 and JP-A-55-77737. As for the thioureas, tetramethylthiourea and 1,3-dimethyl-2-imidazolinethione are preferably used.

According to the controlled double jet method and the grain formation method using a silver halide solvent, a silver halide emulsion having a regular crystal shape and a narrow distribution of grain sizes can be obtained with ease, and so these methods are useful for making the silver halide emulsions used in the present invention.

For the purpose of rendering the grain sizes uniform, it is also preferable that the grain growth is accelerated within the limits of critical saturation degree by using a method of changing the addition speed of silver nitrate or an alkali halide depending on the speed of grain growth, as described in British Patent No. 1,535,016, JP-B-48-36890 and JP-B-52-16364 (the term "JP-B" as used herein means an "examined Japanese patent publication"), or a method of changing the concentrations of the aqueous solutions, as described in British Patent No. 4,242,445 and JP-A-55-158124.

For attainment of high contrast and low fog density, it is desirable to incorporate at least one metal selected from rhodium, rhenium, ruthenium, osmium and iridium into silver halide grains used in the silver halide photographic material of the present invention. The content of such a metallic compound is preferably from $1\times10^{-9}$ to $1\times10^{-5}$ mol, more preferably from $1\times10^{-8}$ to $5\times10^{-6}$ mol, per mol of silver. These metals may be used as a mixture of two or more thereof. The metals can be distributed evenly throughout the grains, or can be distributed in a specified pattern as described in JP-A-63-29603, JP-A-2-306236, JP-A-3-167545, JP-A-4-76534, JP-A-5-273746 and JP-A-6-110146.

The rhodium compounds which can be used in the present invention are water-soluble ones. Suitable examples thereof include rhodium(III) halides and rhodium complex salts containing as ligands halogen atoms, amines, oxalato groups or so on, such as hexachlororhodium(III) complex salts, hexabromorhodium(III) complex salts, hexaamminerhodium(III) complex salts and trioxalatorhodium(III) complex salts. In using these rhodium compounds, they are dissolved in water or an appropriate solvent. In order to stabilize the solution of a rhodium compound, a conventional method, that is, a method of adding an aqueous solution of hydrogen halogenide (e.g., hydrochloric acid, hydrobromic acid, hydrofluoric acid) or an alkali halide (e.g., KCl, NaCl, KBr, NaBr), can be adopted. Instead of using a water-soluble rhodium compound, it is possible to incorporate rhodium into emulsion grains by adding rhodium-doped silver halide grains to the silver halide preparation system and dissolving the grains therein.

Those compounds can be properly added at the time silver halide emulsion grains are formed, or at any stage prior to the emulsion coating. In particular, it is preferable for them to be added at the time the emulsion is formed, and thereby to be incorporated into silver halide grains.

As for the iridium compounds used in the present invention, various ones including, e.g., hexachloroiridium, hexaammineiridium, trioxalatoiridium and hexacyanoiridiumsalts can be used in the present invention. In using these iridium compounds, they are dissolved in water or an appropriate solvent. In order to stabilize the solution of an iridium compound, a conventional method, that is, a method of adding an aqueous solution of hydrogen halogenide (e.g., hydrochloric acid, hydrobromic acid, hydrofluoric acid) or an alkali halide (e.g., KCl, NaCl, KBr, NaBr), can be adopted. Instead of using a water-soluble iridium compound, it is possible to incorporate iridium into emulsion grains by adding iridium-doped silver halide grains to the silver halide preparation system and dissolving the grains therein.

The silver halide grains used in the present invention may be doped with rhenium, ruthenium or osmium.

In doping with such metal, the metal is added to an emulsion in the form of water-soluble complex salt disclosed in, for example, JP-A-63-2042, JP-A-1-285941, JP-A-2-20852, JP-A-2-20855. In particular, complexes having the coordination number of 6 and represented by the following formula are preferable:

$$[VL^{0}_{6}]^{-n^{0}}$$

wherein V represents Ru, Re or Os, $L^0$ represents a ligand, and $n^0$ is 0, 1, 2, 3 or 4.

In this case, a counter ion is of no importance, so that an ammonium ion or an alkali metal ion is used as the counter ion.

As for the ligands, halides, cyanide, cyanate, nitrosyl or thionitrosyl ligands are suitable examples thereof. Specific examples of the metal complexes which can be used in the present invention are given below. However, the invention should not construed as being limited to these examples.

| | | |
|---|---|---|
| $[ReCl_6]^{-3}$ | $[ReBr_6]^{-3}$ | $[ReCl_5(NO)]^{-2}$ |
| $[Re(NS)Br_5]^{-2}$ | $[Re(NO)(CN)_5]^{-2}$ | $[Re(O)_2(CN)_4]^{-3}$ |
| $[RuCl_6]^{-3}$ | $[RuCl_4(H_2O)_2]^{-2}$ | $[RuCl_5(NO)]^{-2}$ |
| $[RuBr_5(NS)]^{-2}$ | $[Ru(CN)_6]^{-4}$ | $[Ru(CO)_3Cl_3]^{-2}$ |
| $[Ru(CO)Cl_5]^{-2}$ | $[Ru(CO)Br_5]^{-2}$ | |
| $[OsCl_5]^{-3}$ | $[OsCl_5(NO)]^{-2}$ | $[Os(NO)(CN)_5]^{-2}$ |
| $[Os(NS)Br_5]^{-2}$ | $[Os(CN)_6]^{-4}$ | $[Os(O)_2(CN)_4]^{-4}$ |

The addition of these metal complexes can be properly carried out at the time silver halide emulsion grains are formed, or at any stage prior to the emulsion coating. In particular, it is preferable for them to be added at the time the emulsion is formed, and thereby to be incorporated into silver halide grains.

In order to incorporate such a metal complex as cited above into silver halide grains by adding it during the grain formation, there can be adopted the method of adding in advance a solution prepared by dissolving in water the metal complex powder or its mixture with NaCl or KCl to either a water-soluble salt solution or a water-soluble halide solution for the grain formation; the method of forming silver halide grains by simultaneously admixing three solutions, namely a silver salt solution, a halide solution and the foregoing metal complex powder-containing solution as the third solution; or the method of pouring a water solution of the metal complex in a desired amount into the reaction vessel under grain formation. In particular, it is preferable to adopt the method of adding to an aqueous halide solution a solution prepared by dissolving in water the metal complex powder together with NaCl or KCl.

In order to make such a metal complex adsorb to the grain surface, an aqueous solution thereof may be poured into the reaction vessel in a required amount just after the grain formation, during or at the conclusion of physical ripening, or at the time of chemical ripening.

Various kinds of iridium compounds can be used in the present invention. Specific examples of an iridium compound which can be used include hexachloroiridium, hexaammineiridium, trioxalatoiridium, hexacyanoiridium, and so on. In using these compounds, they are dissolved in water or an appropriate solvent. In order to stabilize a solution of iridium compound, a prevailing method, or a method of adding a water solution of hydrogen halide (e.g., hydrochloric acid, hydrobromic acid, hydrofluoric acid) or an alkali halide (e.g., KCl, NaCl, KBr, NaBr), can be adopted. Instead of using a water-soluble iridium compound, iridium can be introduced into a silver halide emulsion by adding silver halide grains which are in advance doped with iridium to another silver halide system under preparation to dissolve the grains therein.

Silver halide grains used in the present invention may be doped by other heavy metal salts. In particular, the doping of an Fe complex salt, such as $K_4[Fe(CN)_6]$, is preferred.

Further, the silver halide grains used in the present invention may contain metal atoms, such as cobalt, nickel, palladium, platinum, gold, thallium, copper and lead. These metals are preferably used in an amount of from $1\times10^{-9}$ to $1\times10^{-4}$ mol per mol of silver halide. The metals can be contained in the grains by the addition in the form of metal salt, including single, double and complex salts, during the grain formation.

The silver halide emulsions used in the present invention may be chemically sensitized. As for the chemical sensitization, known methods, such as a sulfur sensitization method, a selenium sensitization method, a tellurium sensitization method, a reduction sensitization method and a precious metal sensitization method, can be adopted. These methods can be used alone or in combination. In the combined use, it is preferable to combine, e.g., a sulfur sensitization method and a gold sensitization method, a sulfur sensitization method, a selenium sensitization and a gold sensitization method, or a sulfur sensitization method, tellurium sensitization method and a gold sensitization method.

In the sulfur sensitization method adopted in the present invention, sensitization can be generally effected by adding a sulfur sensitizer to an emulsion and stirring the emulsion for a prescribed time under a temperature of 40° C. or higher. As for the sulfur sensitizer, known compounds including not only sulfur compounds contained in gelatin but also thiosulfates, thioureas, thiazoles, rhodanines and so on can be used. Of these sulfur sensitizers, thiosulfates and thiourea compounds are preferred. The amount of a sulfur sensitizer added, though it is changed depending on various conditions, such as the pH and the temperature at the time of chemical sensitization and the size of silver halide grains, is in the range of $10^{-7}$ to $10^{-2}$ mol, preferably $10^{-5}$ to $10^{-3}$ mol, per mol of silver halide.

Selenium sensitizers which can be used in the present invention include those disclosed in known patents. In general, selenium sensitization can be effected by adding an unstable selenium compound and/or a nonunstable selenium compound to the silver halide emulsion and agitating the resulting emulsion at a high temperature, preferably 40° C. or more, for a definite time. Suitable examples of the unstable selenium compounds include those disclosed in JP-B-44-15748, JP-B-43-13489, JP-A-4-25832, JP-A-4-109240, JP-A-4-271341, JP-A-4-25832, JP-A-4-109240 and JP-A-4-324855. Specific examples of the unstable selenium compound include isoselenocyanates (e.g., aliphatic isoselenocyanates such as allylisoselenocyanate), selenoureas, selenoketones, selenoamides, selenocarboxylic acids (e.g., 2-selenopropionic acid, 2-selenobutyric acid), selenoesters, diacylselenides (e.g., bis(3-chloro-2,6-dimethoxybenzoyl)selenide), selenophosphates, phosphinoselenides, and colloidal metallic selenium. The compounds represented by formula (VIII) or (IX) described in JP-A-4-324855 are preferably used.

On the other hand, examples of the nonunstable selenium compounds which can be used in the present invention include those disclosed in JP-B-46-4553, JP-B-52-34492 and JP-B-52-34491. Specific examples of such nonunstable selenium compounds include selenious acid, potassium selenocyanide, selenazoles, quaternary salts of selenazoles, diaryl selenides, diaryl diselenides, dialkyl selenides, dialkyl diselenides, 2-selenazolidinedione, 2-selenoxazolidinethione, and derivatives of these compounds.

Tellurium sensitizers which can be used in the present invention are compounds capable of producing silver telluride, which is presumed to act as a sensitization nucleus, at the surface or the inside of silver halide grains. The production rate Of silver telluride in a silver halide emulsion can be examined by the method disclosed in JP-A-5-313284.

Specific examples of the tellurium sensitizers which can be used include the compounds disclosed in U.S. Pat. Nos. 1,623,499, 3,320,069 and 3,772,031; British Patent Nos. 235,211, 1,121,496, 1,295,462 and 1,396,696; Canadian Patent No. 800,958, JP-A-4-204640, JP-A-4-271341, JP-A-4-333043 and JP-A-5-303157; *J. Chem. Soc. Commun.*, 635 (1980); ibid. 1102 (1979); ibid. 645 (1979); *J. Chem. Soc. Perkin. Trans.*, 1,2191 (1980); S. Patai (compiler), *The Chemistry of Organic Selenium and Tellurium Compounds*, Vol. 1 (1986); and ibid. Vol. 2 (1987). In particular, the compounds represented by formulae (II), (III) and (IV) in JP-A-5-303157 are preferred.

The amounts of selenium and tellurium sensitizers used in the present invention, though they depend on the conditions under which the silver halide grains are ripened chemically, are generally from $10^{-8}$ to $10^{-2}$ mol, preferably from $10^{-7}$ to $\times 10^{-3}$ mol, per mol of silver halide. The chemical sensitization, although the present invention does not impose any particular restriction thereon, is generally carried out under a condition such that the pH is from 6 to 11, the pAg is from 6 to 11, preferably from 7 to 10, and the temperature is from 40° to 95° C., preferably from 45° to 85° C.

Examples of precious metal sensitizers used in the present invention include gold, platinum and palladium. In particular, gold sensitizers are preferred. Suitable examples of such gold sensitizers include chloroauric acid, potassium chloroaurate, potassium aurithiocyanate and auric sulfide. These gold sensitizers can be used in an amount of $10^{-7}$ to $10^{-2}$ mol per mol of silver halide.

In a process of producing silver halide emulsion grains used in the present invention or allowing the produced grains to ripen physically, a cadmium salt, a zinc salt, a lead salt, and a thallium salt may be present.

Further, reduction sensitization can be adopted in the present invention. Examples of such reduction sensitizer include stannous salts, amines, formamidinesulfinic acid and silane compounds.

To the silver halide emulsions used in the present invention, thiosulfonate compounds may be added according to the method described in European Patent (EP) No. 293,917.

The present photographic material may contain only one kind of silver halide emulsion or not less than two kinds of silver halide emulsions (differing in average grain size, halide composition, crystal habit or chemical sensitization condition).

Gelatin is preferably used as a binder for a photographic emulsion or as a protective colloid, but other hydrophilic colloids can also be used. Examples thereof include gelatin derivatives; graft polymers of gelatin and other high polymers; proteins such as albumin and casein; cellulose derivatives such as hydroxyethyl cellulose, carboxymethyl cellulose, and cellulose sulfate; sodium alginate; sugar derivatives such as starch derivatives; and various kinds of synthetic hydrophilic high polymers of homopolymers or copolymers such as polyvinyl alcohol, polyacrylic acid, polymethacrylic acid, polyacrylamide, polyvinylimidazole, and polyvinyl butyral.

Examples of the supports for use in the photographic material of the present invention include a paper support laminated with α-olefin polymers (e.g., polyethylene, polypropylene, ethylene/butene copolymer), a flexible synthetic paper support, and a metal support. A polyethylene terephthalate support is particularly preferred. Examples of the subbing layers for use in the present invention include a subbing layer which is coated with an organic solvent containing polyhydroxybenzenes and a subbing layer coated with water latex as disclosed in JP-A-49-11118 and JP-A-52-10491. Generally, the surfaces of these subbing layers can be chemically or physically processed. Examples of the processing include a surface active treatment such as a chemical treatment, a mechanical treatment, and a corona discharge treatment.

The preferred developing solution according to the present invention (a) comprises (1) from 0.2 to 0.75 mol/liter of dihydroxybenzene developing agent, (2) from 0.001 to 0.06 mol/liter of 1-phenyl-3-pyrazolidone or p-aminophenol auxiliary developing agent, (3) from 0.3 to 1.2 mol/liter of free sulfite ion, and (4) a compound represented by the following formula (E); (b) has a concentration ratio of the compound represented by formula (E) to the dihydroxybenzene developing agent is from 0.03 to 0.12, and (c) has a pH value of from 9.0 to 12.0, preferably from 9.6 to less than 11.0, and more preferably from 10.0 to 10.8:

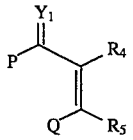

(E)

wherein $R_4$ and $R_5$ each represents a hydroxyl group, an amino group, an acylamino group, an alkylsulfonylamino group, an arylsulfonylamino group, an alkoxycarbonylamino group, a mercapto group or an alkylthio group; P and Q each represents a hydroxyl group, a carboxyl group, an alkoxy group, a hydroxyalkyl group, a carboxyalkyl group, a sulfo group, a sulfoalkyl group, an amino group, an aminoalkyl group, an alkyl group or an aryl group, or P and Q may be bonded with each other to represent an atomic group necessary for forming a 5- to 8-membered ring together with the two vinyl carbon atoms substituted by $R_4$ and $R_5$ and the carbon atom substituted by $Y_1$, in which $Y_1$ represents =O or =N—$R_6$; and $R_6$ represents a hydrogen atom, a hydroxyl group, an alkyl group, an acyl group, a hydroxyalkyl group, a sulfoalkyl group, or a carboxyalkyl group.

Detailed explanation of formula (E) and specific examples of the compounds represented by formula (E) are disclosed in Japanese Patent Application No. 5-282101.

The preferred compound represented by formula (E) is an ascorbic acid or an erythorbic acid (stereoisomer). The addition amount of the compound represented by formula (E) is from 0.03 to 0.12 of the concentration ratio of the compound represented by formula (E) to the dihydroxybenzene developing agent (the value obtained by dividing the concentration of the compound represented by formula (E) by the concentration of dihydroxybenzene developing agent), preferably from 0.03 to 0.10, and particularly preferably from 0.05 to 0.09.

Examples of the hydroquinone developing agent for use in the present invention include hydroquinone, chlorohydroquinone, bromohydroquinone, isopropylhydroquinone, methylhydroquinone, 2,3-dibromohydroquinone, and 2,5-dimethylhydroquinone, and hydroquinone is particularly preferred. The concentration of the hydroquinone derivative in a developing solution is from 0.2 to 0.75 mol/liter, preferably from 0.2 to 0.5 mol/liter, and particularly preferably from 0.2 to 0.4 mol/liter.

Examples of the 1-phenyl-3-pyrazolidone derivative developing agent for use in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone. Among these, preferred are 1-phenyl-3-pyrazolidone and 1-phenyl-4-methyl-4-hydroxymethyl-3-pyrazolidone.

Examples of the p-aminophenol developing agent for use in the present invention include N-methyl-p-aminophenol, p-aminophenol, N-(β-hydroxyethyl)-p-aminophenol, and N-(4-hydroxyphenyl)glycine, and N-methyl-p-aminophenol is preferred.

When the dihydroxybenzenes are used in combination with the 1-phenyl-3-pyrazolidones or p-aminophenols, the amount used of the former is preferably from 0.05 mol/liter to 0.5 mol/liter and the latter is preferably 0.06 mol/liter or less.

A preservative for use in the developing solution of the developing agent of the present invention is a free sulfite ion, which is added to the developing solution in the form of sodium sulfite, lithium sulfite, ammonium sulfite, or sodium bisulfite. The concentration of the free sulfite ion is from 0.3 to 1.2 mol/liter, preferably from 0.4 to 1.0 mol/liter, and particularly preferably from 0.5 to 0.8 mol/liter.

The pH of the developing solution for use in the development processing of the present invention is from 9.0 to 12.0, preferably from 9.5 to 12.0, more preferably from 9.6 to less than 11.0, and most preferably from 10.0 to 10.8. Examples of the alkali agents used for adjusting the pH include pH adjustors such as sodium hydroxide, sodium carbonate, sodium tertiary phosphate, potassium hydroxide and potassium carbonate.

It is preferred that borate which is usually used as a buffer should not be present in the developing solution because it forms a complex with the ascorbic acid derivative compound represented by formula (E).

Dialdehyde hardening agents or bisulfite adducts thereof may be used in the developing solution according to the present invention. Specific examples thereof include glutaraldehyde, α-methylglutaraldehyde, β-methylglutaraldehyde, maleindialdehyde, succindialdehyde, methoxysuccindialdehyde, methylsuccindialdehyde, α-methoxy-β-ethoxyglutaraldehyde, butoxyglutaraldehyde, α,α-diethylsuccindialdehyde, butylmaleindialdehyde, or bisulfite adducts of these compounds. Among these, glutaraldehyde or bisulfite adduct thereof is most generally used. Dialdehyde compound is used in such a degree of amount that the sensitivity of the photographic layer to be processed is not restrained and the drying time is not so prolonged. Specifically, the compound is used in an amount of from 1 g to 50 g, preferably from 3 g to 10 g, per liter of the developing solution.

Antifoggants, for example, indazole, benzimidazole or benzotriazole antifoggants, are used in the developing solution according to the present invention. Specific examples include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazol-2-yl)thio]butanesulfonate, and 5-amino-1,3,4-thiadiazole-2-thiol. The addition amount of these antifoggants is from 0.01 to 10 mmol, more preferably from 0.1 to 2 mmol, per liter of the developing solution. Halide compounds such as potassium bromide and sodium bromide can be used in addition to the above organic antifoggants.

Further, various kinds of organic and inorganic chelating agents can be used in combination in the developing solution of the present invention. Examples of the inorganic chelating agents include sodium tetrapolyphosphate and sodium hexametaphosphate.

Examples of the organic chelating agents include organic carboxylic acid, aminopolycarboxylic acid, organic phosphonic acid, aminophosphonic acid, and organic phosphonocarboxylic acid.

Examples of the organic carboxylic acids include acrylic acid, oxalic acid, malonic acid, succinic acid, glutaric acid, adipic acid, pimelic acid, suberic acid, acielaidic acid, sebacic acid, nonanedicarboxylic acid, decanedicarboxylic acid, undecanedicarboxylic acid, maleic acid, itaconic acid, malic acid, citric acid, and tartaric acid.

Examples of the aminopolycarboxylic acids include iminodiacetic acid, nitrilotriacetic acid, nitrilotripropionic acid, ethylenediaminomonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminotetraacetic acid, and compounds disclosed in JP-A-52-25632, JP-A-55-67747, JP-A-57-102624, and JP-B-53-40900 (the term "JP-B" as used herein refers to an "examined Japanese patent publication").

Examples of the organic phosphonic acids include hydroxyalkylidene-diphosphonic acid disclosed in U.S. Pat. Nos. 3,214,454, 3,794,591 and German Patent Publication No. 2,227,639, and the compounds disclosed in *Research Disclosure,* Vol. 181, Item 18170 (May, 1979).

Examples of the aminophosphonic acids include aminotris(methylenephosphonic acid), ethylenediaminotetramethylenephosphonic acid, aminotrimethylenephosphonic acid, and the compounds disclosed in *Research Disclosure,* No. 18170, JP-A-57-208554, JP-A-54-61125, JP-A-55-29883 and JP-A-56-97347.

Examples of the organic phosphonocarboxylic acids include the compounds disclosed in JP-A-52-102726, JP-A-53-42730, JP-A-54-121127, JP-A-55-4024, JP-A-55-4025, JP-A-55-126241, JP-A-55-65955, and *Research Disclosure,* No. 18170.

These chelating agents may be used in the form of alkali metal salts or ammonium salts. The addition amount of these chelating agents is preferably from $1\times10^{-4}$ to $1\times10^{-1}$ mol, more preferably from $1\times10^{-3}$ to $1\times10^{-2}$ mol, per liter of the developing solution.

The developing solution for use in the present invention can contain various additives, if needed, in addition to the above described components, for example, a buffer (e.g., carbonate, alkanolamine), an alkali agent (e.g., hydroxide, carbonate), an auxiliary solvent (e.g., polyethylene glycols, esters thereof), a pH adjustor (e.g., organic acid such as acetic acid), a development accelerator (e.g., pyridinium compounds and other cationic compounds, cationic dyes such as phenosafranine, neutral salts such as thallium nitrate and potassium nitrate as disclosed in U.S. Pat. No. 2,648,604, JP-B-44-9503, and U.S. Pat. No. 3,171,247, polyethylene glycol and derivatives thereof, nonionic compounds such as polythioethers as disclosed in JP-B-44-9304, U.S. Pat. Nos. 2,533,990, 2,531,832, 2,950,970 and 2,577,127, organic solvents as disclosed in JP-B-44-9509 and Belgian Patent 682,862, thioether based compounds as disclosed in U.S. Pat. No. 3,201,242, and thioether based compounds are particularly preferred of them), and a surfactant.

The development processing temperature and the development. processing time are related reciprocally and determined in relationship with the total processing time, and generally the processing temperature is from about 20° C. to about 50° C. and the processing time is from 10 seconds to 2 minutes.

If $m^2$ of a silver halide black-and-white photographic material is processed, the replenishment rate of the developing solution is 700 ml or less and preferably 500 ml or less.

The fixing solution for use in the fixing step in the present invention is an aqueous solution containing sodium thiosulfate and ammonium thiosulfate, and if needed, water-soluble aluminum compound, tartaric acid, citric acid, gluconic acid, boric acid, and salts thereof.

The formation of sparingly soluble aluminum salts can be prevented by controlling the pH of the hardening fixing solution containing a water-soluble aluminum salt to a lower level. However, because the hardening fixing solution contains thiosulfate as a fixing solution, there occurs the problem of sulfurization when the solution is preserved as a concentrated liquid. On the other hand, if the pH of the fixing solution is high, the stability of the fixing agent is improved and the dyes dissolved out from the photographic material during processing are easily removed, but promotes the formation of sparingly soluble aluminum salts. Accordingly, the pH of one reagent type hardening fixing solution is from 4.6 to 4.9. However, even if the pH is in the above-described range, the formation of a sparingly soluble aluminum salt cannot completely be prevented. The preparation of a concentrated liquid is, therefore, particularly difficult. In general, a large quantity of a boron compound is used to solve these problems. The boron compound in a fixing solution is carried over to a washing step during processing by a photographic material and discharged in environment with a waste water. In the meantime, the environmental preservation has become a world-wide problem in recent years, and it has been strongly desired in photographic processing to reduce the boron compound contained in waste water.

It is preferred for the fixing solution for use in the present invention to use gluconic acid, iminodiacetic acid, 5-sulfosalicylic acid, derivatives thereof, and salts thereof for the stabilization of the aluminum salt in place of the boron compound (boric acid). The gluconic acid may be an anhydride having a lactone ring round it. Gluconic acid, iminodiacetic acid, alkali metal salts of these compounds, and ammonium salts of these compounds are particularly preferred of them. These compounds are used in one reagent type concentrated fixing solution substantially not containing a boric compound in an amount of from 0.01 to 0.45 mol/liter and preferably from 0.03 to 0.3 mol/liter.

They may be used alone or in combination with one or more compounds. Further, they are preferably used in the present invention in combination with the following compounds, for example, organic acids (e.g., malic acid, tartaric acid, citric acid, succinic acid, oxalic acid, maleic acid, glycolic acid, benzoic acid, salicylic acid, Tiron, ascorbic acid, glutaric acid, adipic acid), amino acids (e.g., aspartic acid, glycine, cysteine), aminopolycarboxylic acids (e.g., ethylenediaminetetraacetic acid, diethylenetriaminepentaacetic acid, 1,3-propanediaminetetraacetic acid, nitrilotriacetic acid) and saccharides.

Ammonium thiosulfate and sodium thiosulfate can be used as a fixing agent of the fixing solution in the present invention. The amount used of the fixing agent may be varied arbitrarily and that in the concentrated solution is generally from 0.8 to about 6 mol/liter.

The fixing solution of the present invention contains a water-soluble aluminum salt having an effect as a hardening agent, such as aluminum chloride, aluminum sulfate, potassium alum, and aluminum ammonium sulfate. They are preferably contained in an amount of from 0.01 to 0.15 mol/liter in terms of an aluminum ion concentration in the concentrated solution.

The pH of the concentrated fixing solution for use in the present invention is 4.6 or more and preferably from 4.7 to 5.0.

The fixing solution can include, if needed, a preservative (e.g., sulfite, bisulfite), a pH buffer (e.g., acetic acid, sodium carbonate, sodium hydrogencarbonate, phosphoric acid), a pH adjustor (e.g., sodium hydroxide, ammonia, sulfuric acid), a chelating agent having a water softening ability, compounds disclosed in JP-A-62-78551, a surfactant, a wetting agent, and a fixing accelerator. Specific examples of the surfactants include an anionic surfactant (e.g., a sulfated product, a sulfonated product), a polyethylene surfactant, and amphoteric surfactants disclosed in JP-A-57-6840, and known defoaming agents can also be used. Specific examples of the wetting agents include alkanolamine and alkylene glycol. Specific examples of the fixing accelerators include alkyl- and aryl-substituted thiosulfonic acid and the salts thereof, thiourea derivatives disclosed in JP-B-45-35754, JP-B-58-122535 and JP-B-58-122536, alcohol having a triple bond in the molecule, thioether compounds disclosed in U.S. Pat. No. 4,126,459, mercapto compounds disclosed in JP-A-1-4739, JP-A-1-159645 and JP-A-3-101728, mesoionic compounds disclosed in JP-A-4-170539, and ammonium thiocyanate.

The concentrated fixing solution for use in the present invention is diluted with water to a predetermined concentration when it is used. Particularly, it is diluted in the ratio of from 0.2 parts to 5 parts of water to one part of the concentrated fixing solution.

A photographic material is subjected to washing or stabilizing processing after being development processed and fixing processed. Washing or stabilizing processing can be carried out with a replenishing rate of 3 liters or less per $m^2$ of the silver halide photographic material (including zero, i.e., washing in a reservoir). That is, not only water saving processing can be carried out but also piping for installation of an automatic processor is not required. When washing is carried out with a reduced amount of water, it is preferred to use a washing tank equipped with a squeegee roller disclosed in JP-A-63-18350 and JP-A-62-287252. The addition of various kinds of oxidizing agents and the provision of filters for filtration may be combined to reduce environmental pollution which becomes a problem when washing is carried out with a small amount of water. Further, all or a part of the overflow generated from the washing tank or the stabilizing tank by the replenishment of the water applied with an antimold means by the method according to the present invention to the washing tank or the stabilizing tank in proportion to the progress of the processing can be utilized in the preceding processing step, i.e., a processing solution having a fixing ability as disclosed in JP-A-60-235133. Moreover, a water-soluble surfactant or a defoaming agent may be included in washing water to prevent generation of irregular foaming which is liable to generate when washing is conducted with a small amount of water and/or to prevent components of the processing agents adhered to a squeegee roller from transferring to the processed film. In addition, dye adsorbents disclosed in JP-A-63-163456 may be included in a washing tank to inhibit contamination by dyes dissolved from photographic materials.

When a photographic material is. subjected to stabilizing processing after the washing processing, bath containing compounds disclosed in JP-A-2-201357, JP-A-2-132435, JP-A-1-102553 and JP-A-46-44446 may be used as a final bath. This stabilizing bath may contain, if needed, ammonium compounds, metal compounds such as Bi and Al, brightening agents, various kinds of chelating agents, film pH adjustors, hardening agents, sterilizers, antimold agents, alkanolamines, and surfactants. Tap water, deionized water, and water sterilized by a halogen, ultraviolet sterilizing lamp or various oxidizing agents (e.g., ozone, hydrogen peroxide, chlorate) are preferably used as washing water in a washing step or a stabilizing step.

The photographic materials of the present invention are not particularly restricted as to additives, and so various kinds of additives can be used therein. However, those disclosed in the following patent specifications can be preferably added thereto.

| Item | Reference and Passage therein |
|---|---|
| 1) Spectral sensitizing dyes which may be used in combination | Spectral sensitizing dyes disclosed in JP-A-2-12236, from p.8, left lower column, line 13 to right lower column, line 4; JP-A-2-103536, from p.16, right lower column to p.17, left lower column, 1.20; JP-A-1-112235, JP-A-124560, JP-A-3-7928, JP-A-5-11389. |

-continued

| Item | Reference and Passage therein |
|---|---|
| 2) Surfactants | JP-A-2-122363, at page 9, from right upper column, line 7, to right lower column, line 7; and JP-A-2-18542, from page 2, left lower column, line 13, to page 4, right lower column, line 18. |
| 3) Antifoggants | JP-A-2-103536, from page 17, right lower column, line 19, to page 18, right upper column, line 4, and page 18, right lower column, from line 1 to line 5; the thiosulfinic acid compounds disclosed in JP-A-1-237538. |
| 4) Polymer latexes | JP-A-2-103536, page 18, left lower column, from line 6 to line 20. |
| 5) Compounds containing an acidic group | JP-A-2-103536, from page 18, left lower column, line 6, to page 19, left upper column, line 1; JP-A-2-55349, from page 8, light lower column, line 13, to page 11, left upper column, line 8. |
| 6) Matting agent, Slipping agent, and Plasticizers | JP-A-2-103536, at page 19, from left upper column, line 15, to right upper column, line 15. |
| 7) Hardeners | JP-A-2-103536, at page 18, right upper column, from line 5 to line 17. |
| 8) Dyes | JP-A-2-103536, at page 17, right lower column, from line 1 to line 18; the solid dyes disclosed in JP-A-2-294638 and JP-A-5-11382. |

The present invention will now be illustrated in greater detail by reference to the following examples. However, the invention should not be construed as being limited to these examples.

EXAMPLES

The present invention-is described in detail by way of the following examples, but lit should be understood that the present invention is not to be deemed to be limited thereto.

EXAMPLE 1

| Preparation of Emulsion | |
|---|---|
| First Liquid | |
| Water | 750 ml |
| Gelatin | 20 g |
| Sodium Chloride | 3 g |
| 1,3-Dimethylimidazolidine-2-thione | 20 mg |
| Sodium Thiosulfonate | 10 mg |
| Second Liquid | |
| Water | 300 ml |
| Silver Nitrate | 150 g |
| Third Liquid | |
| Water | 300 ml |
| Sodium Chloride | 34 g |
| Potassium Bromide | 32 g |
| Potassium Hexachloroiridate | 0.25 mg |
| Ammonium Hexabromorhodate | 0.06 mg |

The second and third liquids in the amounts corresponding to 90% of each were simultaneously added to the first liquid maintained at 38° C. and pH 4.5 over a period of minutes with stirring, and nucleus grains having a diameter of 0.20 μm were formed. Subsequently, the fourth and fifth liquids shown below were added over a period of 8 minutes to grow the nucleus grains to a diameter of 0.24 μm. Further, the remaining amount of 10% of the second and third liquids were added over a period of 2 minutes to obtain the nucleus grains having a diameter of 0.25 μm. Moreover, 0.15 g of potassium iodide was added and grain formation was completed.

| | |
|---|---|
| Fourth Liquid | |
| Water | 100 ml |
| Silver Nitrate | 50 g |
| Fifth Liquid | |
| Water | 100 ml |
| Sodium Chloride | 14 mg |
| Potassium Bromide | 11 mg |
| Potassium Ferrocyanide | 5 mg |

The mixture was then washed according to the ordinary flocculation method and 40 g of gelatin was added. The pH and pAg were adjusted to 5.8 and 7.5, respectively, and 1 mg of sodium thiosulfate, 1 mg of Compound (a) and 5 mg of chloroauric acid were added and optimal chemical sensitization was carried out at 55° C. Further, 200 mg of 1,3,3a, 7-tetrazaindene was added as a stabilizer.

Finally, a cubic silver iodochlorobromide grain emulsion having an average grain size of 0.25 μm which contained 70 mol % of silver chloride and 0.08 mol % of silver iodide was obtained (variation coefficient: 9%).

Compound (a)

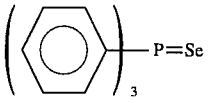

The sensitizing dye ($5.5\times10^{-4}$ mol, shown in Table 3), 5 g of Br, 5 g of KI, and 50 g, 0.4 g and 0.1 g of hydroquinone, the following Compound (b) and Compound (c), respectively, as stabilizers, each per mol of Ag, were added to the thus-obtained emulsion.

Compound (b)

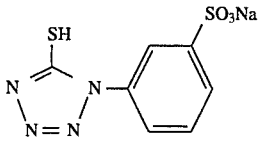

Compound (c)

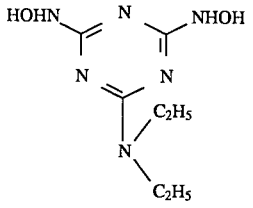

Further, 0.3 g of Compound III-38 as a nucleating agent and 0.2 g of Compound A-111 as a nucleation accelerator were added to the emulsion. Sodium dodecylbenzenesulfonate (0.4 g) was added, polyethylacrylate latex and colloidal silica having a particle size of 0.01 pm were added in amounts of respectively 30% with respect to the gelatin binder, and 2-bis(vinylsulfonylacetamido)ethane was added as a hardening agent in an amount of 4% with respect to the gelatin binder. The emulsion was then coated on a polyester support to provide a coated silver weight of 3.2 g/m$^2$ and a coated gelatin weight of 1.4 g/m$^2$. Further, an upper protective layer, a lower protective layer and a subbing layer having the compositions indicated in Table 1 were simultaneously coated. Moreover, a BC layer and a BC protective layer having the compositions indicated in Table 2 were coated on the backside of the support.

TABLE 1

| | per m$^2$ |
|---|---|
| Lower Protective Layer | |
| Gelatin | 0.5 g |
| 1,5-Dihydroxy-2-benzaldoxime | 25 mg |
| α-Lipoic Acid | 5 mg |
| Polyethyl Acrylate Latex | 160 mg |
| Upper Protective Layer | |
| Gelatin | 0.3 g |
| Silica Matting Agent (average size: 2.5 μm) | 30 mg |
| Silicone Oil | 30 mg |
| Colloidal Silica (particle size: 0.01 μm) | 30 mg |
| N-Perfluorooctanesulfonyl-N-propylglycine Potassium Salt | 10 mg |
| Sodium Dodecylbenzenesulfonate | 25 mg |
| Subbing Layer | |
| Gelatin | 0.5 g |
| Compound (d) | 20 mg |
| N-Oleyl-N-methyltaurine Sodium Salt | 10 mg |

Compound (d)

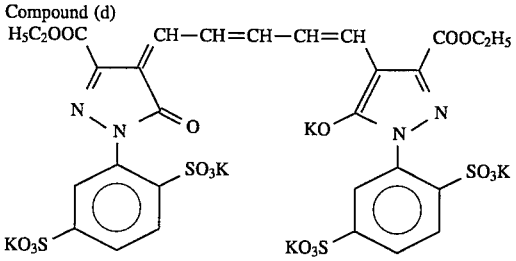

TABLE 2

| | per m$^2$ |
|---|---|
| BC Layer | |
| Gelatin | 0.25 g |
| Sodium Dodecylbenzenesulfonate | 20 mg |
| $SnO_2/SbO_2$ (9/1) (average grain size: 0.25 μm) | 200 mg |
| BC Protective Layer | |
| Gelatin | 3.0 g |
| Polymethyl Methacrylate (average grain size: 3.5 μm) | 50 mg |
| Compound (e) | 35 mg |
| Compound (f) | 35 mg |
| Compound (g) | 120 mg |
| Sodium Acetate | 10 mg |
| Sodium Dodecylbenzenesulfonate | 90 mg |
| 2-Bis(vinylsulfonylacetamido)ethane | 160 mg |

Compound (e)

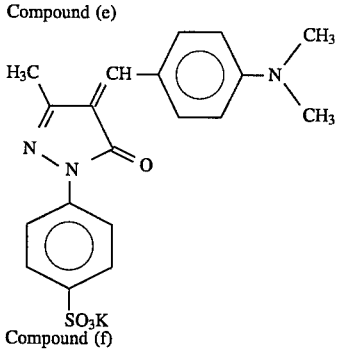

Compound (f)

TABLE 2-continued per $m^2$

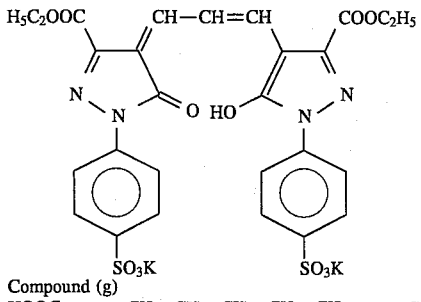

Compound (g)

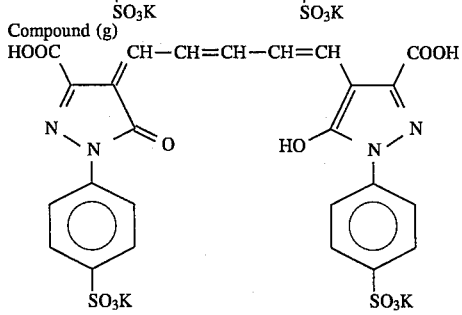

Evaluation of Photographic Performance

The samples obtained were exposed with a xenon flash light of $10^{-6}$ sec through an interference filter which had a peak at 633 nm and a step wedge, processed at 35° C. for 30 sec. using automatic processor FG-680AG (produced by Fuji Photo Film Co., Ltd.), and subjected to sensitometry.

The reciprocal of the exposure required to provide a density of 1.5 was taken as the sensitivity and this is shown as a relative sensitivity. The gradient of the straight line joining the points of density 0.1 and 3.0 was taken as the gradation.

Evaluation of Black Spots

Black spots of the processed samples were evaluated microscopically in five grades. The five evaluation grades represented from "5" being best to "1" being worst. "5" and "4" are practically usable, "3" is at a limiting level for practical use, and "2" and "1" are impracticable.

Evaluation of Residual Color

Unexposed samples were processed at a washing temperature of the automatic processor of 10° C. The residual color after processing was evaluated visually in five grades.

Evaluation of Preservability

Samples which were stored for three days under 50° C., 60% RH conditions were subjected to sensitometry and the change of the sensitivity was shown in percentage (ΔS).

The composition of the developing solution which was used is shown below.

| Composition of Developing Solution 1 | |
|---|---|
| Potassium Hydroxide | 35 g |
| Diethylenetriaminepentaacetic Acid | 2 g |
| Potassium Carbonate | 12 g |
| Sodium Metabisulfite | 40 g |
| Potassium Bromide | 3 g |
| Hydroquinone | 25 g |
| 5-Methylbenzotriazole | 0.08 g |
| 4-Hydroxymethyl-4-methyl-1-phenyl-3-pyrazolidone | 0.45 g |
| 2,3,5,6,7,8-Hexahydro-2-thioxo-4-(H)-quinazolinone | 0.04 g |
| Sodium 2-Mercaptobenzimidazole-5-sulfonate | 0.15 g |
| Diethylene Glycol | 20 g |
| Water to make | 1 liter |
| pH was adjusted to 10.45 with potassium hydroxide | |

The composition of the fixing solution which was used is shown below.

| | |
|---|---|
| Ammonium Thiosulfate | 359 g |
| Disodium Ethylenediaminetetraacetate Dihydrate | 2.3 g |
| Sodium Thiosulfate Pentahydrate | 33 g |
| Sodium Sulfite | 75 g |
| NaOH | 37 g |
| Glacial Acetic Acid | 87 g |
| Tartaric Acid | 8.8 g |
| Sodium Gluconate | 6.6 g |
| Aluminum Sulfate | 25 g |
| pH (adjusted with sulfuric acid or sodium hydroxide) | 5.05 |
| Water to make | 1 liter |
| Further, 2 liters of water is added to dilute the solution for use. | |

TABLE 3

| Sample No. | Sensitizing Dye | Photographic Performance: Sensitivity | Photographic Performance: Gradation | Black Spots | Residual Color | Preservability ΔS | Remarks |
|---|---|---|---|---|---|---|---|
| 1 | I-1 | 100 | 21 | 4 | 5 | +5 | Invention |
| 2 | I-7 | 103 | 19 | 4 | 5 | +7 | " |
| 3 | I-5 | 102 | 20 | 4 | 5 | +6 | " |
| 4 | I-22 | 98 | 23 | 4 | 5 | +7 | " |
| 5 | I-23 | 90 | 18 | 4 | 5 | +6 | " |
| 6 | I-27 | 90 | 18 | 4 | 5 | +7 | " |
| 7 | I-29 | 85 | 17 | 4 | 4 | +6 | " |
| 8 | I-33 | 80 | 18 | 4 | 3 | +8 | " |
| 9 | I-32 | 102 | 21 | 5 | 3 | +10 | " |
| 10 | (h) | 70 | 19 | 3 | 1 | +18 | Comparison |
| 11 | (i) | 60 | 18 | 2 | 2 | +30 | " |
| 12 | (j) | 58 | 20 | 2 | 3 | +25 | " |

Dye (h)

TABLE 3-continued

| Sample No. | Sensitizing Dye | Photographic Performance Sensitivity | Photographic Performance Gradation | Black Spots | Residual Color | Preservability ΔS | Remarks |
|---|---|---|---|---|---|---|---|

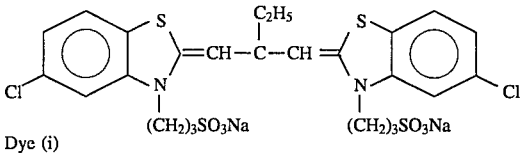

Dye (i)

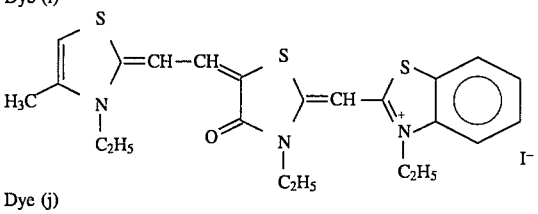

Dye (j)

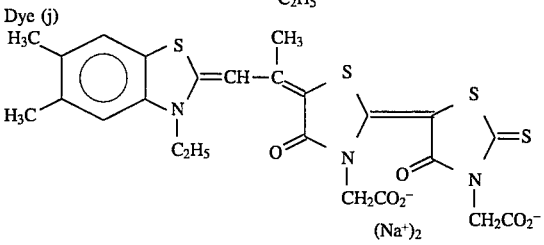

It can be seen from the table that Sample Nos. 1 to 9 of the present invention are superior to comparative dyes in all of photographic performance, inhibition of black spots, residual color and preservability.

EXAMPLE 2

Samples were prepared in the same manner as Sample No. 1 in Example 1, except that nucleating agents were changed as indicated in Table 4. The results obtained are shown in Table 4. It can be seen that the present samples also show excellent results. A sample which did not contain a nucleating agent was also evaluated for comparison. This sample could not provide sufficient gradation.

TABLE 4

| Sample No. | Nucleating Agent | Photographic Performance Sensitivity | Photographic Performance Gradation | Black Spots | Residual Color | Preservability ΔS | Remarks |
|---|---|---|---|---|---|---|---|
| 13 | III-4 | 102 | 18 | 4 | 5 | +5 | Invention |
| 14 | III-10 | 98 | 19 | 4 | 5 | +7 | " |
| 15 | III-29 | 99 | 20 | 4 | 5 | +8 | " |
| 16 | III-31 | 110 | 20 | 4 | 5 | +7 | " |
| 17 | III-36 | 89 | 19 | 4 | 5 | +6 | " |
| 18 | III-41 | 95 | 21 | 4 | 5 | +7 | " |
| 19 | III-44 | 100 | 18 | 4 | 5 | +6 | " |
| 20 | III-47 | 98 | 20 | 4 | 5 | +7 | " |
| 21 | III-49 | 100 | 19 | 4 | 5 | +6 | " |
| 22 | None | 60 | 7 | 4 | 5 | +10 | Comparison |

EXAMPLE 3

Samples were prepared in the same manner as Sample No. 1 in Example 1, except that sensitizing dyes and nucleation accelerators were changed as indicated in Table 5. The results obtained are shown in Table 5.

TABLE 5

| Sample No. | Sensitizing Dye | Nucleation Accelerator: Compound | Nucleation Accelerator: Amount Added (mol/mol Ag) | Photographic Performance: Sensitivity | Photographic Performance: Gradation | Preservability (ΔS) (%) | Residual Color | Remarks |
|---|---|---|---|---|---|---|---|---|
| 23 | (h) | — | — | 90 | 15 | +12 | 2 | Comparison |
| 24 | I-1 | — | — | 85 | 14 | +5 | 3 | " |
| 25 | I-4 | — | — | 87 | 15 | +6 | 3 | " |
| 26 | I-31 | — | — | 88 | 15 | +5 | 3 | " |
| 27 | (h) | A-111 | $3.1 \times 10^{-4}$ | 100 | 20 | +10 | 3 | " |
| 28 | " | A-120 | " | 101 | 19 | +11 | 2 | " |
| 29 | I-1 | A-111 | " | 100 | 21 | +5 | 5 | Invention |
| 30 | " | " | $1.5 \times 10^{-4}$ | 99 | 20 | +6 | 4 | " |
| 31 | " | A-120 | $3.1 \times 10^{-4}$ | 103 | 21 | +6 | 5 | " |
| 32 | " | VI-2 | " | 102 | 21 | +5 | 5 | " |
| 33 | " | VIII-2 | " | 103 | 20 | +5 | 5 | " |
| 34 | " | IV-9 | " | 100 | 19 | +5 | 5 | " |
| 35 | I-1 | V-7 | $3.1 \times 10^{-4}$ | 99 | 20 | +6 | 5 | Invention |
| 36 | I-7 | A-111 | " | 101 | 21 | +7 | 5 | " |
| 37 | I-24 | " | " | 101 | 21 | +6 | 5 | " |

As is apparent from the results shown in Table 5, Sample Nos. 29 to 37 according to the present invention provide high contrast, change of sensitivity under high temperature conditions is little, and are excellent in residual color level.

EXAMPLE 4

Sample Nos. 24, 29, 32 and 36 prepared in Example 3 were processed with the developing solution prepared by adding the following compounds (k), (l) and (m) to developing solution used in Example 1 as indicated in Table 6. The results obtained are shown in Table 7.

TABLE 6

| Developing Solution No. | Compound No. | Amount Added (g/liter) |
|---|---|---|
| Solution 1 | — | — |
| Solution 2 | (k) | 5.9 |
| Solution 3 | (l) | 6.2 |
| Solution 4 | (m) | 5.3 |

(k)

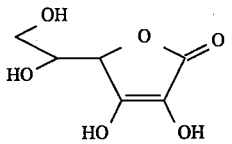

(l)

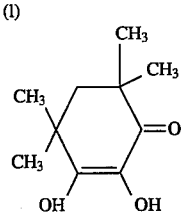

TABLE 6-continued

| Developing Solution No. | Compound No. | Amount Added (g/liter) |
|---|---|---|
| (m) 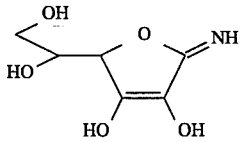 | | |

TABLE 7

| Test No. | Sample No. | Developing Solution | Photographic Performance: Sensitivity | Photographic Performance: Gradation | Black Spots | Remarks |
|---|---|---|---|---|---|---|
| 1 | 24 | 1 | 100 | 21 | 3 | Comparison |
| 2 | " | 2 | 99 | 20 | 4 | " |
| 3 | " | 3 | 99 | 19 | 4 | " |
| 4 | " | 4 | 100 | 20 | 4 | " |
| 5 | 29 | 1 | 100 | 21 | 4 | Invention |
| 6 | " | 2 | 101 | 20 | 5 | " |
| 7 | " | 3 | 101 | 21 | 5 | " |
| 8 | " | 4 | 102 | 22 | 5 | " |
| 9 | 32 | 1 | 100 | 21 | 4 | " |
| 10 | " | 2 | 99 | 21 | 5 | " |
| 11 | " | 3 | 100 | 20 | 5 | " |
| 12 | " | 4 | 100 | 20 | 5 | " |
| 13 | 36 | 1 | 101 | 21 | 4 | " |
| 14 | " | 2 | 102 | 22 | 5 | " |
| 15 | " | 3 | 102 | 21 | 5 | " |
| 16 | " | 4 | 101 | 22 | 5 | " |

As is apparent from the results shown in Table 7, black spots were prevented excellently according to the processing method of the present invention.

While the invention has been described in detail and with reference to specific examples thereof, it will be apparent to one skilled in the art that various changes and modifications can be made therein without departing from the spirit and scope thereof.

What is claimed is:

1. A silver halide photographic material, which comprises a support having thereon at least one silver halide emulsion layer, wherein the silver halide emulsion layer or other hydrophilic colloid layer contains at least one hydrazine compound and an onium salt compound as a nucleation accelerator, and wherein the silver halide emulsion is spectrally sensitized with at least one compound represented by the following formula (I):

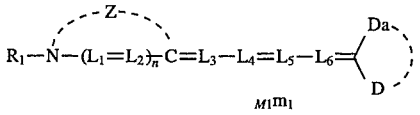

(I)

wherein $R_1$ represents an alkyl group; Z represents an atomic group necessary for forming a 5- or 6-membered nitrogen-containing heterocyclic ring; D and $D_a$ represent an atomic group necessary for forming a non-cyclic or cyclic acid nucleus; $L_1$, $L_2$, $L_3$, $L_4$, $L_5$ and $L_6$ each represents a methine group; $M_1$ represents a charge neutralizing counter ion; $m_1$ represents a number of 0 or more necessary for neutralizing a charge in the molecule; and n represents 0 or 1.

2. The silver halide photographic material as claimed in claim 1, wherein the compound represented by formula (I) is selected from the compounds represented by the following formula (II):

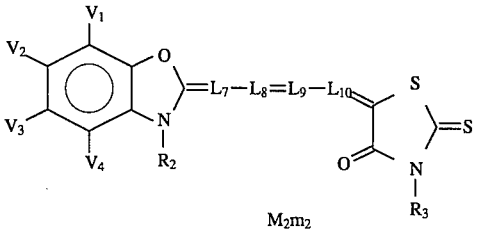

(II)

wherein $R_2$ and $R_3$ each represents an alkyl group containing a group having a water solubility as a form of free acid or salt; $V_1$, $V_2$, $V_3$ and $V_4$ each represents a hydrogen atom or a monovalent substituent, with the proviso that the total molecular weight of $V_1$, $V_2$, $V_3$ and $V_4$ is 50 or less; $L_7$, $L_8$, $L_9$ and $L_{10}$ each represents a methine group; $M_2$ represents a charge neutralizing counter ion; and $m_2$ represents a number of 0 or more necessary for neutralizing a charge in the molecule.

3. The silver halide photographic material as claimed in claim 1, wherein the nucleation accelerator is a phosphonium salt.

4. The silver halide photographic material as claimed in claim 2, wherein the compound represented by formula (II) is a compound represented by the following formula (II-a):

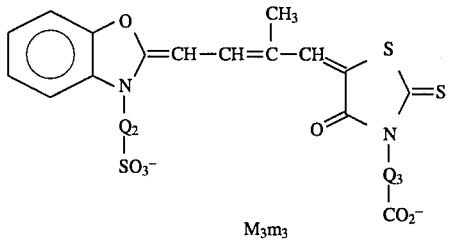

(II-a)

wherein $M_3$ has the same meaning as $M_1$ or $M_2$; $m_3$ has the same meaning as $m_1$ or $m_2$; and $Q_2$ and $Q_3$ each have the same meaning as $Q_1$.

5. The silver halide photographic material as claimed in claim 1, wherein the onium salt compound is an ammonium salt, a pyridinium salt or a phosphonium salt.

6. The silver halide photographic material as claimed in claim 3, wherein the phosphonium salt is a compound represented by formula (A):

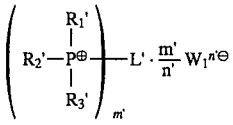

(A)

wherein $R_1'$, $R_2'$ and $R_3'$ each represents an alkyl group, a cycloalkyl group, an aryl group, an alkenyl group, a cycloalkenyl group or a heterocyclic group; m' represents an integer of from 1 to 4; L' represents an m'-valent organic group bonded with a P atom via the carbon atom thereof; n' represents an integer of from 1 to 3; and $W_1$ represents an n'-valent anion, and $W_1$ may be linked with L'.

* * * * *